US009615663B2

(12) United States Patent
Davis

(10) Patent No.: US 9,615,663 B2
(45) Date of Patent: Apr. 11, 2017

(54) MODULAR TOOL-LESS FURNITURE

(71) Applicant: Clark Evan Davis, Provo, UT (US)

(72) Inventor: Clark Evan Davis, Provo, UT (US)

( * ) Notice: Subject to any disclaimer, the term of this patent is extended or adjusted under 35 U.S.C. 154(b) by 0 days.

(21) Appl. No.: 14/214,914

(22) Filed: Mar. 15, 2014

(65) Prior Publication Data

US 2014/0263130 A1 Sep. 18, 2014

Related U.S. Application Data

(60) Provisional application No. 61/802,609, filed on Mar. 16, 2013, provisional application No. 61/837,924, filed on Jun. 21, 2013, provisional application No. 61/891,844, filed on Oct. 16, 2013.

(51) Int. Cl.

| | |
|---|---|
| ***A47B 47/00*** | (2006.01) |
| ***A47B 96/14*** | (2006.01) |
| ***A47B 47/04*** | (2006.01) |

(52) U.S. Cl.

CPC ..... *A47B 96/145* (2013.01); *A47B 47/0075* (2013.01); *A47B 47/042* (2013.01)

(58) Field of Classification Search

CPC ..... A47B 47/0075; A47B 47/0091; A47B 96/145; A47B 47/042; A47B 47/0066; A47B 47/06; A47B 47/00; A47B 43/00; A47B 43/02; A47B 57/00; A47B 57/10; A47B 96/1458; A47B 96/205; A47B 96/206; B65D 5/48038

USPC ..... 211/183, 186, 189, 72, 134, 188, 194; 297/440.13, 440.12; 229/933, 120.36, 229/120.38; 217/22, 30–33; 312/265.5

See application file for complete search history.

(56) References Cited

U.S. PATENT DOCUMENTS

| | | | | |
|---|---|---|---|---|
| 919,257 | A | 4/1909 | Seydewitz | |
| 1,061,297 | A * | 5/1913 | Johnson | 229/122.21 |
| 1,419,647 | A | 6/1922 | Shepherdson | |
| 1,747,900 | A | 2/1930 | Jenny | |
| 1,903,631 | A | 4/1933 | Morrison | |
| 1,940,117 | A | 12/1933 | Carpos | |
| 2,279,864 | A | 4/1942 | Eide | |
| 2,334,912 | A | 11/1943 | Eide | |

(Continued)

FOREIGN PATENT DOCUMENTS

| | | |
|---|---|---|
| DE | 102007058662 | 6/2009 |
| GB | 2353080 | 2/2001 |
| NL | 1025719 | 9/2005 |
| WO | WO 2005-085656 | 9/2005 |

OTHER PUBLICATIONS

Celery Rocking Chair viewed at http://www.eroomservice.com/manufacturer/celery/ circa Dec. 3, 2011.

(Continued)

*Primary Examiner* — Daniel J Troy
*Assistant Examiner* — Hiwot Tefera
(74) *Attorney, Agent, or Firm* — Pate Peterson PLLC; Brett Peterson

(57) ABSTRACT

Modular furniture is provided. The modular furniture includes joint and furniture components which allow the furniture to be assembled without tools and which provide increased stability and strength to the furniture. The modular furniture also provides increased attractiveness and user customization while using a limited number of different components.

20 Claims, 47 Drawing Sheets

(56) References Cited

U.S. PATENT DOCUMENTS 2,369,930 A 2/1945 Wagner
D144,730 S 5/1946 Perrault
2,418,731 A 4/1947 Seitz
2,479,086 A 8/1949 Silverman
2,481,671 A 9/1949 John et al.
2,486,987 A 11/1949 Scarlett
2,518,955 A 8/1950 Stelzer
2,534,413 A 12/1950 Cenis
2,551,071 A 5/1951 Tyncs
D164,552 S 9/1951 Curtis
2,595,002 A 4/1952 Schneider
2,602,012 A 7/1952 Doty
2,615,771 A 10/1952 Curtis
2,632,498 A 3/1953 Curtis
2,672,181 A 3/1954 Rose
2,677,491 A * 5/1954 Burger ..... B65D 85/327 206/521.5
2,720,253 A 10/1955 Turner
2,792,877 A 5/1957 West
2,825,101 A 3/1958 Rubsnstein
3,149,880 A 9/1964 Steuer
3,186,027 A 6/1965 Merillat
3,262,405 A 7/1966 Sutton
3,300,245 A 1/1967 Rumble
D212,601 S 11/1968 Rubenstein
3,527,497 A 9/1970 Self
3,547,491 A 12/1970 Bovasso
3,578,385 A 5/1971 Stiglitz
3,603,656 A 9/1971 Ferman
3,697,363 A 10/1972 Martinez
3,788,700 A 1/1974 Wartes
3,812,977 A 5/1974 Glassman
3,847,435 A 11/1974 Skinner
4,055,924 A 11/1977 Beaver
D247,596 S * 3/1978 Hashimoto ..... D6/371
4,082,356 A 4/1978 Johnson
4,103,818 A * 8/1978 Raubenheimer ... B65D 5/48038 206/459.5
4,140,065 A 2/1979 Chacon
4,153,311 A * 5/1979 Takahashi ..... 312/107
4,158,277 A 6/1979 Krempp et al.
4,188,067 A 2/1980 Elmer
4,191,113 A 3/1980 Hogberg
4,202,581 A 5/1980 Fleishman
4,225,180 A 9/1980 Gillis
4,348,052 A 9/1982 Roland
4,390,204 A 6/1983 Fleishman
4,419,028 A 12/1983 Roland
4,433,753 A 2/1984 Watson
4,433,843 A 2/1984 Bricco
4,492,332 A * 1/1985 Collins ..... B65D 5/48038 229/120.36
4,509,794 A 4/1985 Roland
4,533,174 A * 8/1985 Fleishman ..... A47B 3/06 297/16.1
4,544,092 A * 10/1985 Palmer ..... B65D 5/48038 217/31
4,548,350 A * 10/1985 Engle ..... B65D 5/48038 217/31
4,574,917 A 3/1986 Stoddard
4,591,090 A * 5/1986 Collins ..... B65D 5/48038 217/32
4,593,950 A 6/1986 Infanti
4,595,105 A 6/1986 Gold
D289,234 S 4/1987 Hoult
4,685,609 A * 8/1987 Ferrari ..... B65D 5/48038 217/32
4,712,837 A 12/1987 Swilley
4,759,449 A 7/1988 Gold
D299,087 S 12/1988 Bruce
4,841,878 A 6/1989 Kriegsman
D302,216 S 7/1989 Roland
4,846,530 A 7/1989 Noble
4,867,327 A 9/1989 Roland
4,878,439 A 11/1989 Samson
4,926,759 A 5/1990 Vitsky et al.
5,011,228 A 4/1991 Marcantel
5,082,329 A 1/1992 Mars
5,253,595 A 10/1993 Heidmann
5,263,766 A 11/1993 McCullough
5,275,467 A 1/1994 Kawecki
5,367,964 A 11/1994 Hockensmith
5,387,027 A 2/1995 Maloney
5,454,331 A 10/1995 Green
5,605,378 A 2/1997 Oyediran
5,644,995 A 7/1997 Gurwell et al.
5,655,812 A 8/1997 Albecker
5,765,922 A 6/1998 Hsia
5,803,548 A 9/1998 Battle
5,921,631 A 7/1999 Bush
5,927,816 A 7/1999 Hsu
5,941,377 A * 8/1999 Hart ..... B65D 71/0077 206/175
5,992,938 A 11/1999 Jones
6,036,270 A 3/2000 Bufalini
6,041,920 A * 3/2000 Hart ..... B65D 71/0077 206/175
D422,799 S 4/2000 Dworshak et al.
6,053,585 A 4/2000 Osen
6,109,695 A 8/2000 Kahwaji
6,126,022 A 10/2000 Merkel
6,155,641 A 12/2000 Frost
6,174,116 B1 1/2001 Brand
6,189,974 B1 2/2001 Beck
6,247,754 B1 6/2001 Vanderaue et al.
6,283,564 B1 9/2001 Corson
6,347,772 B1 * 2/2002 L'Hotel ..... 248/174
6,378,707 B1 4/2002 Taggert
6,443,076 B1 9/2002 Case
6,532,878 B2 * 3/2003 Tidemann ..... 108/186
6,595,378 B2 * 7/2003 Wang ..... 211/189
6,615,746 B2 9/2003 Bart
6,615,999 B1 * 9/2003 Culp ..... 211/186
6,619,749 B2 9/2003 Willy
6,675,979 B2 1/2004 Taylor
6,769,369 B1 8/2004 Brandenberg
6,807,912 B2 10/2004 Willy
D499,577 S 12/2004 Willy
6,845,871 B1 1/2005 Culp
6,848,747 B1 2/2005 Robinson
6,955,401 B1 10/2005 Shoulberg
7,066,548 B2 6/2006 Butler
7,114,300 B1 * 10/2006 Culp ..... 52/211
7,168,766 B2 1/2007 Pelletier
7,219,962 B2 5/2007 Stone
D547,076 S 7/2007 Hughes et al.
7,255,403 B2 8/2007 Butler
7,300,110 B1 11/2007 Debien
7,533,940 B1 5/2009 Zook
7,631,605 B2 12/2009 Willy
7,856,772 B1 12/2010 Culp et al.
8,167,377 B2 5/2012 Kovach
8,220,399 B2 * 7/2012 Berent et al. ..... 108/158.12
8,590,976 B2 * 11/2013 Davis ..... 297/440.13
8,832,917 B1 * 9/2014 Elliott ..... 29/428
2003/0107255 A1 6/2003 Willy
2004/0056526 A1 3/2004 Willy
2008/0074013 A1 3/2008 Ahlgrim et al.
2009/0066140 A1 * 3/2009 Berent et al. ..... 297/440.13
2010/0003077 A1 1/2010 Kelley
2012/0080910 A1 * 4/2012 Davis ..... 297/118
2013/0080286 A1 * 3/2013 Rotholz ..... A47C 5/005 705/26.5
2013/0170904 A1 * 7/2013 Cappelle ..... A47B 47/042 403/381

OTHER PUBLICATIONS

PlyGrid Shelves viewed at http://offi.com/products/offikids/PLYGRID.php?p2c=249 circa Dec. 3, 2011.
Snap Table viewed at http://www.offi.com/pdfs/snaptable.pdf circa Dec. 3, 2011.

(56) References Cited

OTHER PUBLICATIONS

Furniture viewed at http://www.playatech.com/product_list.php circa Dec. 3, 2011.
Arabic Table viewed at http://www.plydea.com/support/assemblypdf.html circa Dec. 3, 2011.
Blue7Chair viewed at http://www.plydea.com/support/assemblypdf.html circa Dec. 3, 2011.
First Desk viewed at http://www.plydea.com/support/assemblypdf.html circa Dec. 3, 2011.
Rinaldo Chair viewed at http://www.plydea.com/support/assemblypdf.html circa Dec. 3, 2011.
Tuffet Stool viewed at http://www.plydea.com/support/assemblypdf.html circa Dec. 3, 2011.
WasteNot Basket viewed at http://www.plydea.com/support/assemblypdf.html circa Dec. 3, 2011.
Winehold Wine Rack viewed at http://www.plydea.com/support/assemblypdf.html circa Dec. 3, 2011.

* cited by examiner

MODULAR TOOL-LESS FURNITURE

PRIORITY

The present application claims the benefit of U.S. Provisional Application Ser. No. 61/802,609, filed Mar. 16, 2013, which is herein incorporated by reference in its entirety, claims the benefit of U.S. Provisional Application Ser. No. 61/837,924, filed Jun. 21, 2013, which is herein incorporated by reference in its entirety, and also claims the benefit of U.S. Provisional Application Ser. No. 61/891,844, filed Oct. 16, 2013, which is herein incorporated by reference in its entirety.

THE FIELD OF THE INVENTION

The present invention relates to furniture. In particular, examples of the present invention relates to a modular furniture system which provides improved joints allowing toolless assembly and increased stability.

BACKGROUND

Many persons desire modular furniture. Modular furniture is often assembled by the end user from flat pieces and is thus easy to store and transport in the un-assembled form. Modular furniture often suffers from instability, and in some instances modular furniture is made overly complex or uses more permanent fastening or construction methods to stabilize the furniture. This, however, makes the furniture more cumbersome for the end user and reduces some of the portability and ease of use associated with this type of furniture. Additionally, the use of fasteners such as screws or nails to stabilize the furniture is often problematic in the long term as these fasteners become loose with use and movement of the furniture.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

Figure 1:
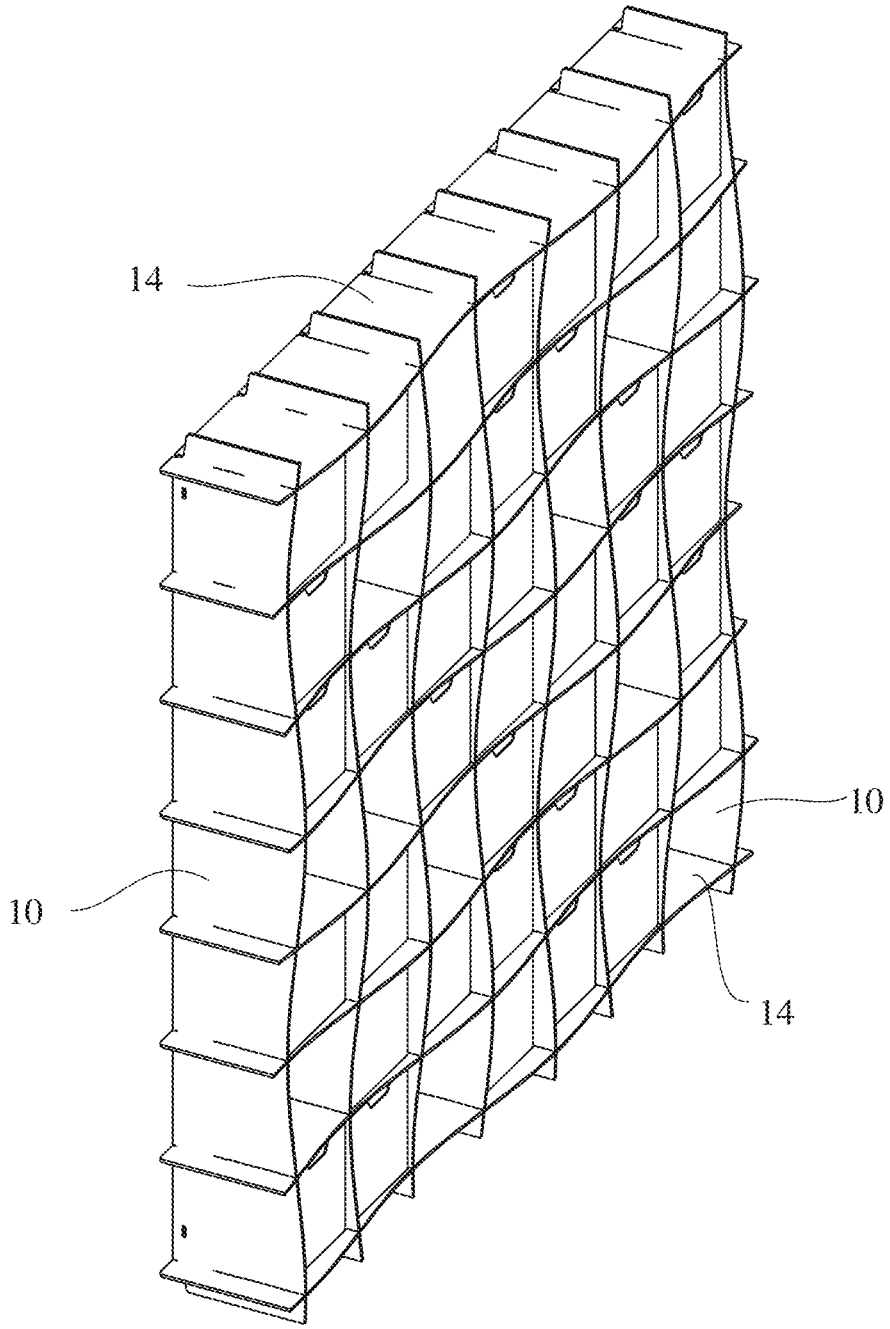
FIGS. 1 through 8 show a shelving grid and parts thereof.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various examples of the present invention. Also, common but well-understood elements that are useful or necessary in a commercially feasible embodiment are often not depicted in order to facilitate a less obstructed view of these various embodiments of the present invention.

It will be appreciated that the drawings are illustrative and not limiting of the scope of the invention which is defined by the appended claims. The examples shown each accomplish various different advantages. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Toolless Grid Storage

Figure 2:
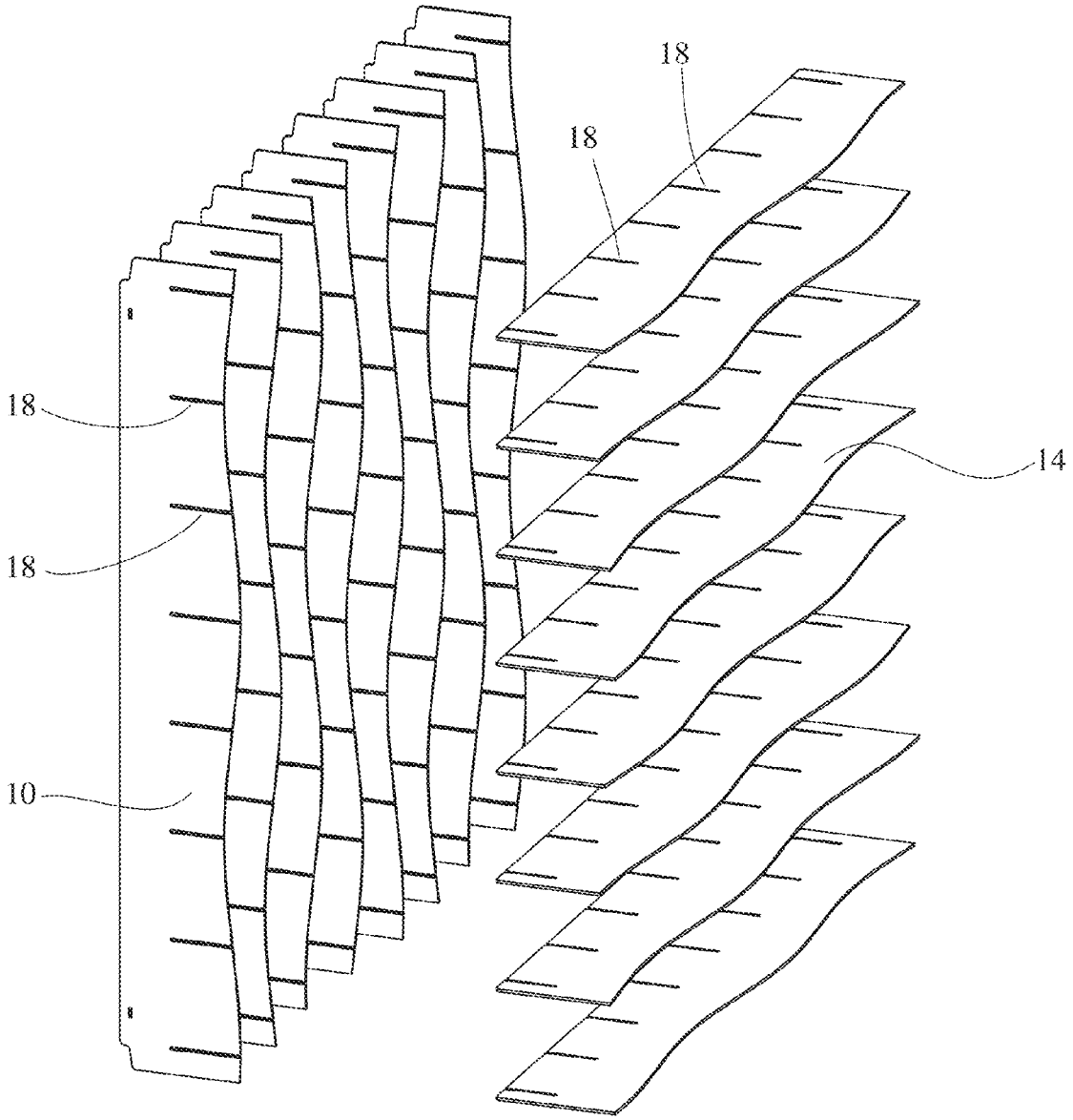

FIGS. 1 and 2 illustrate how a grid shelving unit can be constructed from one set of panels with a notch or slot in the front and another set of panels with a notch or slot in the back. For example, the vertical panels 10 may have slots 18 extending in from the front edge of the panels approximately half of the way through the panel and the horizontal panels 14 may have slots 18 extending into the panel from the back edge of the panel approximately half way through the panel. The notches or slots 18 in the panels 10, 14 may be shaped in an S-shape or curved or bent shape which causes the panel which is inserted into the slot to bend when inserted into the slot. The slot 18 causes the panel 10, 14 to remain bent while the furniture is assembled. The slot may have a slot width which is wider than the adjoining panel's thickness while also having a curved or bent shape which presents an unobstructed pathway through the slot which is narrower than the panel thickness. This allows for interference that helps keep the panels together and strengthens the furniture.

A grid can be made from multiple horizontal and vertical pieces which have slots cut in them approximately half way through them. Typically the most sturdy and aesthetically pleasing shelves are made by forming the horizontal pieces with the slots in the back and the vertical pieces with the slots in the front. This offers greater support to the front horizontal edge of the resulting shelf at the expense of the stability at the back horizontal edge. This is advantageous as the front of the shelf typically receives a higher of use and interaction from a person as objects are placed on the shelf and removed from the shelf. The front vertical edge does not need the same stability as it is not weight bearing. The horizontal and vertical pieces could be swapped, but this configuration may be stronger because the front edge of the horizontal pieces is not broken and should perform better for weight bearing at the front edge.

Figure 3:
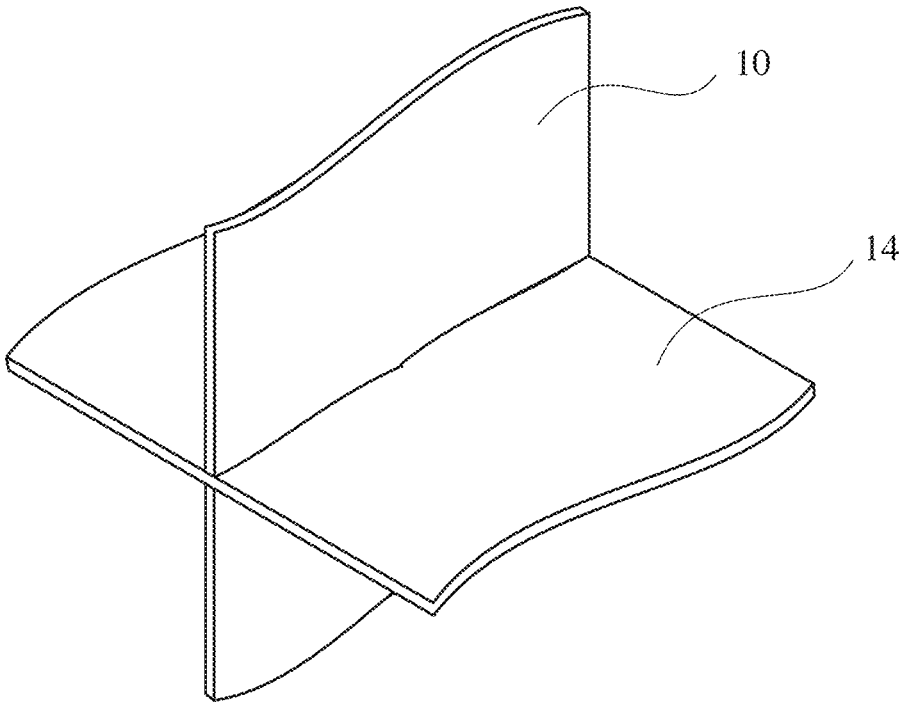
Figure 4:
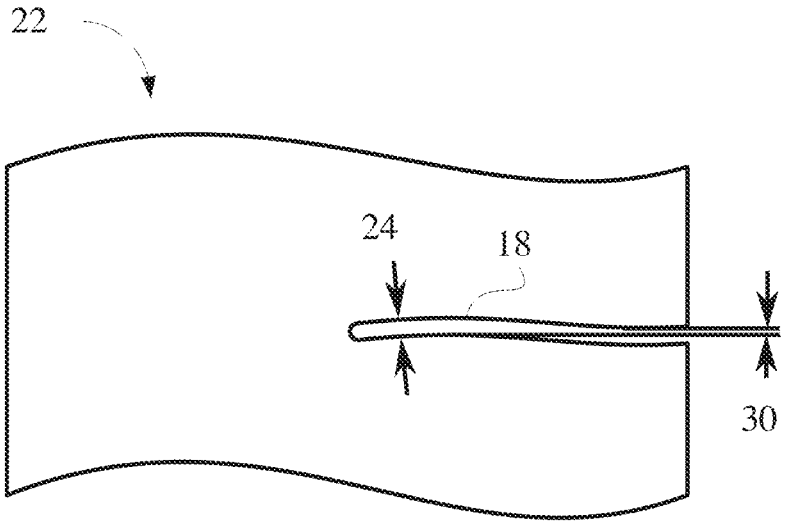

FIG. 3 illustrates a single joint of a piece of furniture such as a shelving grid which is made from a horizontal piece 14 and a vertical piece 10. FIG. 4 illustrates a portion of a planar piece 22 (which could be a portion of a vertical piece 10 or a horizontal piece 14) with a slot 18. The slot 18 is not straight, but may be a uniform width. The uniform slot width 26 is greater than the thickness of the piece it accepts, and the narrowest extended width 30 through the slot is less than the thickness of the piece it accepts. Therefore, as the parts 10, 14 are slid together, the piece being inserted into a slot 18 has to bend. This creates pressure and friction between the bent piece 10, 14 and the walls of the slot 18, holding the pieces securely together without nails or glue while allowing for easy assembly and disassembly. The slot width 26 is relatively close to the thickness of the inserted panel, and may often be between about 10 and 50 percent greater than the panel thickness. The open extended width 30 through the slot 18 is often between about 90 and 50 percent of the thickness of the inserted panel. The slot 18 is typically relatively straight overall so that the inserted panel, although bent to create a stressed joint, remains relatively flat. The overall outside width of the slot between the extremes of the slot may be between about 10 and 50 percent greater than the thickness of the inserted panel.

The slot width 26 could be made less than the thickness of the inserted piece, but this could require that the piece with the slot would have to bend in plane, causing high and unnecessary stress. To achieve a tight fit in straight cut slot without being so tight that assembly is difficult, very tight tolerances in the material thickness and the slot widths have to be held. The curved-slot configuration shown in these figures allows for more easily attainable tolerances in the material thickness and slot dimensions. The panels 10, 14 are often made of a wood such as plywood or a plastic such as ABS. These materials have a degree of flexibility and will bend elastically when inserted into a slot 18 to provide the discussed rigidity. The material used to form the shelving grid pieces 10, 14 may often be about one quarter of an inch thick, and may be between one eighth and three eighths of an inch thick in many examples.

Figure 5:
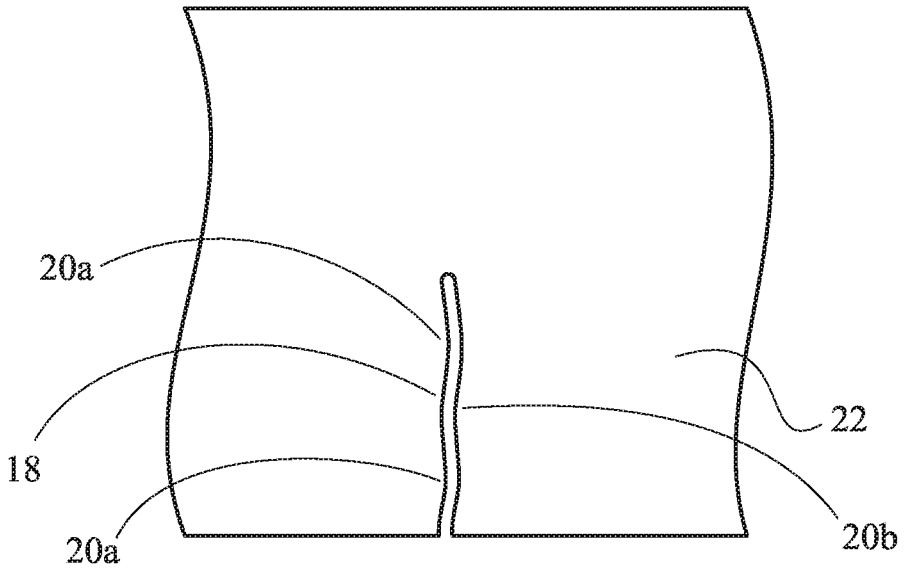

FIG. 5 shows a variation of the slot 18 with more profile variation. As shown, the slot may be a bent shape such as the zig-zag shape shown. The slot 18 may have a single bend or multiple bends and provides a slot 18 with a slot width 26 which is greater than the thickness of the material used to create the piece 10, 14 and provides an unobstructed channel 30 through the slot which is narrower than the material used to create the piece 10, 14 so that the piece 10, 14 inserted into the slot must bend when inserted and remain bent in an assembled configuration. The piece 10, 14 which is inserted into the slot 18 is bent by two points 20*a* on one side of the slot and another point 20*b* on the other side of the slot.

Figure 6:
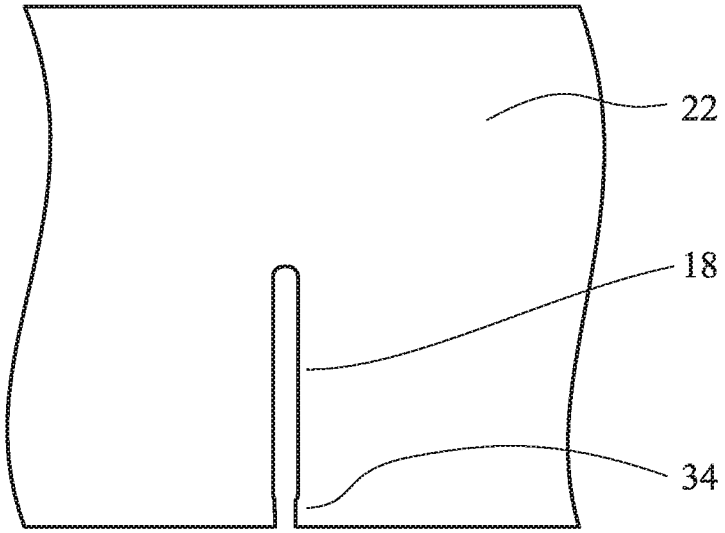

FIG. 6 shows a variation where a slot 18 is slightly wider than the material used to make the pieces 10, 14 for the rearmost majority of the slot and is narrower for a section 34 at the front of the slot 18. This requires a degree of in-plane bending or stretching of the section 22 of the piece 10, 14, but results in a lower stress than an entire slot 18 formed narrower than the material of pieces 10, 14 as the material has more room to distribute the stress and stress is not concentrated at the root of the slot. A slot 18 as shown in FIG. 6 may be combined with a slot 18 shown in FIG. 4 or 5 in creating a joint as shown in FIG. 3. A slot 18 as shown in FIG. 6 may be formed at the front of the vertical pieces 10 while a slot 18 as shown in FIG. 4 or 5 may be formed at the back of the horizontal pieces 14. This results in a shelving grid where the horizontal pieces 14 are held tightly but are not bent by the slots in the vertical pieces 10 to provide a flat shelf area while the vertical pieces 10 are bent by the slots in the horizontal pieces 14 to provide a secure and stable piece of furniture.

A benefit of a stressed joint (i.e. a joint with panels 10, 14 which are held in an elastically bent configuration when assembled) is that it will stay together under typical loads and movement, and also eliminates the play or movement in furniture that can make it feel unstable or cheap. Additionally it can make the furniture quieter. No tools are required to assemble the joint and no fasteners are needed to keep the joint together.

Placement of Interference Joints

Figure 7:
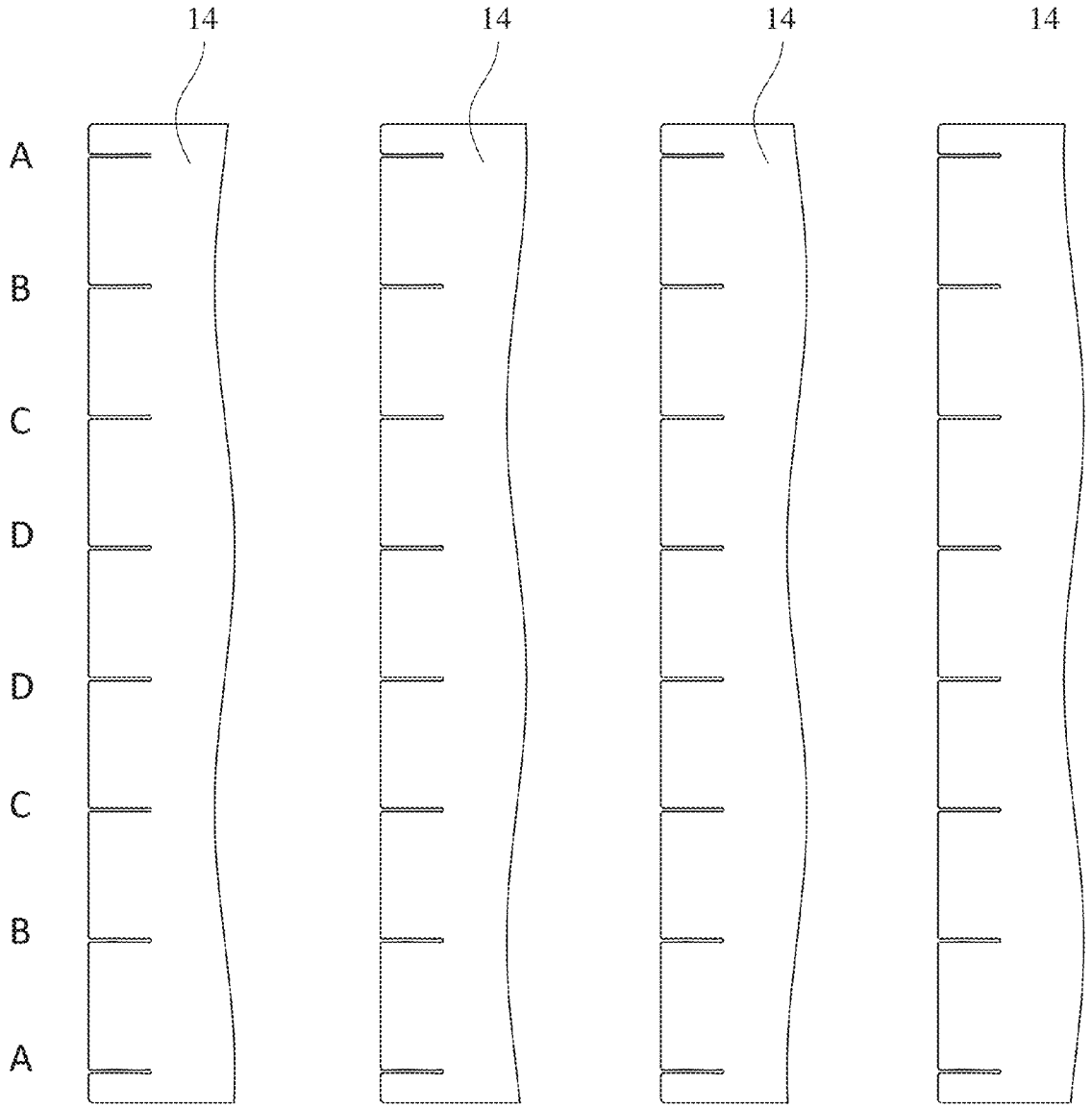
Figure 8:
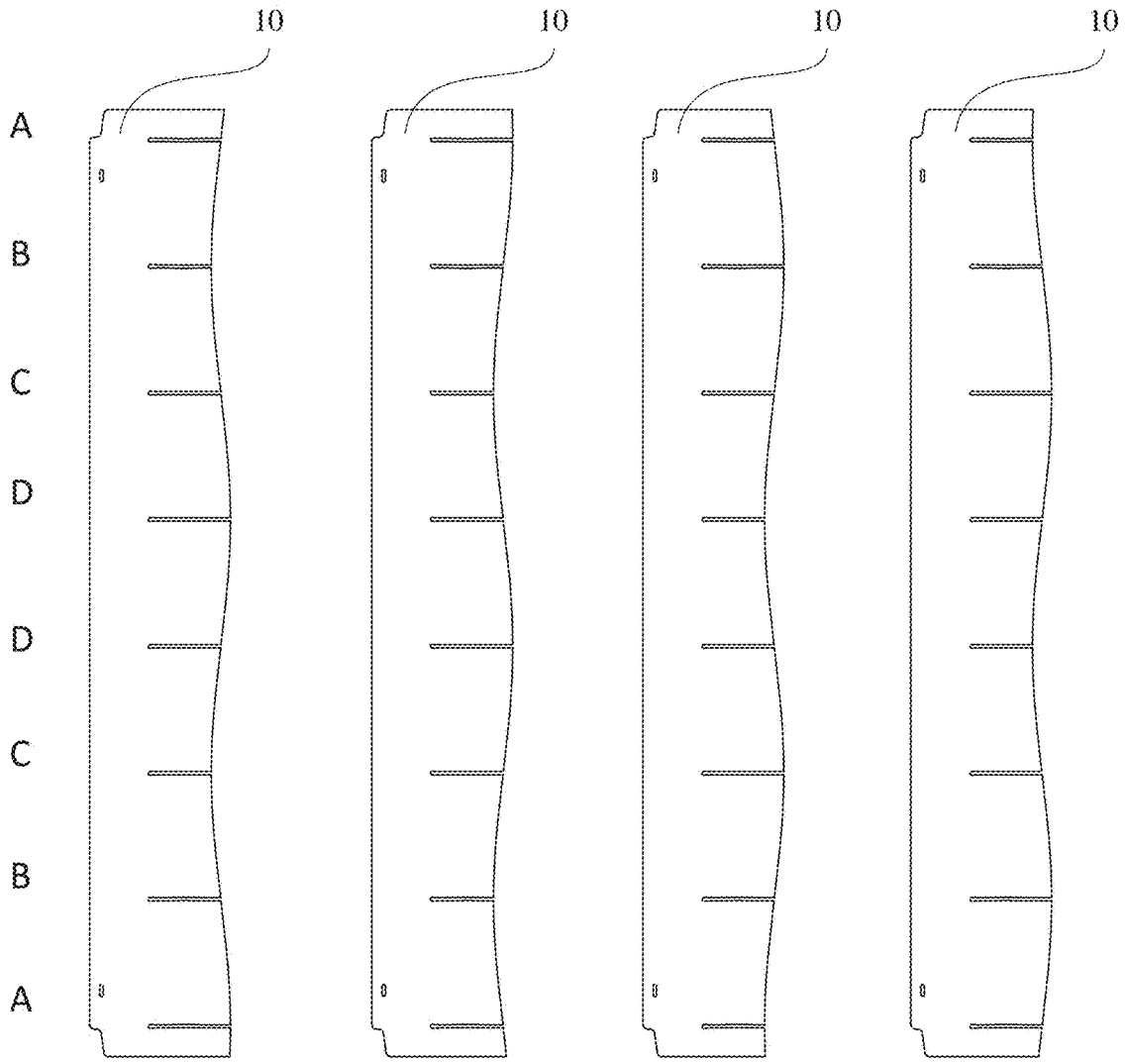

This interference and elastic bending of the panels 10, 14 can make assembling and disassembling the panels into furniture difficult. This is particularly true when a large piece of furniture is assembled, as the force required to assemble a single joint is multiplied by the number of joints formed by a given panel or piece 10, 14. One way to remedy this problem is to only make the slots near the end of each panel 10, 14 have interference. That is to say that only the slots near the end of each panel 10, 14 hold the panel which is received into the slot in a bent configuration when assembled. For example, in FIGS. 7 and 8 the slots 18A or the slots 18A and 18B could have interference and cause the inserted panel to bend as discussed, but not the slots 18B, 18C, 18D or 18C, 18D. The slots 18 which are not shaped to bend the received panel 10, 14 may be straight and may be cut with a width which is close to but slightly larger than the thickness of the material used to make the panels 10, 14. In the assembled shelving unit, both slots 18A would have interference at the corners of the shelving unit and all slots 18 would have at least some interference around the perimeter of the shelving unit while no slots 18 would have interference in the center. This may provide a shelving unit which is adequately stable without requiring unnecessarily high forces to assemble the shelves.

Captive Grid

The same joints discussed above with panels 10, 14 and slots 18 can be used within a casework created with another material or another type of joints. Shelves for small objects can be made to be subdivided by an internal grid with intersecting slots which is placed into a case formed by thicker material. The internal grid can be formed in the same way illustrated above.

Figure 9:
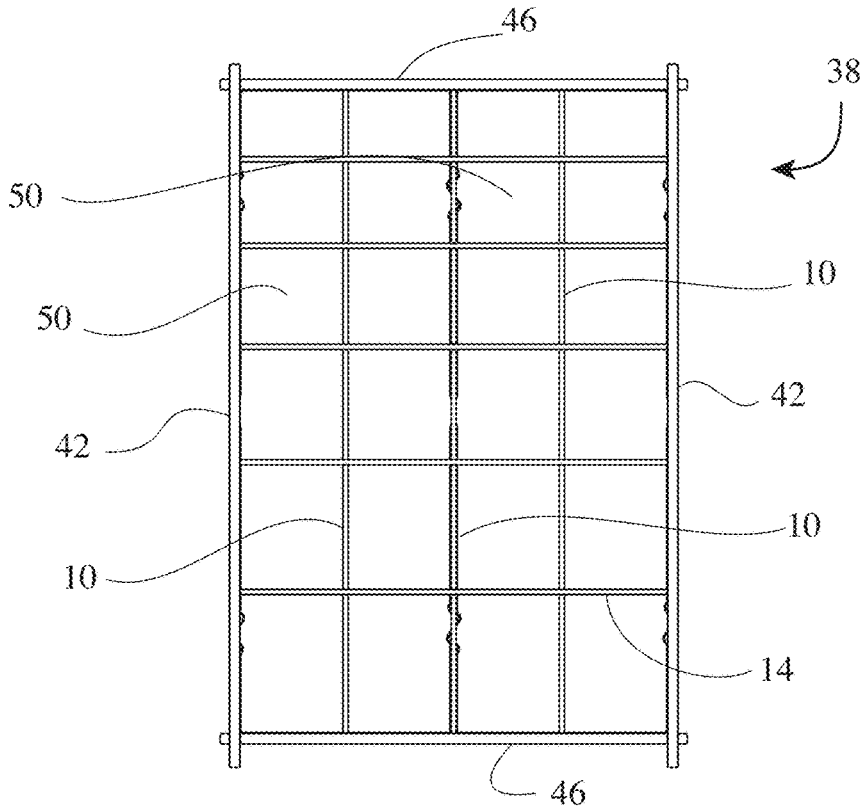
FIGS. 9 through 16 show furniture joints and furniture with a shelving grid.
Figure 10:
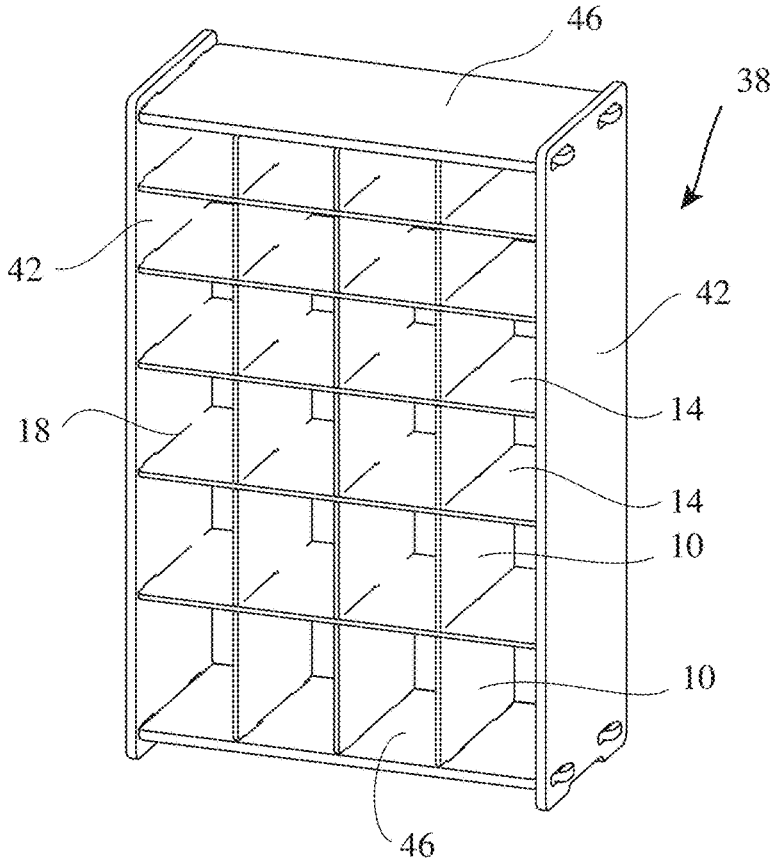

FIGS. 9 and 10 show a cubby shelf 38 for small objects like shoes. The shelf may be designed to have equal sized openings. The illustrated shelf has openings that progressively get larger towards the bottom of the shelf. An advantage to this design is that space for storing shoes is maximized as not all shoes are the same size.

The cubby shelf 38 may be formed from vertical side pieces 42 and horizontal top and bottom pieces 46. The top and bottom pieces 46 and side pieces 42 may be attached together differently than the divider grid inside of the cubby shelf 38. The side pieces 42 and top and bottom pieces 46 may be connected with interlocking tabs and slots. The tabs may extend through slots and then be moved in a transverse direction to lock the tabs into the slots. The divider grid may be formed of vertical panels 10 and horizontal panels 14.

The vertical panels 10 and horizontal panels 14 may include slots 18 and may connect together in the manner discussed with respect to FIGS. 1 through 8 above.

Captive Back Joint

Figure 11:
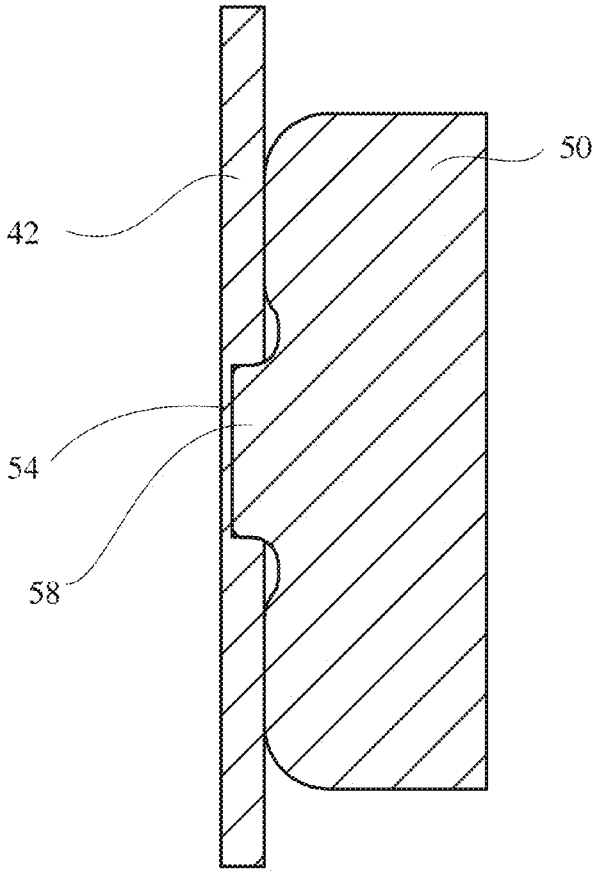
Figure 12:
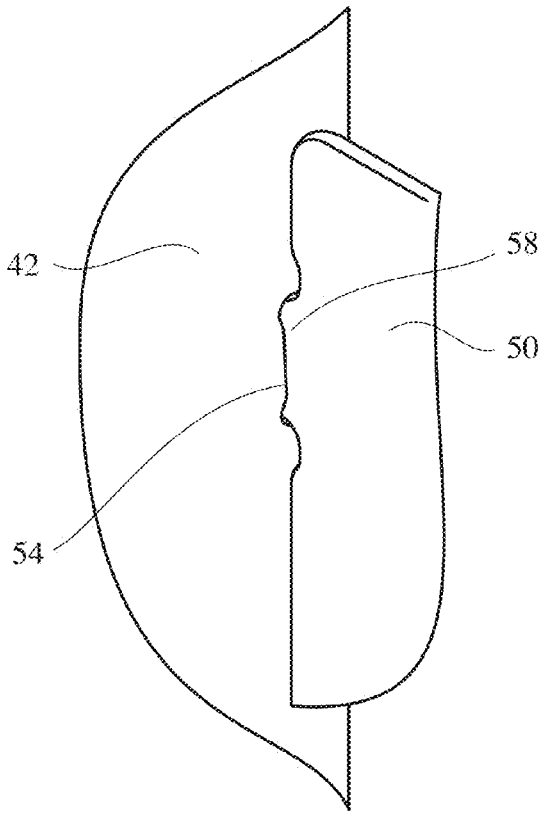

FIGS. 11 and 12 illustrate how the vertical panels 10 and horizontal panels 14 may be attached to the vertical sides 42 or horizontal top and bottom panels 46 of a piece of furniture. The vertical panels 10 and horizontal panels 14 may be held captive in the panels 42, 46. Additionally, the furniture 38 may have one or more back panels 50. The back panels 50 may be attached to the size panels 42 or top and bottom panels 46. A joint can be made which is blind to the outside of the panels 42, 46 and uses tension when assembled to create a joint that provides stability, as well as doesn't make any noise from shifting.

As shown in FIG. 11, a joint between a panel such as a back panel 50 may include a blind slot 54 cut into the side panel 42 and a tab 58 which is inserted into the slot 54. The blind slot 54 may be formed so that it does not extend through the panel 42 and is not seen from the outside of the furniture 38. The tab 58 may be placed into the slot 54 as the furniture 38 is assembled and held in place by the joints which secure the side panels 42 to the top and bottom panels 46. Although discussed as jointing the back panel 50, such a tab 58 and slot 54 may be used to secure the vertical panels 10 and horizontal panels 14 of the shelving grid to the furniture 38.

Figure 13:
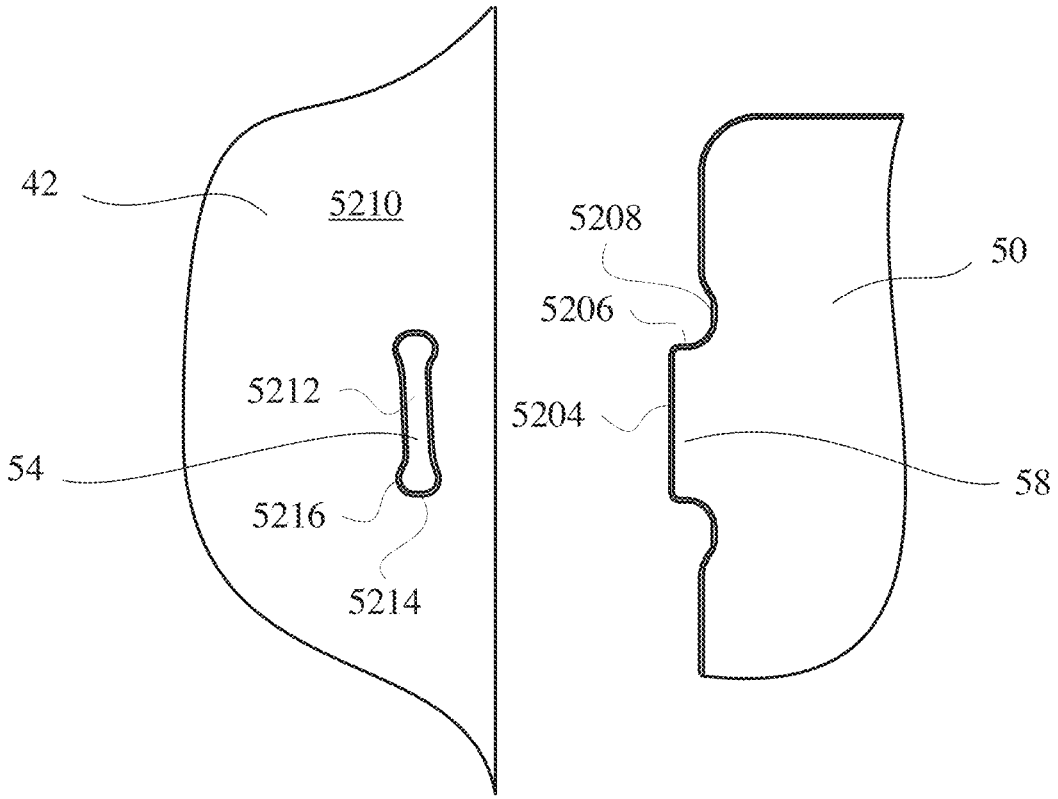
Figure 14:
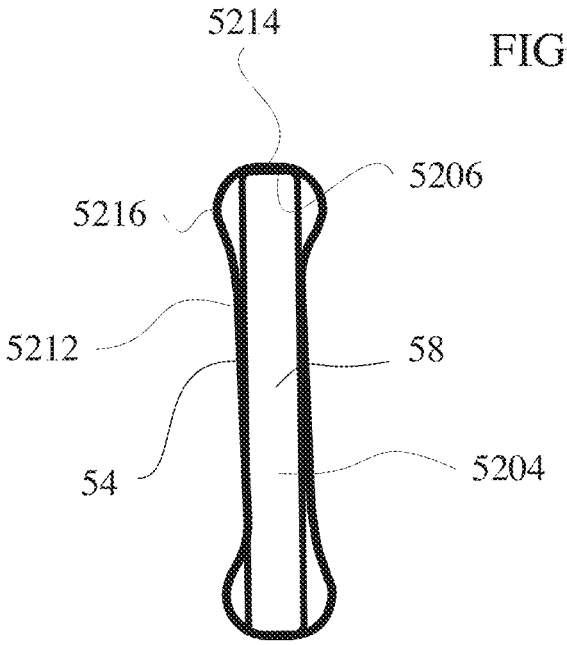
Figure 15:
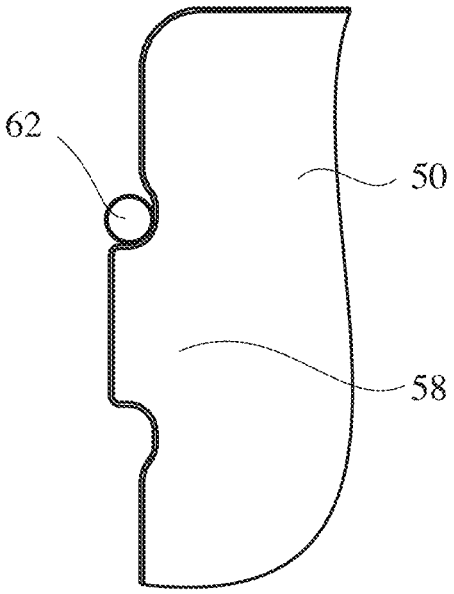

Such a joint (54, 58) can be made with thinner materials than are typically used for other portions of the case. Thus, the joint may be used to join a thin back 50 or panels 10, 14 to thicker panels 42, 46 of the furniture. FIG. 12 shows a perspective view of the assembled joint of FIG. 11. FIGS. 13 and 14 show additional views of such a joint. The slot 54 may be cut into the panel 42 at a slight angle relative to the alignment of the panel 50, requiring the tab 58 to be twisted slightly to fit into the slot 54. This bends the panel 50 out of plane when assembled and places the joint under tension, stiffening the joint and strengthening the furniture 38. FIGS. 13, 14, and 15 illustrate how the slot 54 and tab 58 may be cut with an extra relieved area adjacent inside corners to allow the tab 58 to seat fully into the slot 54 and to fit against the ends of the slot while allowing both to be cut with a router bit 62, allowing the pieces to be fully cut on a cnc router table or the like.

Figure 16:
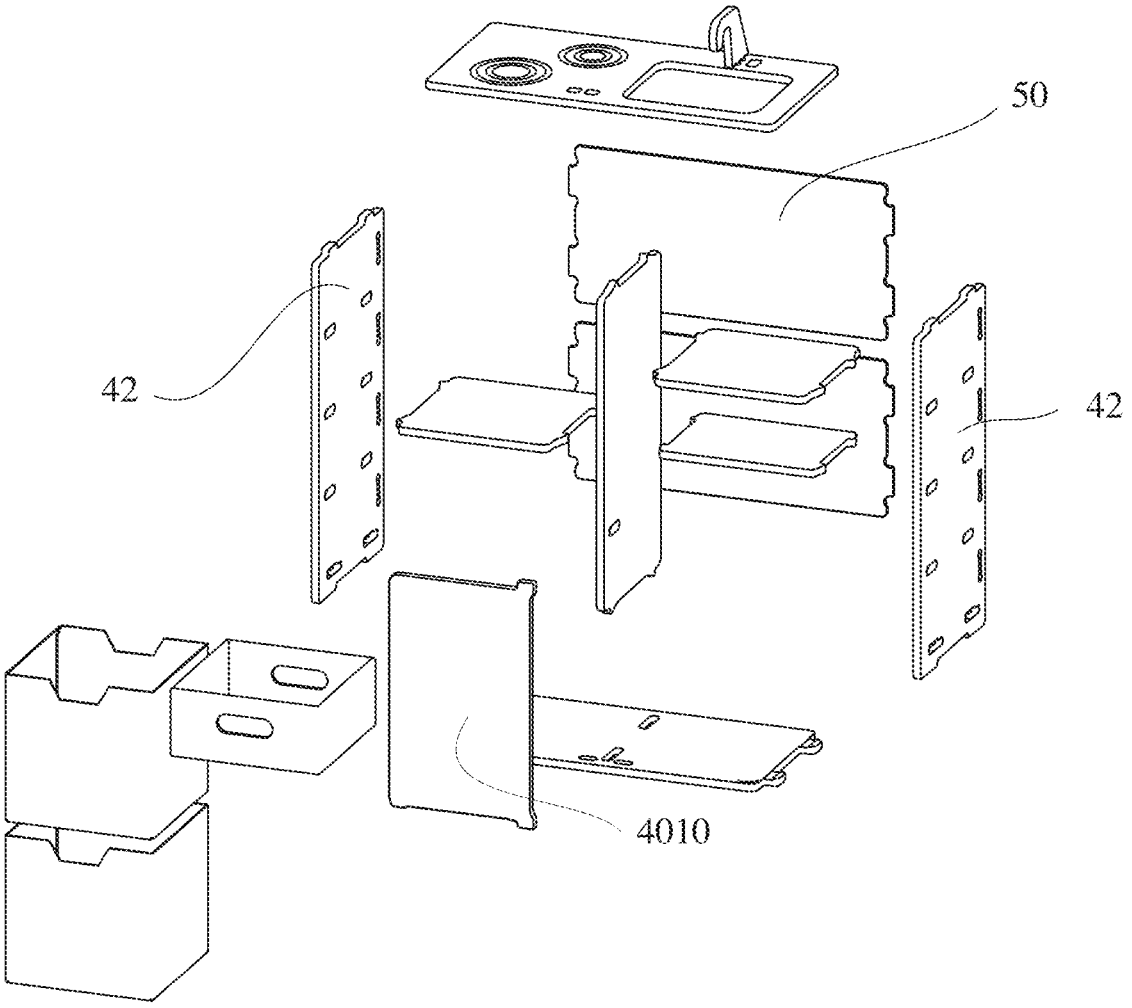

FIG. 16 shows another example of how such a joint may be used. The joint can be used in furniture such as a toy kitchen set to join a thin back panel 50 to a thicker side panel 42. The tab 58 may be sized within the slot 54 to fit quite closely to prevent the furniture sides 42 from being displaced vertically relative to each other and skewing the furniture 38. Additional stability can be achieved if the tabs 58 are long enough to extend to the bottom of the slot 54.

Captive Back Joint (Z Form)

Figure 17:
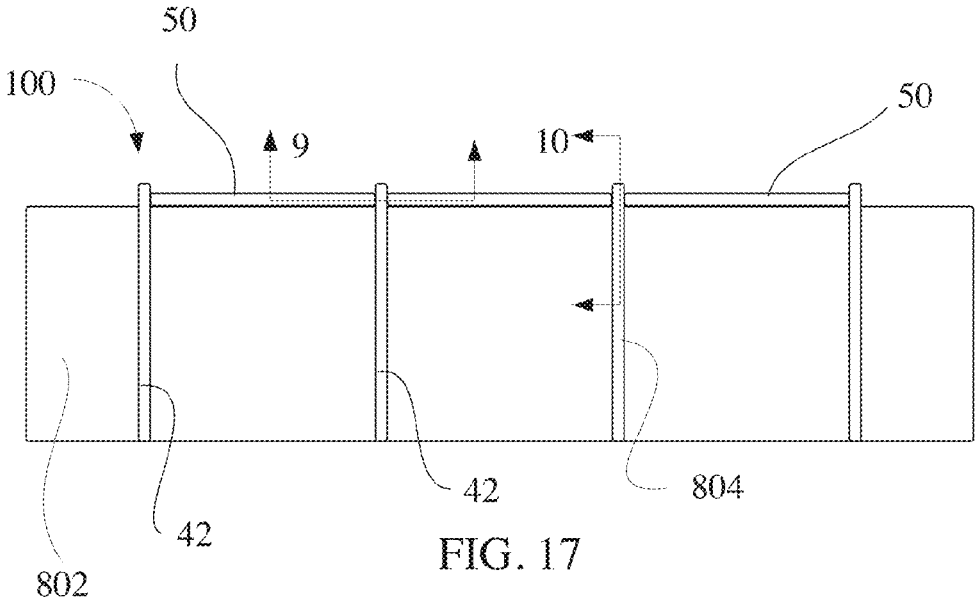
FIGS. 17 through 23 show joints used in furniture shelves, dividers, and back panels.
Figure 18:
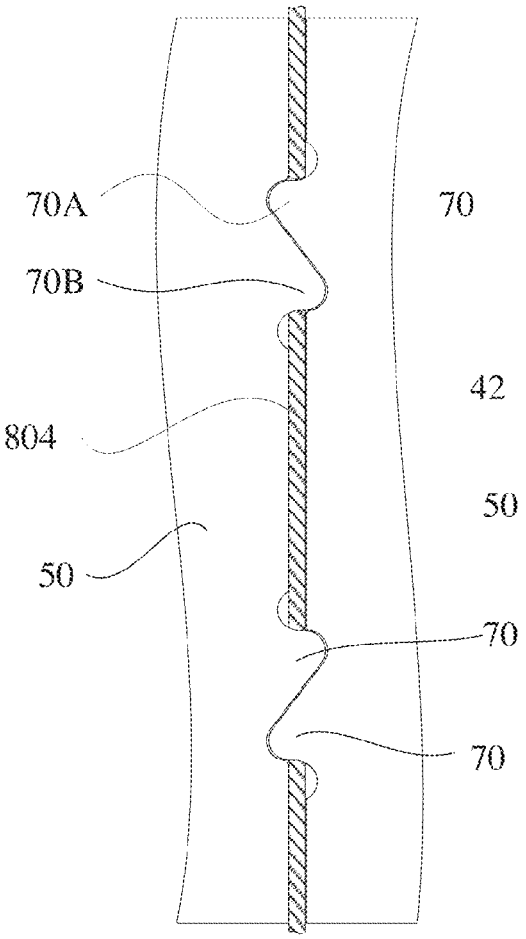
Figure 19:
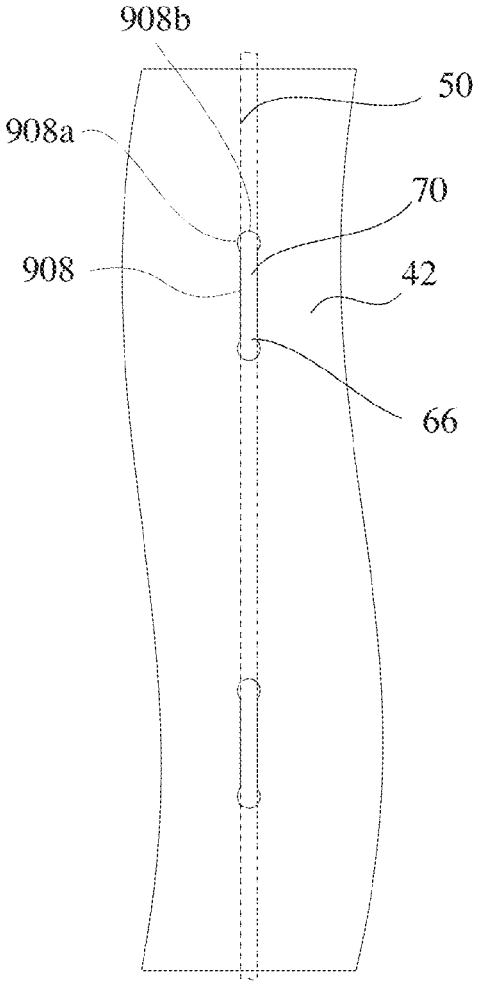

FIGS. 17, 18 and 19 show an additional variation of a joint between adjacent furniture panels. As an example, the joint may be formed between a back panel 50 and adjacent vertical panels 10, 42 or horizontal panels 14, 46 of a piece of furniture. The joint may also be used between other furniture panels which are disposed on intersecting planes such as horizontal divider panels 14 and vertical case panels 42.

By modifying the shape of the tabs 58 used on the panel 50, multiple back panels 50 can be used to cover the entire back of a piece of furniture. The tabs 58 are z or s shaped so they nest with a corresponding tab 58 on an adjacent panel. A vertical or horizontal panel 10, 42 such as from the furniture case or from an internal shelving grid is deeper than other internal grid components and passes between the back panels 50 and has slots 66 that the tabs 70 pass through. As is seen, the tabs 70 are cut so that a first tab and a second tab from adjacent panels 50 nest together and together fill the slot 66. The tabs 70 may be symmetrical and thus ease design and production constraints and improve the modularity of the pieces used to assemble the furniture. The tabs 70 may have a projection which extends outwardly and a recess cut inwardly into the panel 50. The recess may be a similar size and shape as the projection and receives the projection from a tab on an adjacent panel. For such a design, a single tab 70 may not completely fill a slot 66 and may leave a gap and allow some movement, but two adjoining tabs 70 may fill the slot 66 and prevent movement of the tabs within the slot. The tabs 70 may include a projecting portion which extends through the slot and past the panel 42 into which the tab is inserted. This may increase the stability of the joint. This joint keeps the rear panels in line with one another and provides a connection that prevents shear between the parts allowing the back panel to provide stability across the backs.

To provide stability to racking in both directions the direction of the tab 70 may be mirrored from top to bottom. That is to say that one tab 70 on a panel 50 may have an upper projecting portion and a lower recessed portion while another tab on the same panel has a lower projecting portion and an upper recessed portion. Adjacent panels 50 are formed with complementary tabs and fit together. Panels 50 on the side of a piece of furniture which do not have another adjoining panel 50 may be formed with a full tab as described in other figures. This allows a single panel to still give stability with out the other back panels being present.

Figure 20:
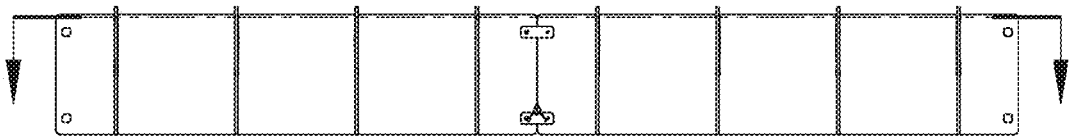
Figure 21:
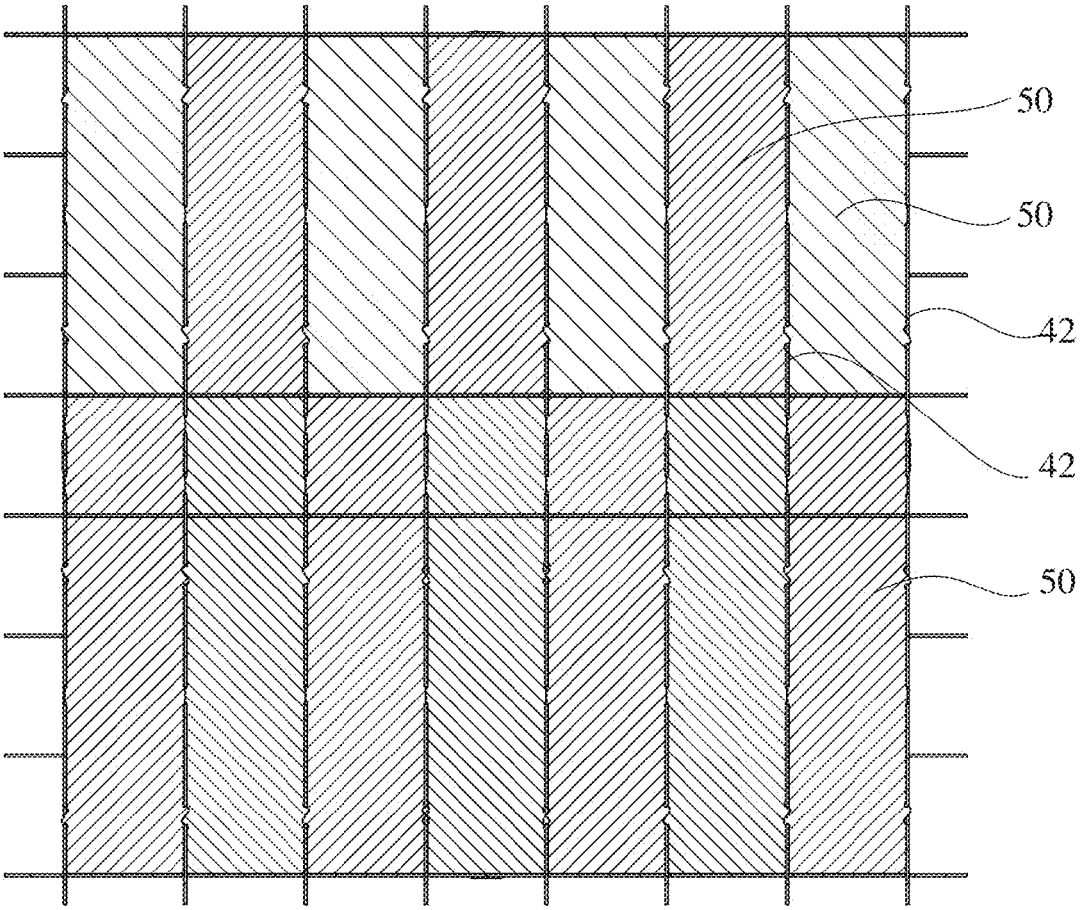

FIG. 20 shows a top view of a piece of furniture with back panels 50 having tabs 70. FIG. 21 shows a back view of the same piece of furniture. The back panels 50 can be used in a case construction or in the grid type constructions shown. A benefit to the multiple panels 50 is that it allows a large back panel to be broken into multiple smaller panels 50. This can make packing and shipping easier.

Additionally patterns can be made with the back panels 50 by using panels of multiple colors, or using panels with different colors on each side. This allows the user to create patterns by selecting which side faces forward and how the panels 50 are arranged.

The back panels 50 shown in FIGS. 17, 18 and 19 also illustrate how these panels may be applied to a shelving grid. 806. The tabs 70 on the back panels 50 extend through slots 66 on the vertical panel 10 of a shelving grid. The recessed portion 70A of a tab can accept the protruding portion 70B of an adjoining tab 70.

Figure 22:
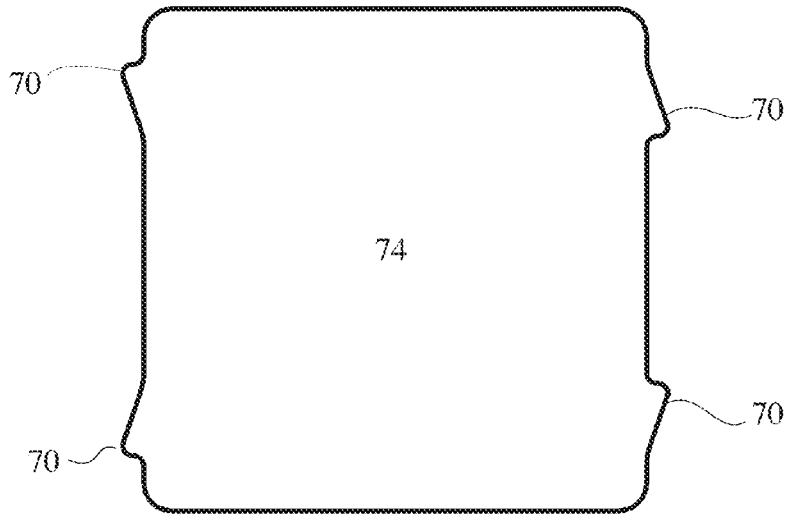
Figure 23:
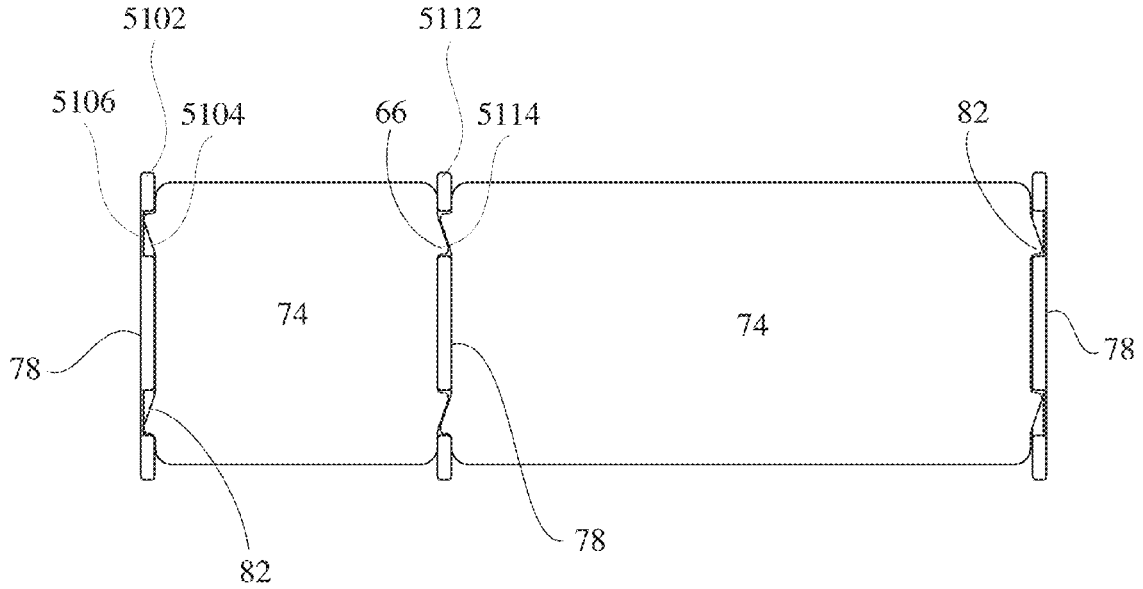

FIGS. 22 and 23 illustrate a method of captively connecting shelves or other divider panels 74 within adjoining panels 78. The structure is similar to the method illustrated for back panels 50 and shows how this method can be applied to back panels, divider panels, shelves, etc. The shelf or partition 74 has protruding tabs 70 which, as discussed above, may be formed with a protruding portion and a recessed portion so that two adjoining tabs 70 from adjacent panels 74 nest together within a slot 66. For stability, the tabs 70 may be mirrored on the same side of a partition 74 so that the perpendicular side edges of the tabs 70 abut the ends of slots 66 and prevent the partition 74 from moving in both directions in the slot 66. The tabs 70 may be disposed in a complementary arrangement on the two opposite ends of the partition to allow two partitions/shelves 74 to enter a slot 66 from opposite sides. The angled design of the tabs 70 allows at least a portion of the tab to enter farther into the slot making it less likely to come out if there is some flexibility in the parts. It also can make assembly easier because parts are less likely to fall over then with a half depth straight tab.

As seen in FIG. 23, furniture panels 78 which are on the ends of the furniture may be formed with blind slots 82 which are not cut all the way through the panel 78. This provides a more appealing appearance to the furniture. Forming the tabs 70 so that they extends approximately three quarters of the way through a panel 78 provides sufficient engagement with a slot 66 while allowing for blind slots 82 which have a depth that is about three quarters of the thickness of the panel 78 or slightly greater to be used.

Flex Backs

Figure 24:
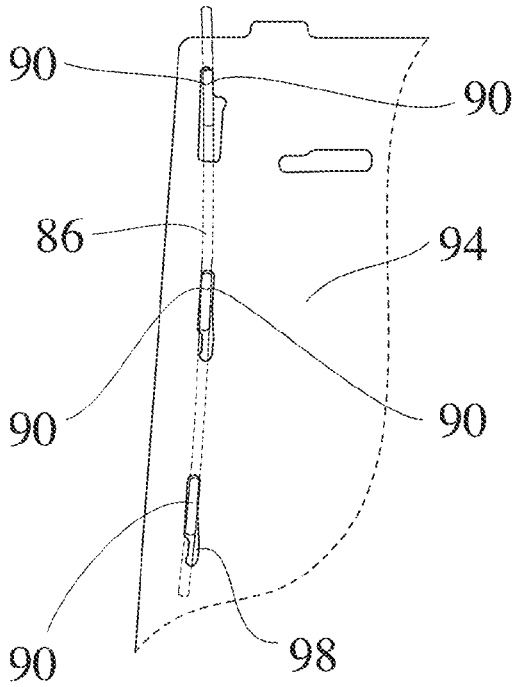
FIGS. 24 through 26 show a furniture tension joint.
Figure 25:
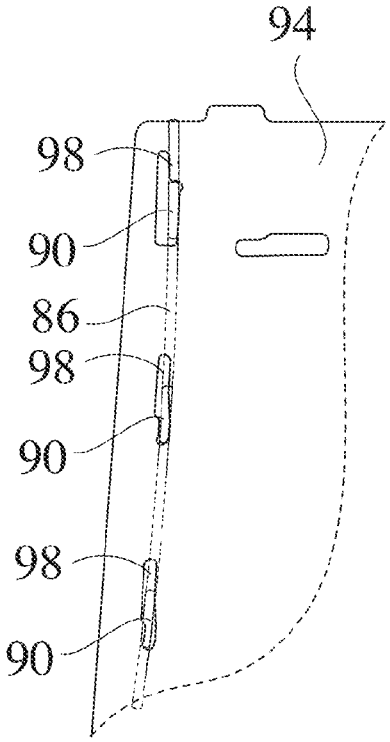

FIGS. 24 and 25 illustrate a joint configuration that can be used in furniture to create a rigid piece of furniture, particularly in desks or other pieces for furniture with only a top for bottom but not both with legs that typically might be loose. The joint system includes a panel 86 with at least 3 tabs 90. Two lower identical tabs 90 include a small recess on them, and an upper tab 90 that doesn't need a recess. A second panel 94 includes three corresponding slots 98. The two lower slots 98 have a nub that when the panel 86 is inserted becomes snug with the recess in the tabs 90. To insert the tabs 90 transversely into the slots 98, the panel 86 must be flexed as the panel 86 must be disposed upward relative to panel 94 as shown in FIG. 24 so that the lower tabs 90 with recesses are not engaging the narrowed portion of the lower slots 98. The upper slot 98 is enlarged and includes a lengthened upper portion which is disposed out of alignment with the lower two slots 98. During assembly, the upper tab 90 is inserted transversely into the misaligned upper portion of the upper slot 98 while the lower tabs are inserted into the lower slots 98, requiring the panel 86 to be bent.

Figure 26:
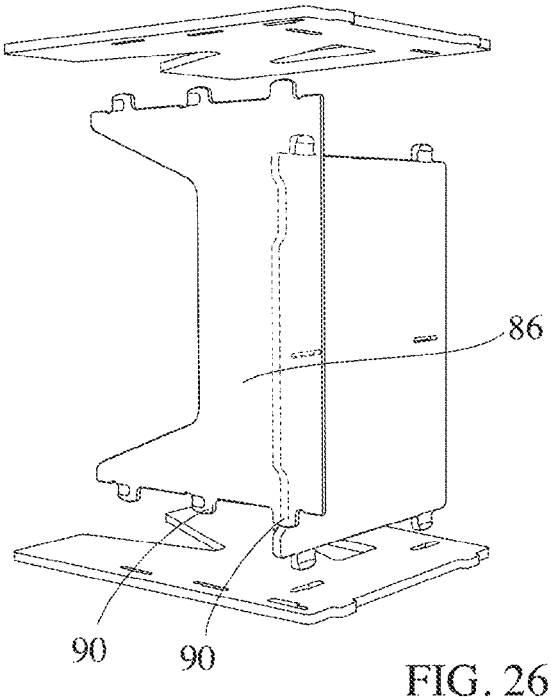

The panel 86 is then pushed downward, causing the two lower tabs 90 to engage the narrowed lower portion of the two lower slots 98. When the panel 86 has moved in a downward direction sufficiently far to engage the lower tabs 90 with the narrowed portion of the lower slots 98, the upper tab 90 reaches a laterally enlarged portion of the upper slot 98 that allows the upper tab 90 to move laterally and relieve some of the bending which was required to place the 86 into initial engagement with the panel 94. The panel 86 may maintain a small amount of bending in the assembled position shown in FIG. 26. The upper tab 90 is engaged into the laterally extending portion of the upper slot 98 and this prevents the panel 86 from moving upwardly out of this position. The lower tabs 90 have a recessed portion on the lower side thereof which does not extend to the lateral side of the tabs and which engages to the narrowed portion of the lower slots 98 to prevent these tabs from being pulled transversely from the slots 98. An advantage to this joint is the positive engagement the top slots give which make a much stronger joint especially for side to side racking. The back joint piece is best made from a thinner more flexible piece, which is advantageous for lighter weight and lower cost.

Door Joint

Figure 27:
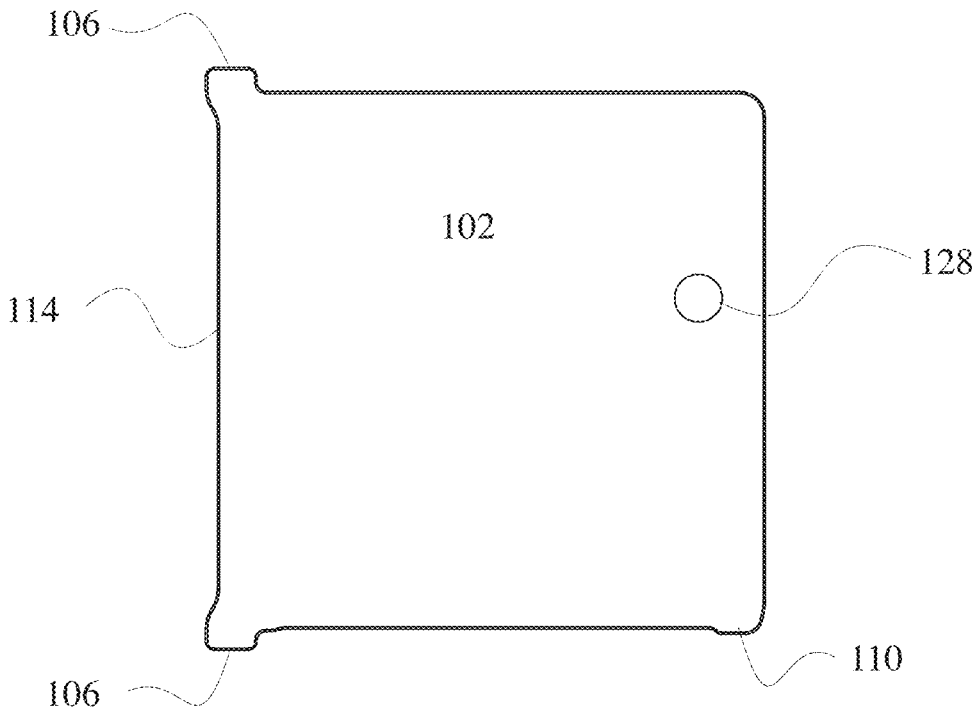
FIGS. 27 through 29 show a furniture door.
Figure 28:
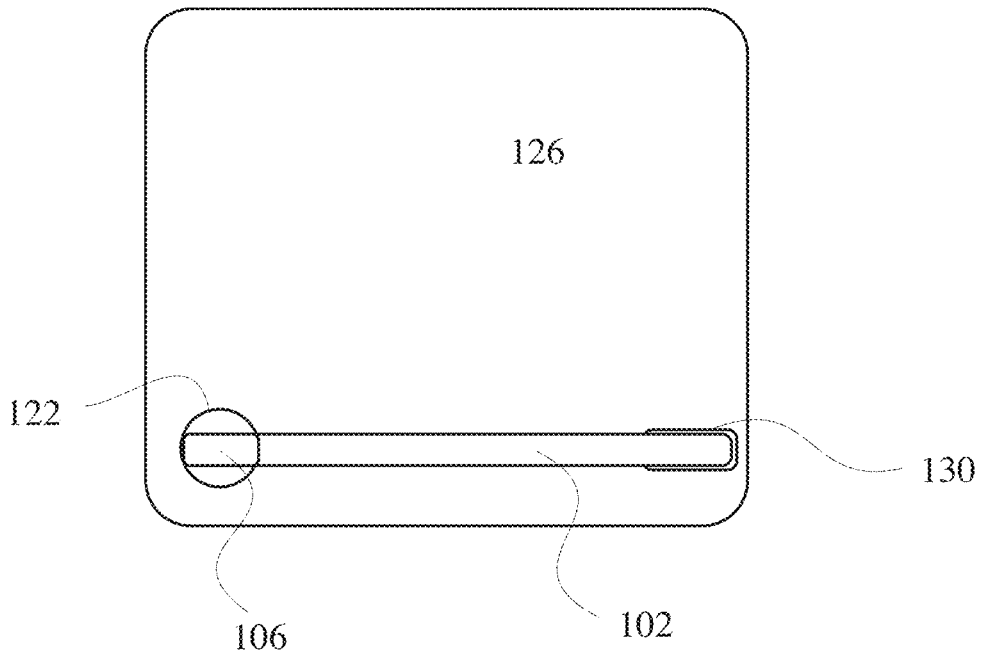
Figure 29:
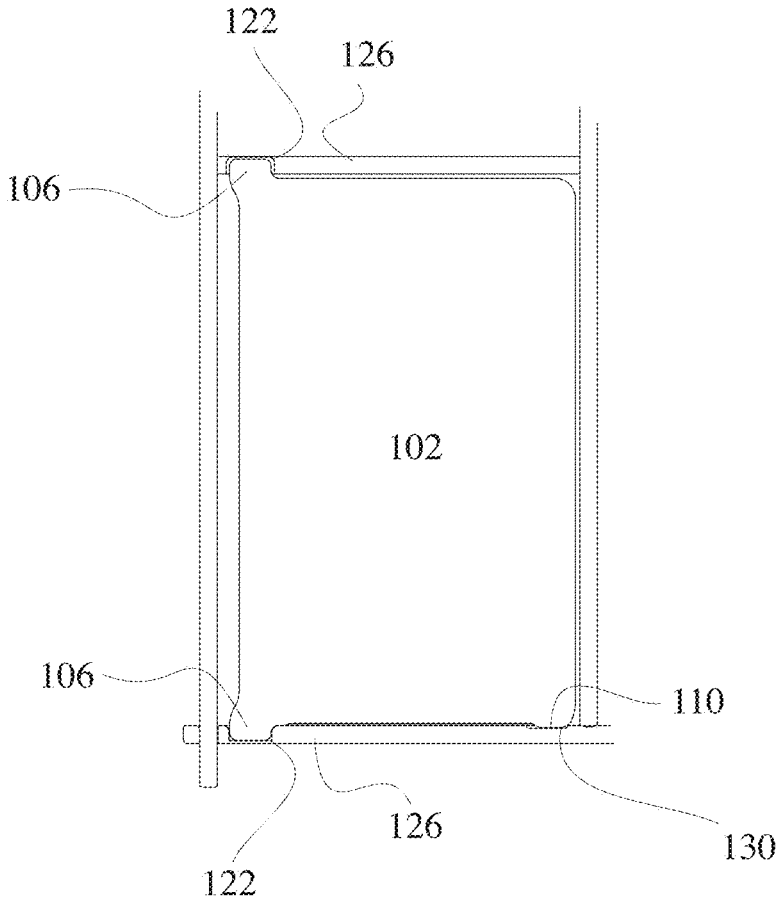

FIGS. 27 and 28 detail the door joint which may be used on furniture such as a cabinet portion of a bookshelf, a child's kitchen set, etc. This joint could also be used generally in a number of applications where it is desirable to create strong and durable door joint from planar materials with no hardware and minimal machining. This joint also minimizes pinching and thus protects little children's fingers from being pinched while playing. The door 102 is cut from a planar material with a hinge tab 106 protruding from the top and bottom edges adjacent a hinge edge of the door. A short tab 110 can be used at the bottom edge of the door away from the hinge to keep the door closed. A recess 114 may be formed into the back of the door that goes towards the centerline of the hinge tabs 106 to prevent pinching of fingers. A handle 118 may be formed as a hole in the door, a knob, etc. FIG. 28 is a top view of the door assembly. The top and bottom hinge tabs 106 are inserted into a hole 122 on a top and bottom plate 126 (i.e. a part of a cabinet or a play kitchen, etc.) The holes 122 may or may not extend all the way through the plate 126. The door 102 can swing and pivots around the center of the hole 122. A recess 130 accepts the nub 110 in the closed position and prevents it from opening without affirmative user effort. FIG. 29 is a cross section of the assembly.

Wave Form

Figure 30:
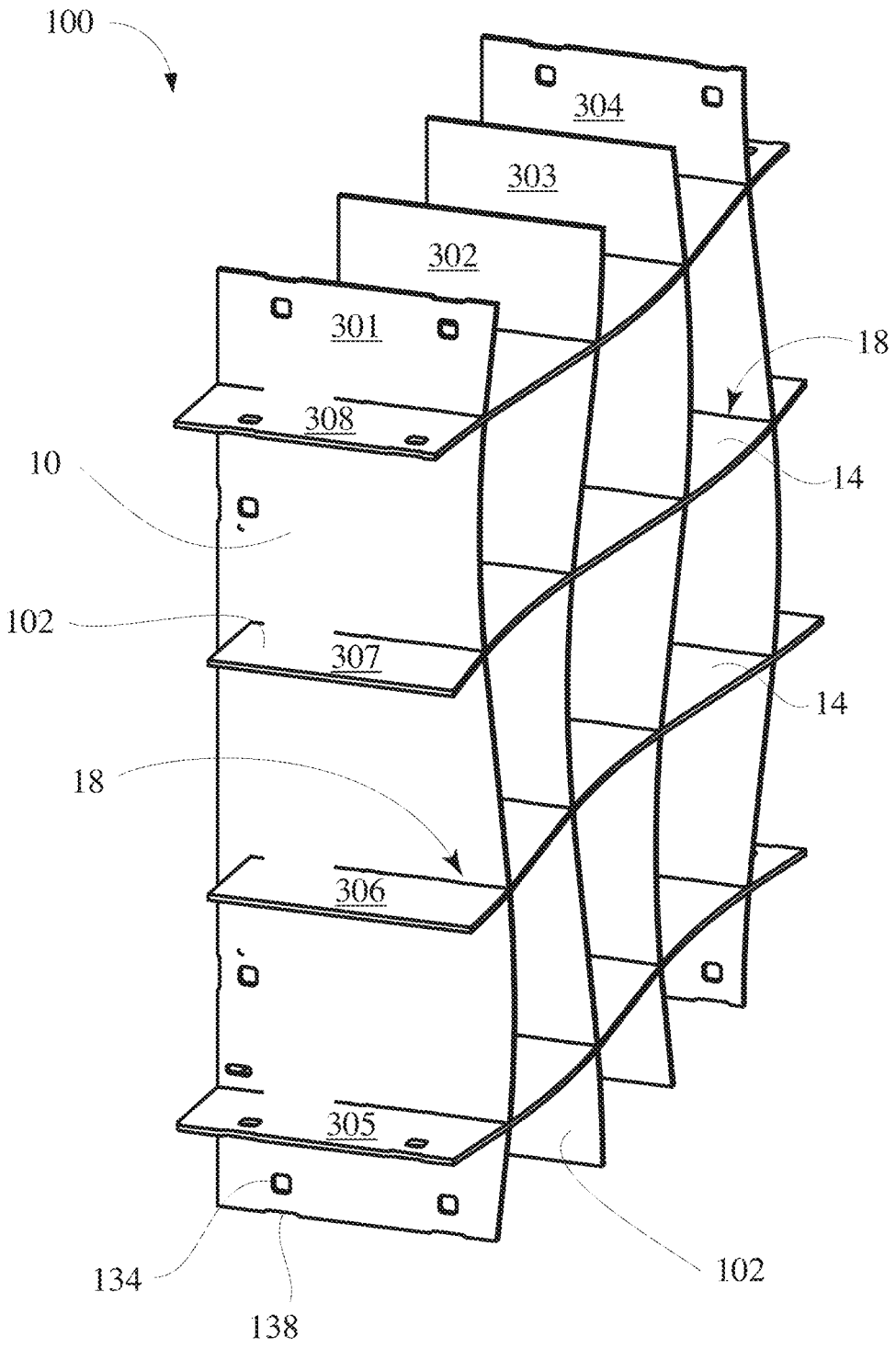
FIGS. 30 through 45 show shelving/furniture grids and parts which may be assembled together to form larger units.
Figure 31A:
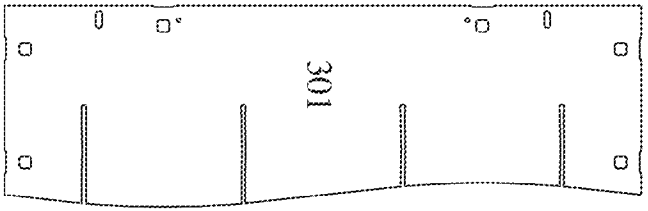
Figure 31B:
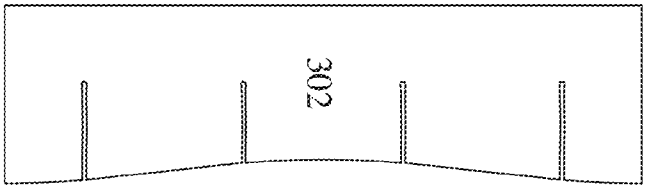
Figure 31C:
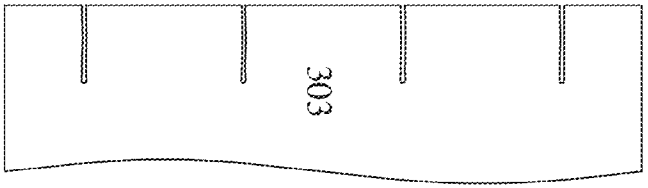
Figure 31D:
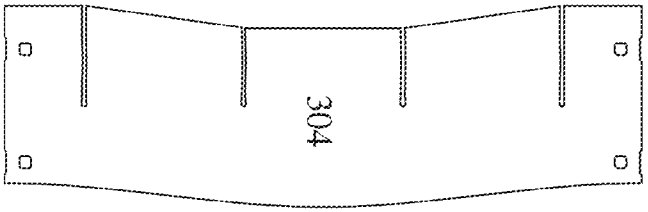
Figure 31E:
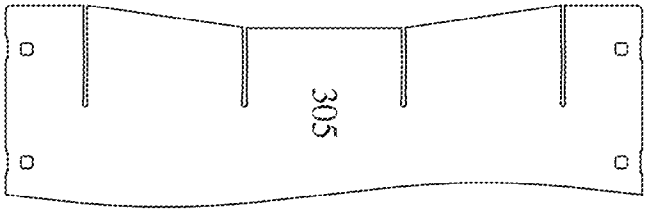
Figure 31F:
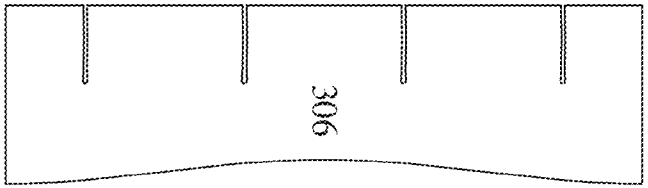
Figure 31G:
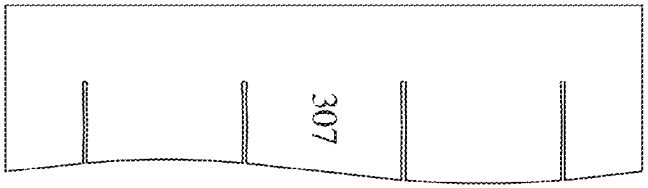
Figure 31H:
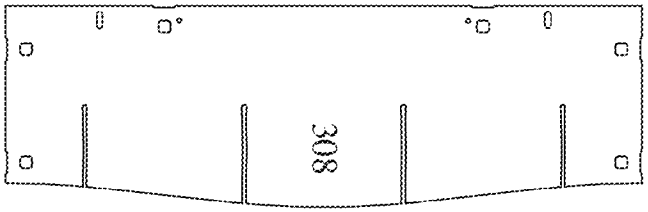

FIG. 30 illustrates a grid unit such as a shelving unit as disclosed in the above figures which is made from flat planar pieces. The grid unit may be made of vertical panels 10 and horizontal panels 14 with slots 18 as discussed above. FIGS. 31A through 31H show the individual panels 301 through 208 used in the grid. Assembled together, they create a useful and aesthetically pleasing shelf. The front edges of the panels 10, 14 are shaped with a wave in this illustration, though any number of shapes could be used including straight, jagged, or other.

By cutting the front edge of the panels 10, 14 making shelving unit with a wave form the progressively moves across the individual panels, the illusion of a wavy surface is achieved across the front of the shelves. This can be quite aesthetically interesting and pleasing. The wave form (amplitude and frequency, as well as rate of advancement) may be the same for both horizontal and vertical members, which gives the illusion of a wave and trough passing over the shelving unit at a 45 degree angle. However, by varying the wavelength and advancement frequency between horizontal and vertical members, giving other angles. The waveform usually works when the wavelength is an integer multiple of the spacing between shelves (or slots). A longer wavelength is typically preferred, on the order of 1-2 times the overall shelf size to achieve an interesting visual surface.

Modularity of Units

The top and bottom edges as well as the back edges of the panels 10, 14 which are outside panels in the grid may contain a hole 134 and associated edge recess 138 that can be used to connect adjoining units together into a larger furniture unit. The holes may be a number of shapes including square, round, slotted or other. The recess 138 on the edge can be used to allow the adjoining edges to butt into one another when being connected with appropriate connectors 142 shown in FIGS. 32 and 33, for example. The interior pieces omit much of the detail to simplify and reduce manufacturing complexity, though all pieces could contain all features or greater functionality or all could omit features for simplicity.

Figure 32:
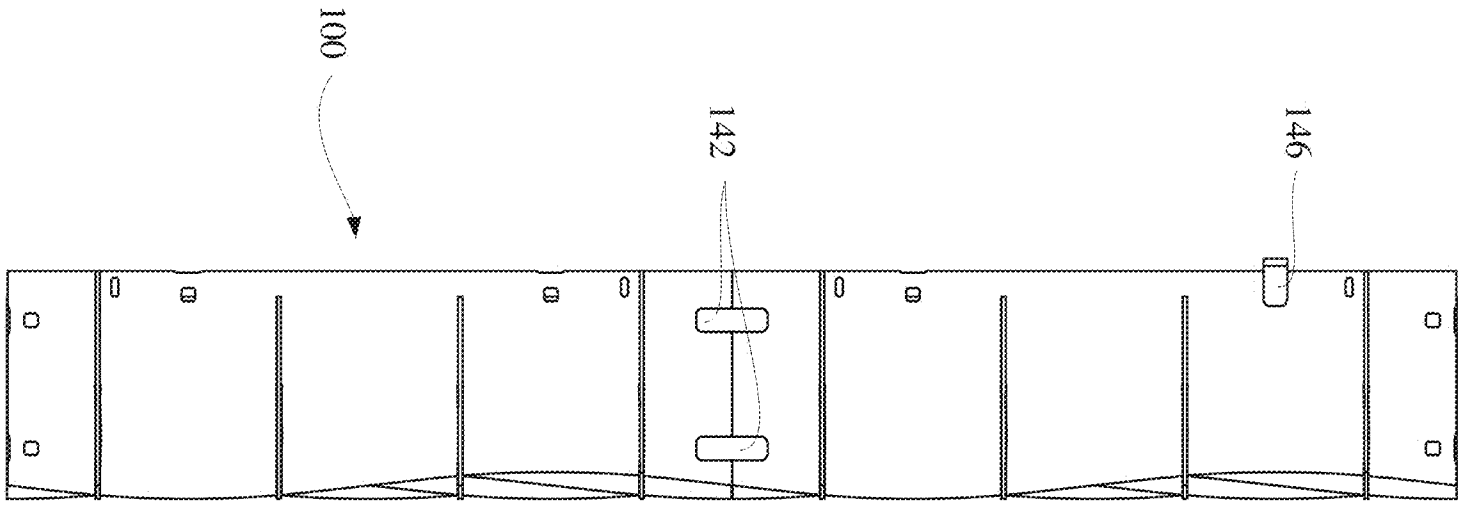

FIG. 32 shows how two grid units may connect to each other on top of each other, or side by side to form, for example, a longer or taller shelving unit. Connectors 142 fit into the recess 138 and the holes 134 and connect the adjoining grids units. Multiple units can be connected in both directions. A wall anchor connector 146 is used to attach the grid unit to a wall by attaching to hole 134, fitting into a recess 138, and proving a flange and hole to allow the furniture to be attached to a wall. A wall connector 146 may include a front portion (i.e. a post 154, body 166, bridge post 158) which is the same as a connector 142 and a back portion which is angled and flat and has holes so screws can be used to connect it to a wall. Such a connector 146 can be used to attach a work surface to the top of a grid unit.

Figure 33:
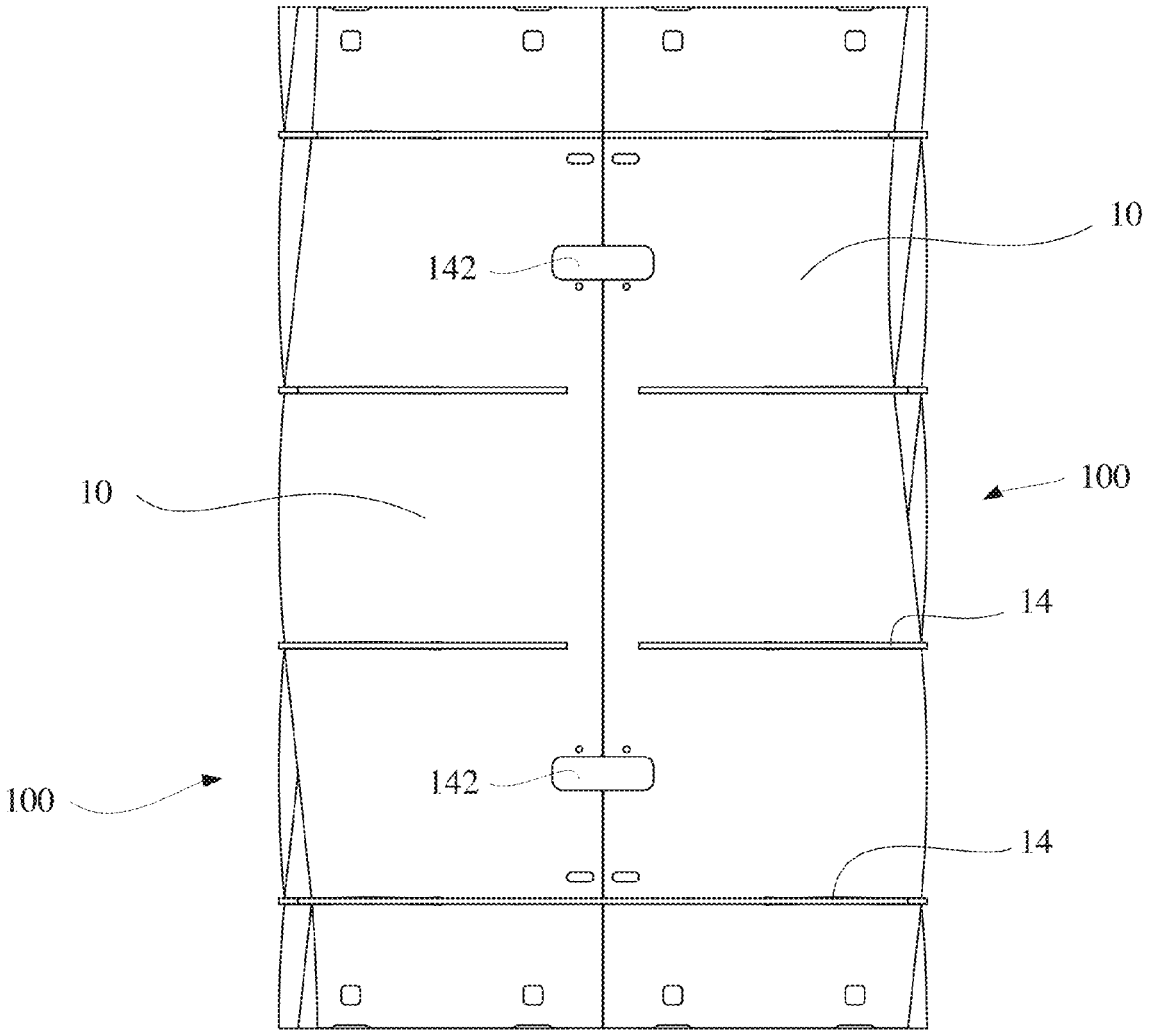

FIG. 33 illustrates how the grid units can be connect back to back by using connectors 142 inserted into the holes 134 and recesses 138. This could be used to create a central room divider or freestanding shelving unit.

Figure 34:
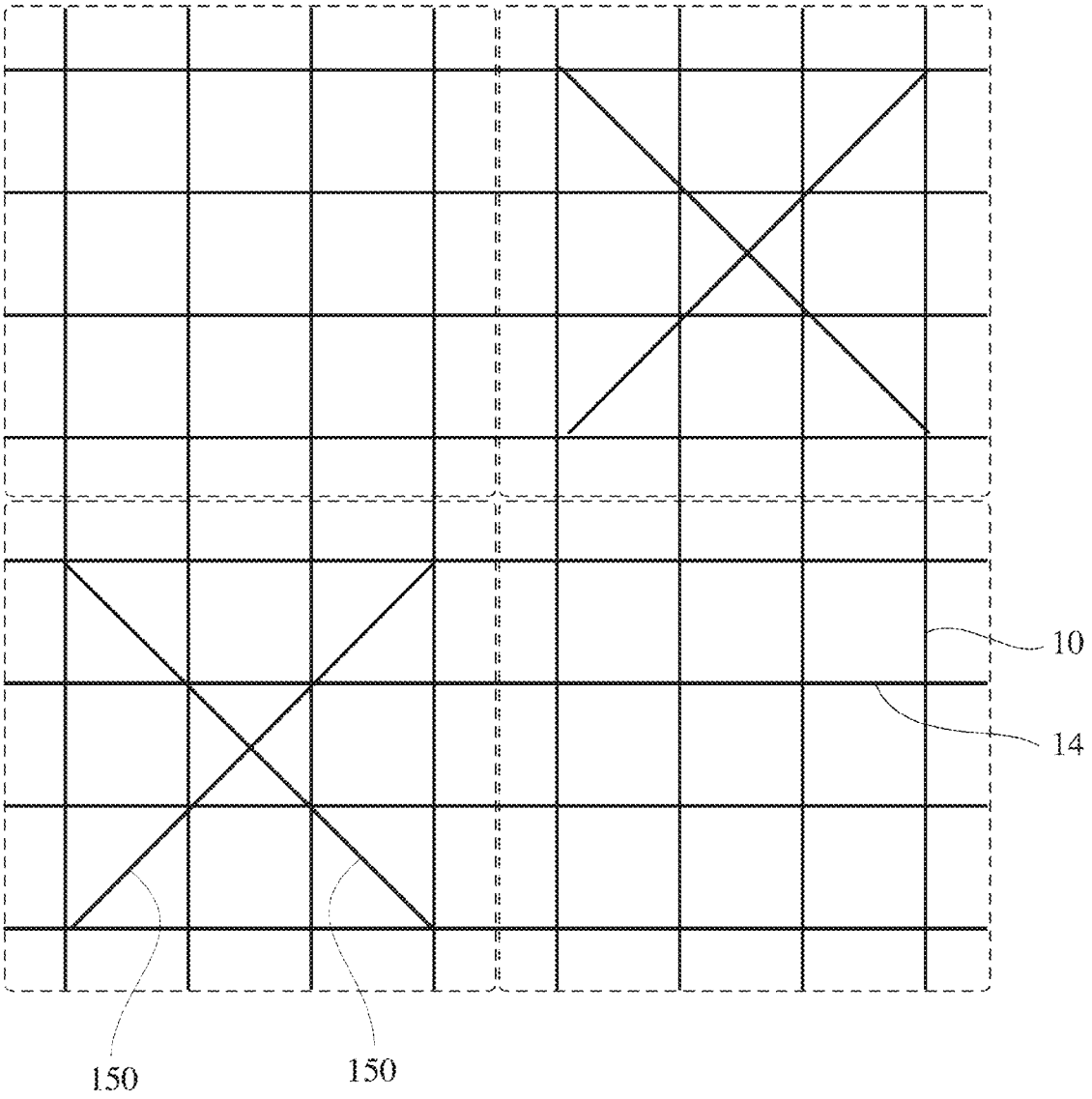
Figure 35:
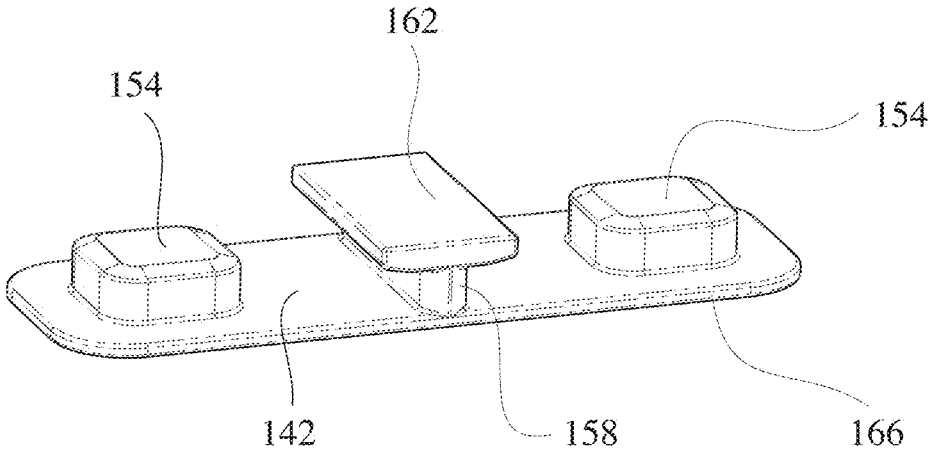
Figure 36:
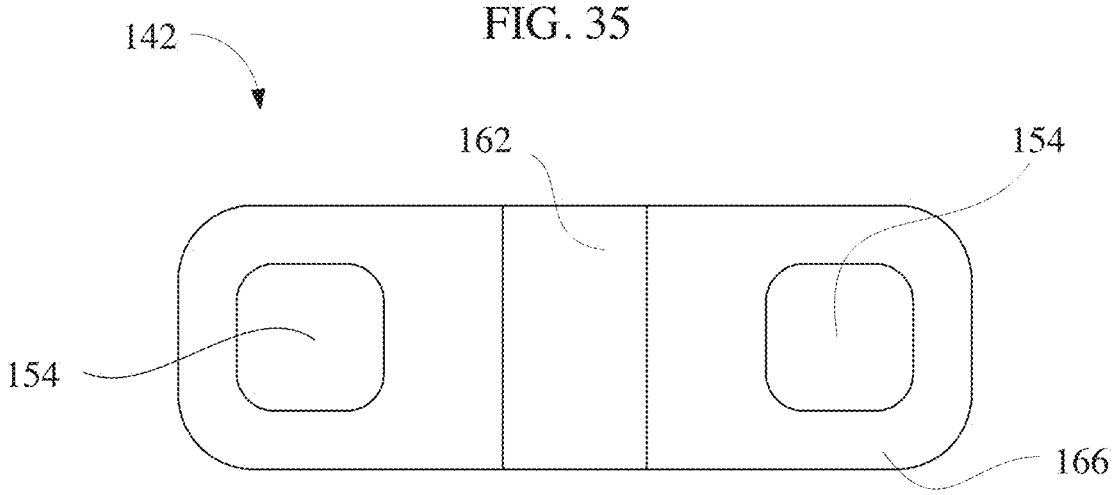
Figure 37:
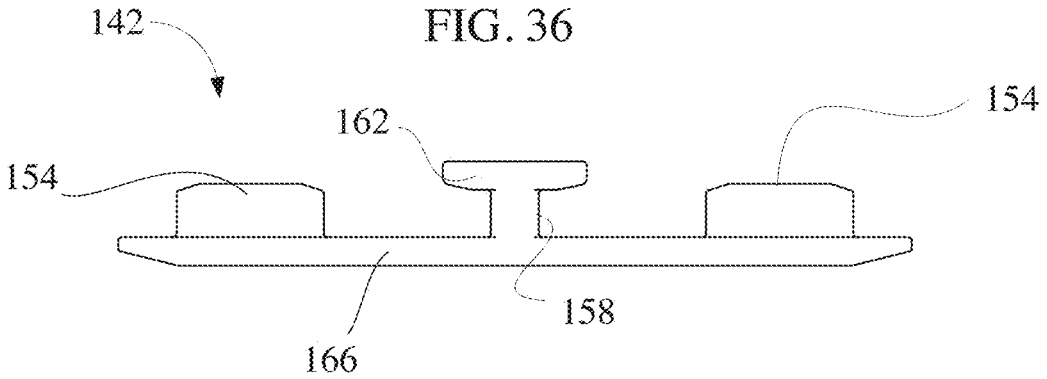

FIG. 34 illustrates a front view of several connected grid units. Each unit is shown by a dashed outline. Units could be made in squares or rectangles and of any multiple of dimensions. Straps 150 can be used to stabilize each individual unit, or the connected units Connectors FIGS. 35-37 illustrates a possible connector 142 used to connect grid units together. The connector 142 may include posts 154 that are inserted into the holes 134. The connector may include a center bridge post 158 which fits into the recess 138. A bridge plate 162 may be formed at the top of the bridge post 158. A main plate 166 may attach the posts 154 and bridge post 158 into a single piece. The connector may be formed from a semi-rigid elastic material such as a thermoplastic. To assemble the parts, the main plate 166 may be flexed to bend the post 154 back and allow the post 154 and bridge post 158 to be inserted into a hole 134 and recess 138 on a furniture panel. The other side of the connector 142 is similarly attached to another furniture panel to attach the panels together. The furniture panels are held between the main plate 166 and bridge plate 162 and secured together by the post 154 and bridge post 158.

Figure 38:
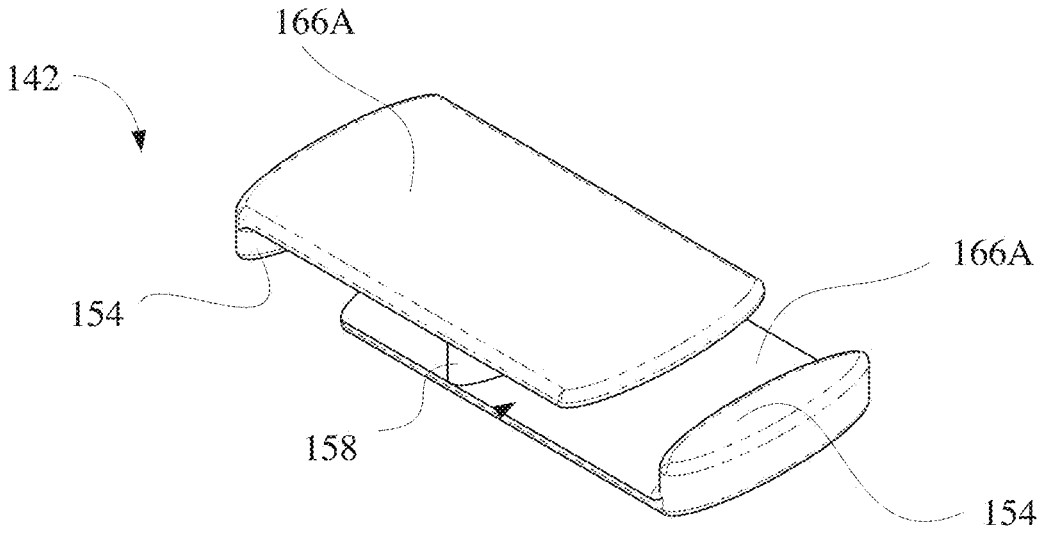
Figure 39:
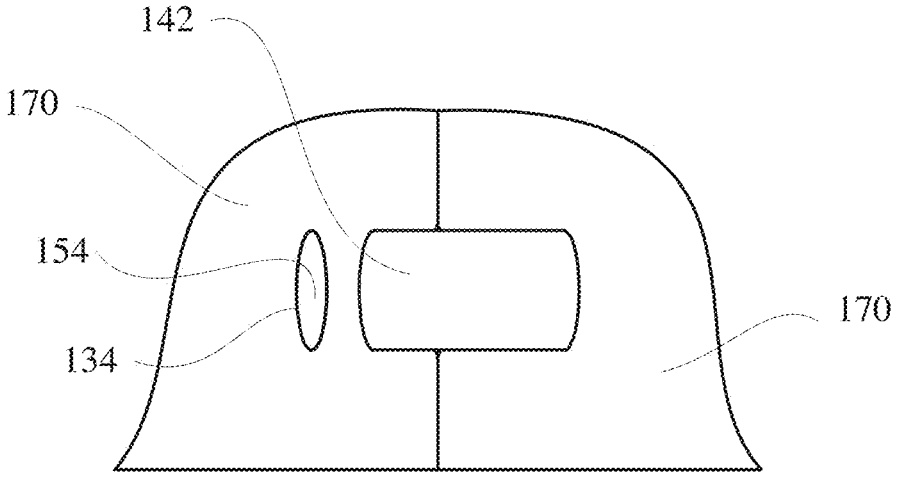

FIG. 38 illustrates an alternative embodiment of the connector 142. In this embodiment, the connector includes two opposed side plates 166A which are each attached to a side post 154 and the bridge post 158. The side plates 166A are placed on opposite sides of the panels 10, 14 which are assembled together and the panels are held between the side plates 166A. FIG. 39 illustrates the alternative connector 142 of FIG. 38 installed and connecting two panels 170 together.

Figure 40:
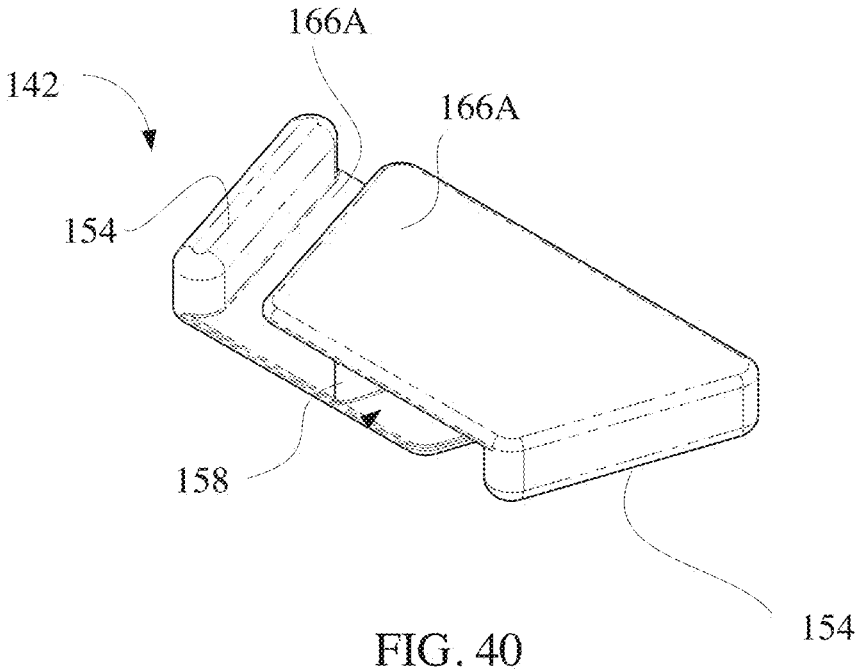
Figure 41:
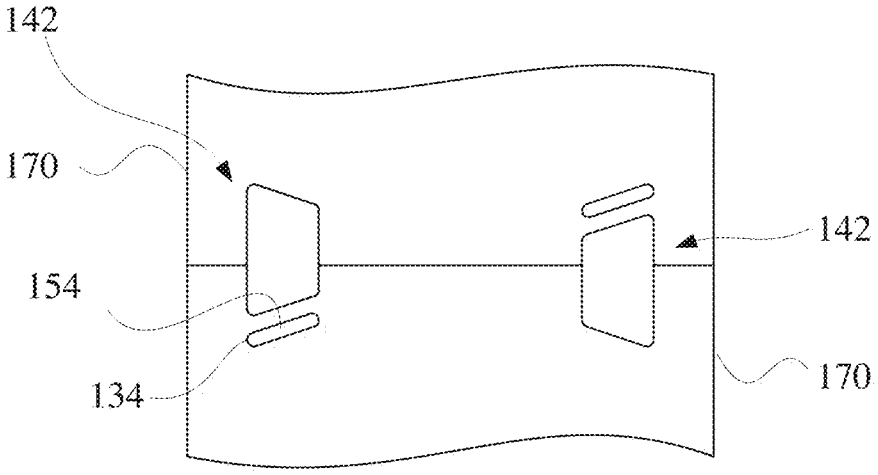

FIG. 40 illustrates another embodiment of the connector 142 which is similar to the connector of FIG. 38 but which includes elongate angled posts 154. FIG. 41 illustrates two of the connectors 142 holding two planar pieces 170 together. The angled configuration of the posts 154 and holes 134 may improve the performance of the connector 142 in preventing the panels 170 from shifting back and forth relative to each other.

Figure 42:
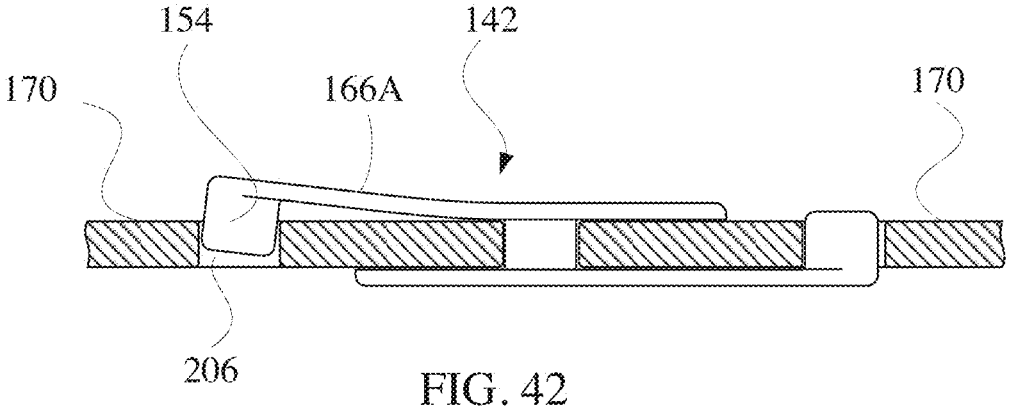
Figure 43:
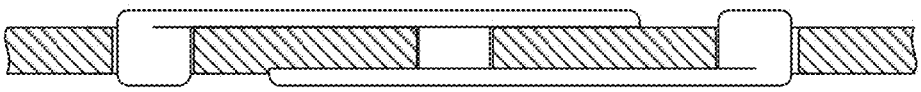

FIGS. 42 and 43 illustrate a cross section of a connector 142 used to attach panels 170 together. In discussing the connectors 142, it is appreciated that the connectors 142 may be used to attach any of the various panels together. The side plates 166A of the connector 142 may be flexed to allow the post 154 to be placed into the hole 134 to secure panels 170 together. The connector 142 may then bend back to the unbent position shown in FIG. 43 to connect the panels 170.

Figure 44:
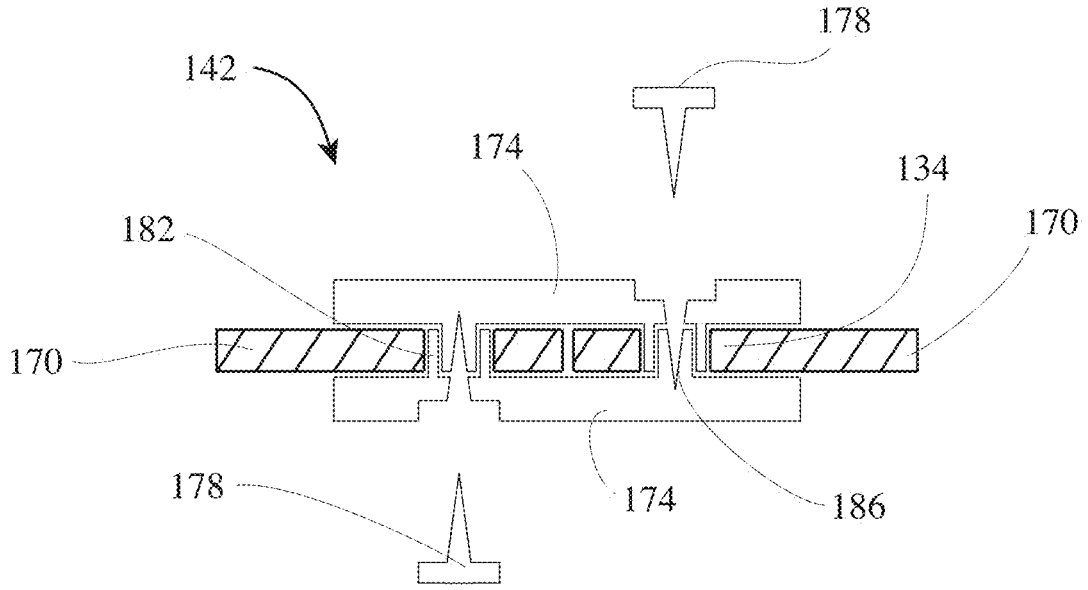
Figure 45:
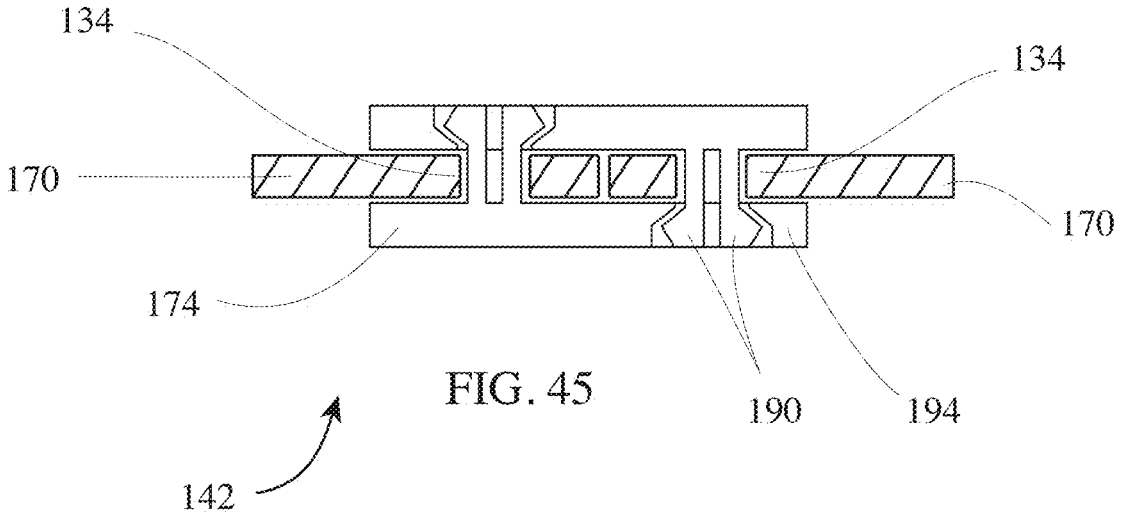

FIG. 44 shows another connector 142 which may be used to connect panels 170 together. The connector is formed of two pieces which are assembled together to hold panels 170 together. The connector 142 may have two halves 174 which are passes through the hole 134 in the panels 170 and the halves 174 are then fastened together to join the connector 142 and secure the panels 170. The connector halves 174 may be fastened together with screws 178. The connector half 174 may have a hollow post 182 which fits through a hole 134 and a smaller post 186 which fits into a recess in the hollow post 182. A connector half 174 may have a hollow post 182 and a smaller post 186 which pass through holes 134 in two panels 170 and engage a hollow post 182 and smaller post 186 on another connector half. FIG. 45 shows another connector 142 which is similar to the connector of FIG. 44. The connector may have a snap-together connection where each half 174 of the connector has arms 190 which pass through the hole 134 and a receptacle 194 which receives these arms. Each connector half 174 may be placed so that the arms 190 extend through a hole 134 in a panel 170 and the receptacle 194 is aligned with a hole 134 in an adjacent panel 170. Another connector half 174 is similarly situated so that the arms 190 of each connector half 174 engage the receptacle 194 of the other connector half. The arms 190 have ridges or other projections which engage the receptacles 194 and lock the connector halves 174 together to fasten the panels 170 together. The arms 190 may be pressed together to release the arms from the receptacle 194 and remove the connector 142 as desired. The two connector pieces may be designed so that one end has a male end and the other ends is female end. This allows for lower tooling costs and few parts.

Interchangeable Components

Figure 46:
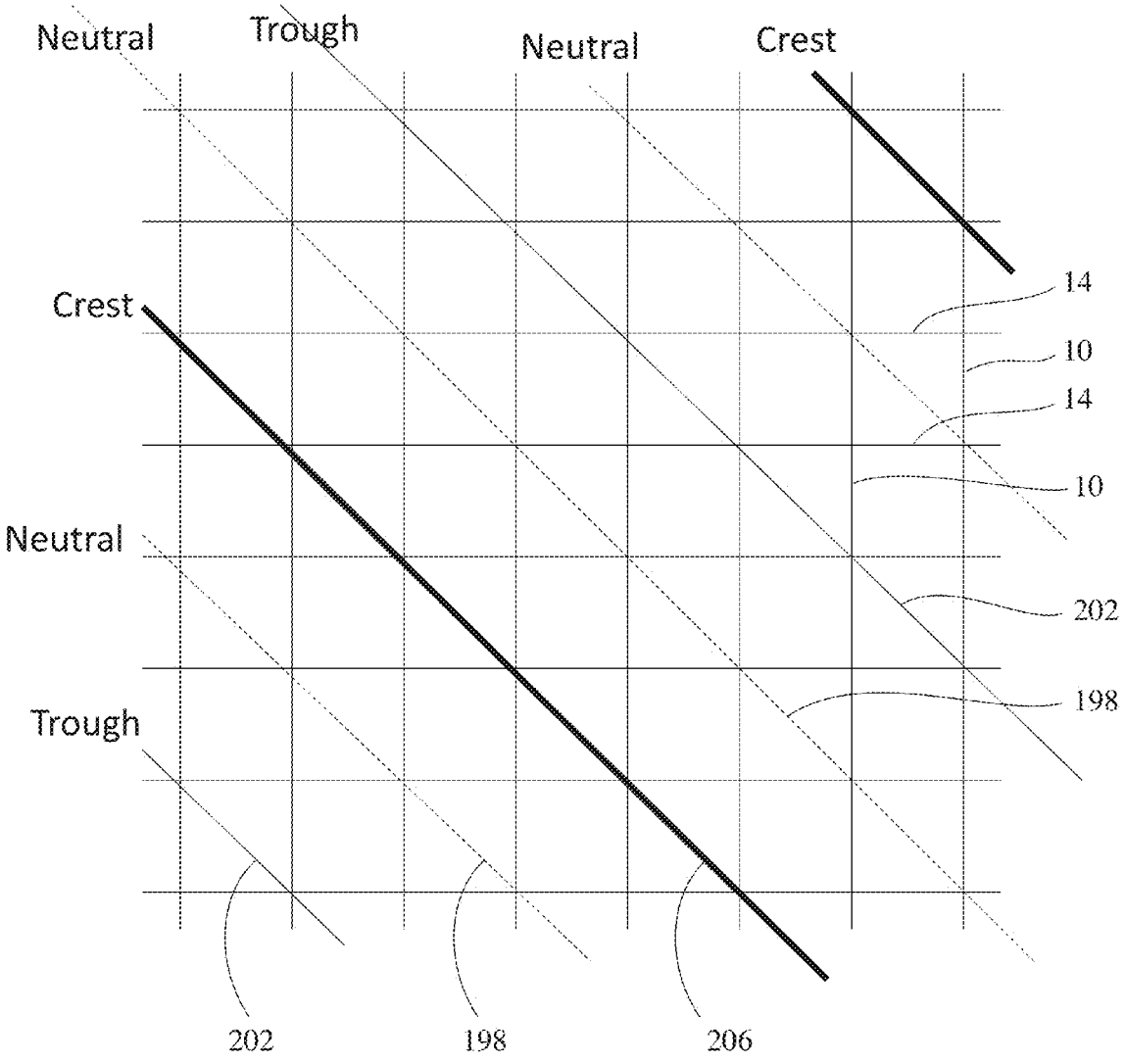
FIGS. 46 through 48 show the application of a wave shape to the front of a furniture grid.
Figure 47:
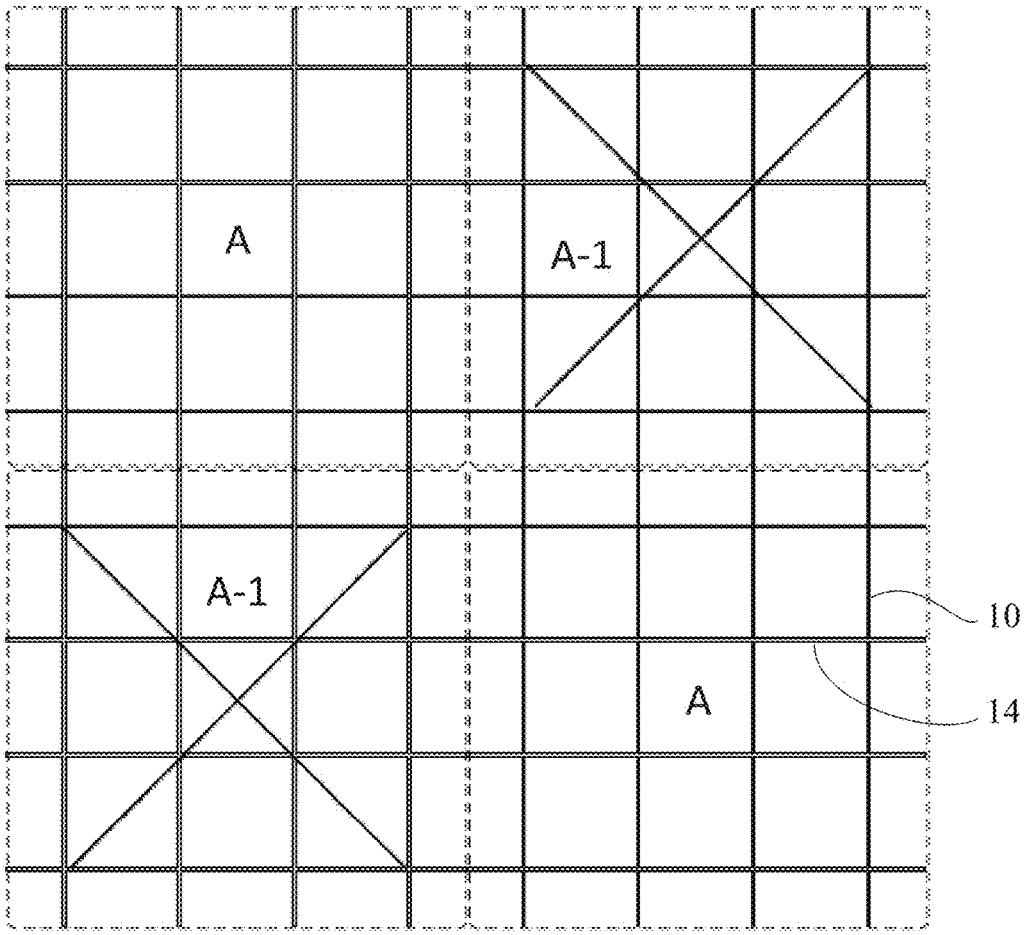

There are several considerations that can be given to optimize the use, manufacture, and shipping of grid components. The grid components can be optimized for modularity. The design of the wave shaped front of the shelving grids can be modified to allow units to be joined together in modular units. FIG. 46 illustrates how to achieve this. If the modular units are designed so that the neutral portion 198 of the wave shaped front (the average forward distance of the trough 202 and crest 206, see FIGS. 30 and 33 for example) lies diagonally across the center of a square shelf, the shelf can be made from four smaller shelf sections, all of which are made of the same parts. FIG. 47 shows that the four sections (A and A-1) would each be made of the same parts, but sections A would be constructed in the same way, and sections A-1 would be constructed in reverse order. This allows greater flexibility in assembling the shelve sections with fewer unique parts.

For modularity, the panels making the grids should be extended to the mid-point of the cubby areas between the panels. To allow flexibility in modularity for a 2×2 cubby, the top/bottom edge could be cut short. For a cubby intended to be stacked on one another in most cases, the top and bottom portions could be reduced to for less material usage and better aesthetic.

Optimized for Fewer Components

Figure 48:
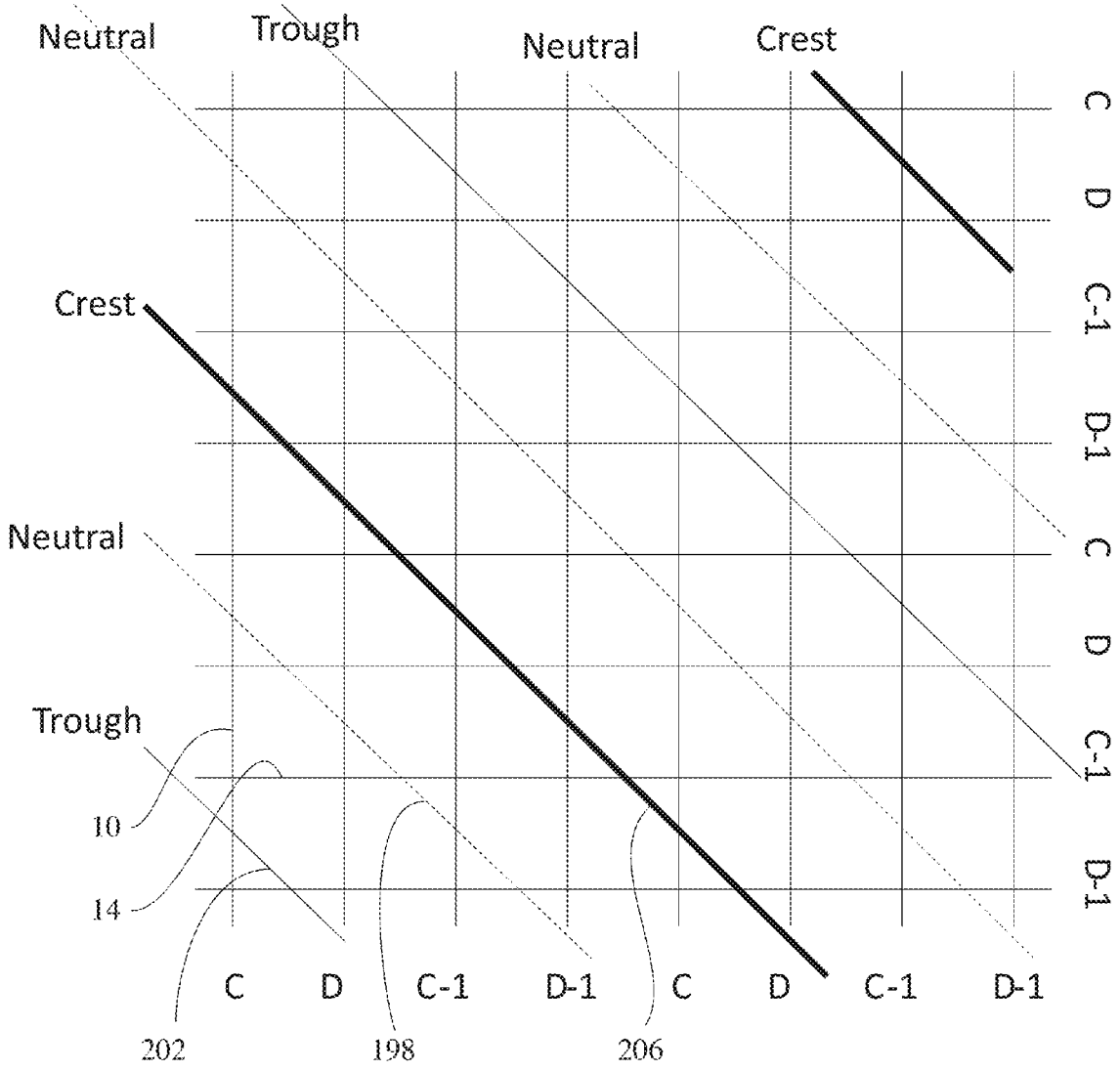

FIG. 48 shows another embodiment of the shelves. In this embodiment, the crest 206 crosses centered between joints of panels 10 and panels 14 rather than directly over the joints between panels 10, 14. This allows the entire shelf to be built from four unique parts, (C, C-1, D, and D-1) though the direction of the parts is alternated. This also allows for design with fewer parts. These principles can also be applied to non-sinusoidal, but repeating wave like forms. Some of the methods may require a wave form that is symmetric about the trough and peak but not all do.

Back Stabilization

Figure 49:
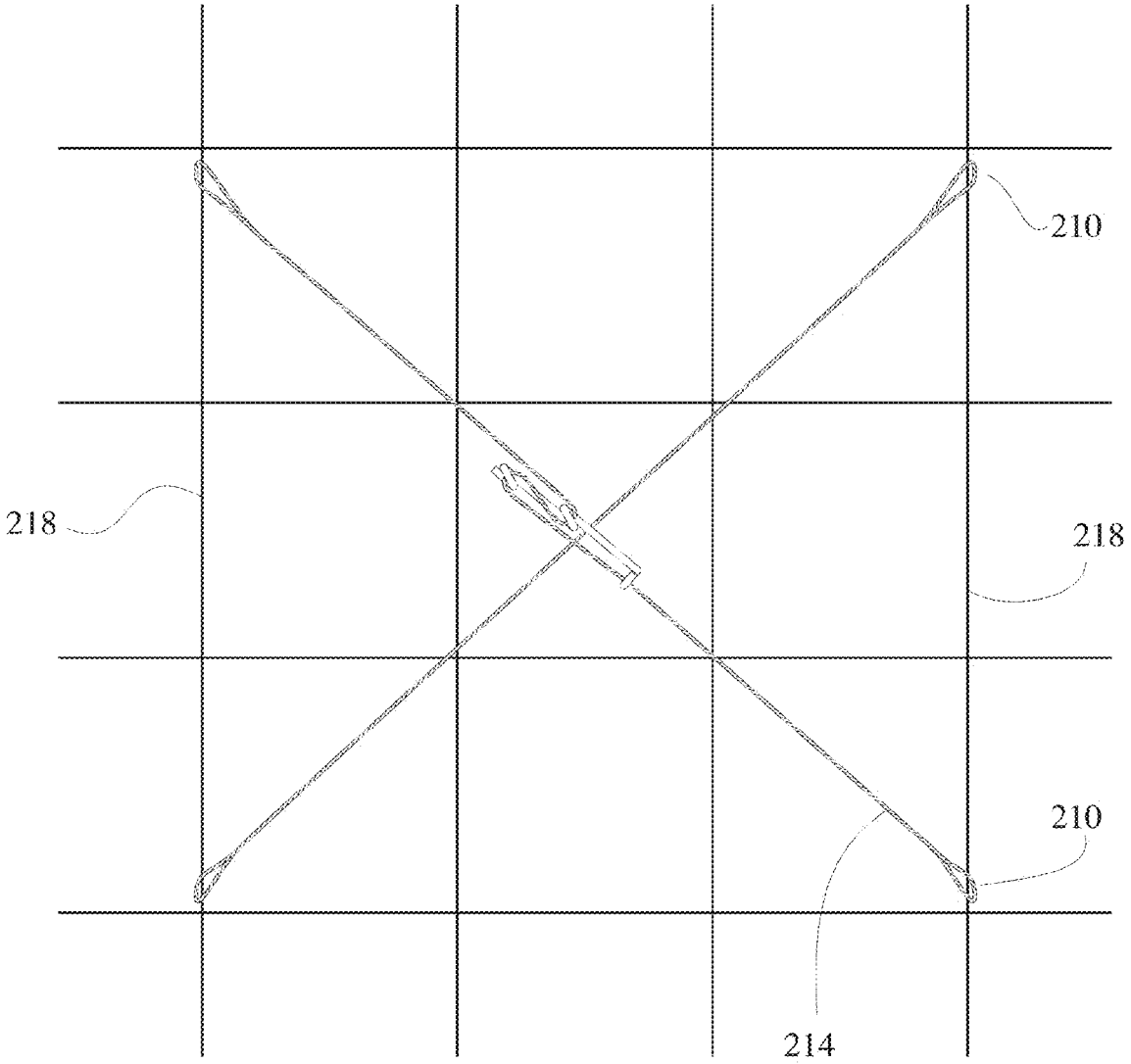
FIGS. 49 through 53 show braces for modular furniture.
Figure 50:
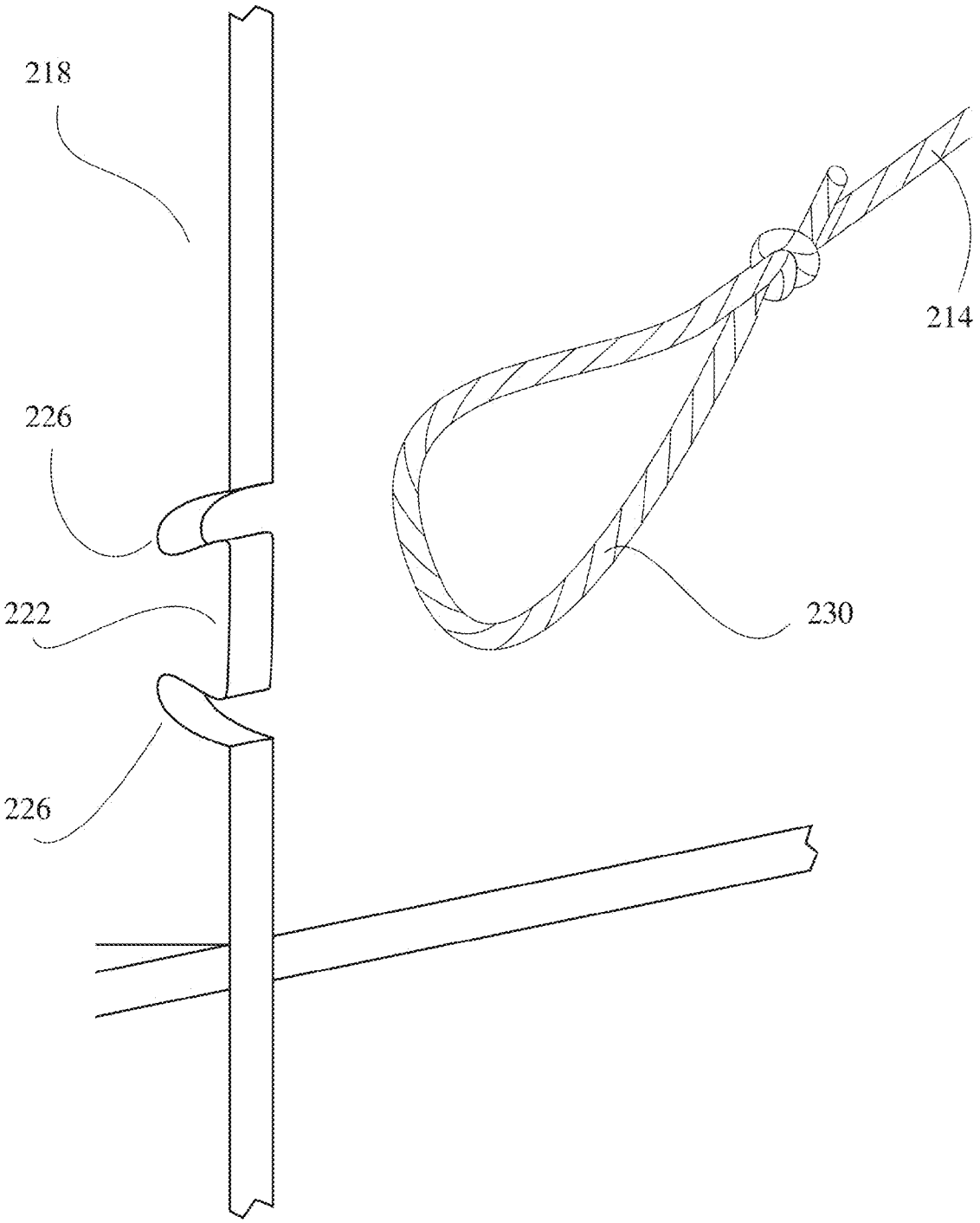
Figure 50A:
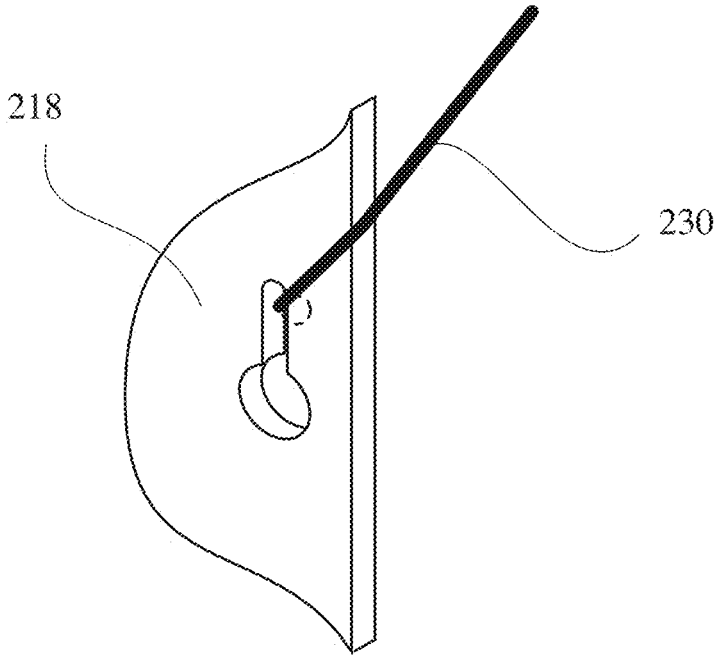
Figure 50B:
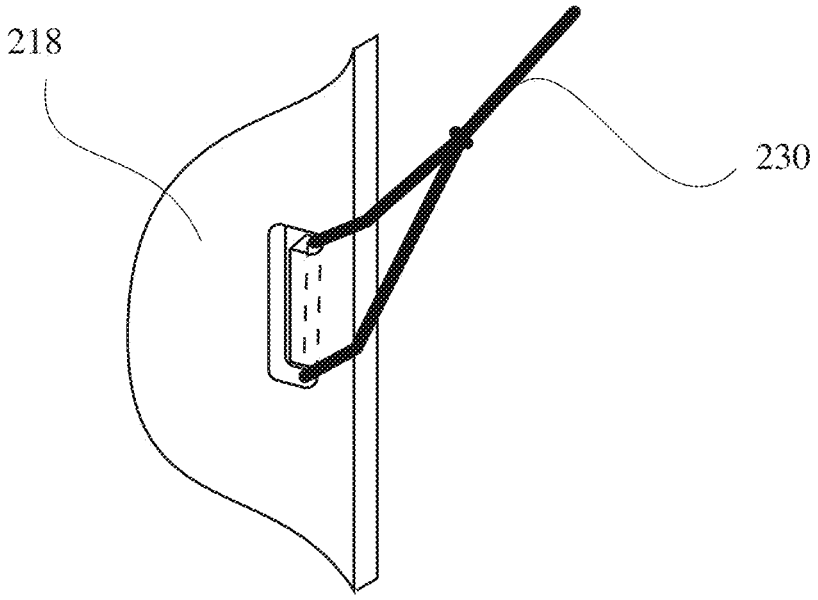
Figure 51:
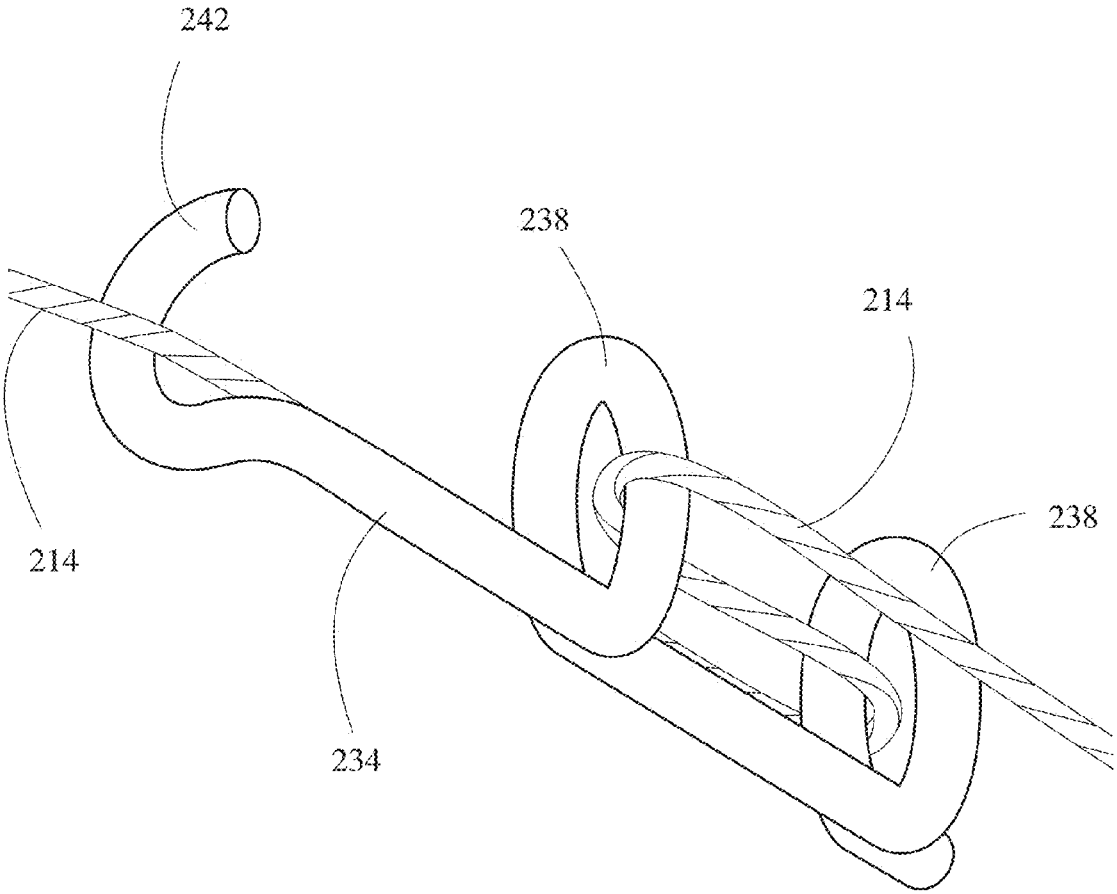
Figure 52:
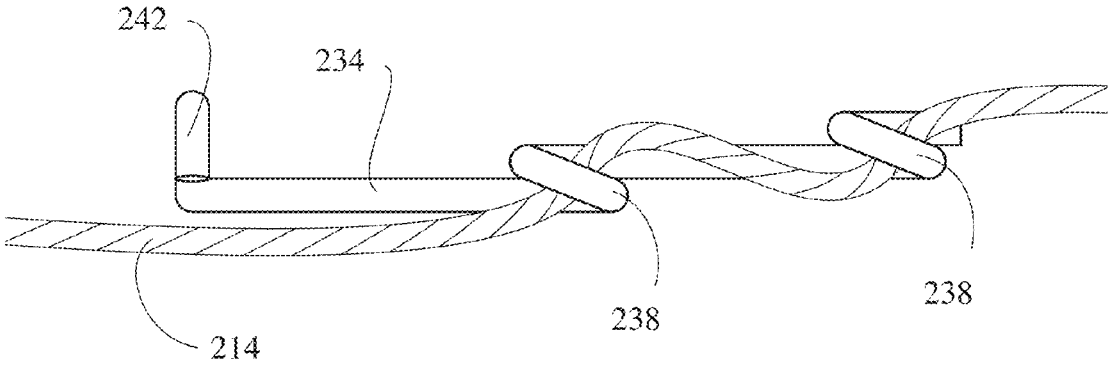
Figure 53:
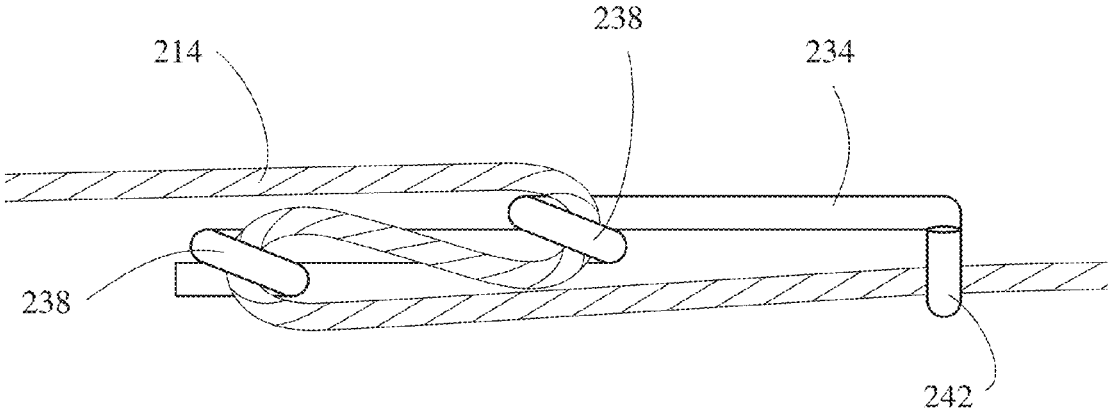
Figure 54:
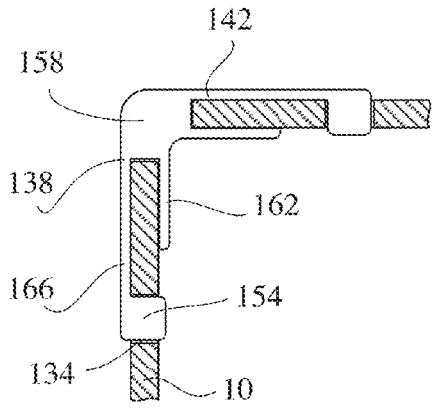
FIGS. 54 through 57 show connectors for attaching panels of modular furniture together.
Figure 55:
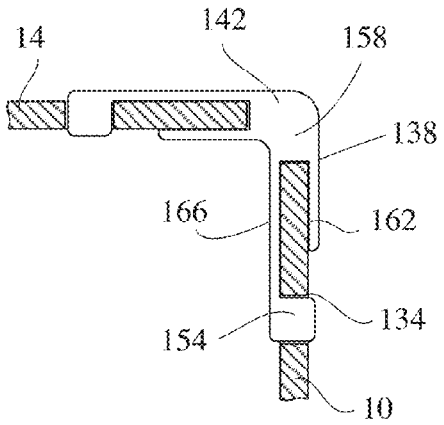
Figure 56:
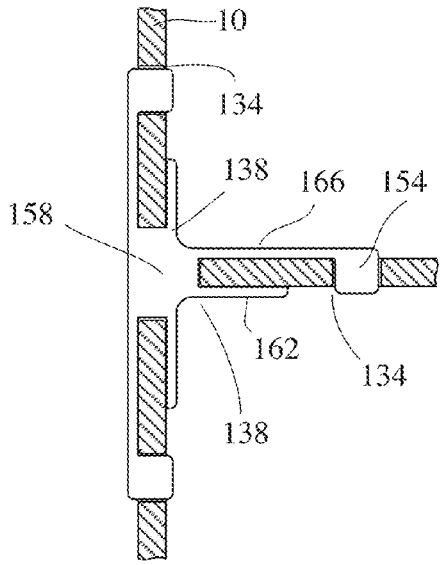
Figure 57:
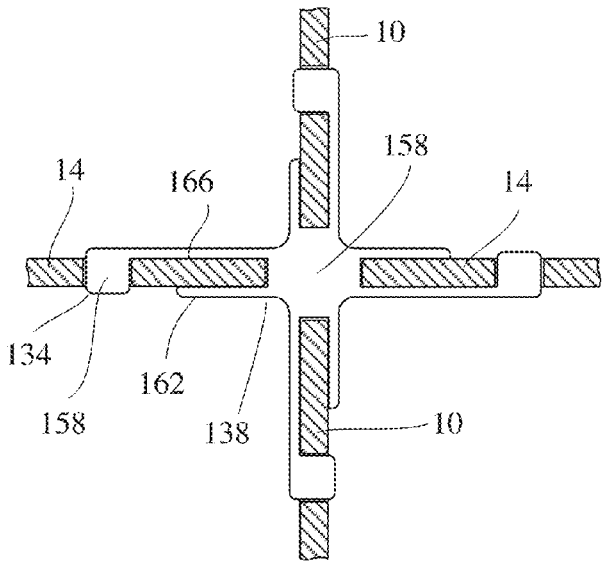

FIG. 49 shows how slots or holes 210 can be used to allow straps or cords 214 to be attached diagonally between the corners of furniture panels 218 (which may be panels 10, 14, 42, 46, etc.) for stability. FIG. 50 shows an alternate configuration where a panel 218 is formed with a tab 222 at an edge thereof, such as at a back edge of the panel 218. The tab 222 may be formed by slots 226 which converge inwardly so that the outside edge of the tab 222 is wider than the root of the tab, causing a looped cord under tension to be held at the root of the tab 222. FIGS. 50 A and 50B show alternative methods of attaching a cord to the panel. A cord 214 may be placed across a diagonal of a piece of furniture as shown in FIG. 49 to stabilize the furniture. The cord 214 may have loops 230 formed on its ends and the loops 230 may be placed over tabs 222 to secure the cord to the furniture. FIG. 51 shows a tensioning device 234 may be used to apply tension to the cord 214 after placement on the tabs 222. The tensioning device 234 may include two holes 238 through which the cord 214 passes and a hook 242 which is secured around the cord 214 to apply tension. FIG. 52 shows the tension device 234 and cord 214 in a non-tensioned configuration. The cord 214 passes through the holes 238. FIG. 53 shows the tension device 234 and cord in a tensioned configuration. The tensioning device 234 has been rotated to place the hook 242 around the end of the cord 214 which passes into the hole 238 farthest away from the hook 242. This causes the cord 214 to double back over itself and shortens the cord 214, applying tension to the cord 214 as placed between tabs 222.

If desired, only one cord needs a tensioner 234. If this is done, though, the cord with no tensioner needs to be shorter, and when under load, the shorter cord and the longer cord with the tensioner 234 secured need to be the same length. One advantage to the tabs 222 and cord 214 is that they take up very little of the cubby space as they are right on the back of the panels.

Alternate Grid System

FIGS. 54 through 57 illustrate cross sectional views of a joint and a connector which allows the shelving grid of panels 10, 14 to be constructed without tabs or edges which extend beyond the Grid. Rather than having slots 18 as used in the middle of the shelving grid, the perimeter joints around the grid may be formed with connectors 142. The adjoining edges of panels 10 and 14 may be formed with holes 134 and recesses 138 as shown in FIG. 30. The connector may have posts 154 and a central bridge post 158 with body plates 166 and bridge plates 162 disposed on opposite sides of the panels 10, 14. Rather than being relatively flat for joining in-plane panels 10, 14, the connectors may be formed in cross, Tee, and angle configurations for joining panels 10, 14 at corners, tees, and crosses. The connectors are similar to the connectors shown in FIGS. 30-43 if these had been cut through at the center and joined together in the configurations shown. These angled connectors 142 in FIGS. 54 and 55 allow a shelving grid to be formed without overhanging tabs or edges. The connectors shown in FIGS. 56 and 57 may be used to connect sections of shelving grid together to form a larger shelving grid.

Bins

Storage bins or boxes can be used with a shelving grid or cubby system. There are several ways that bins can be used to create visually interesting and functional storage.

City Scape Buildable Bins

Figure 58:
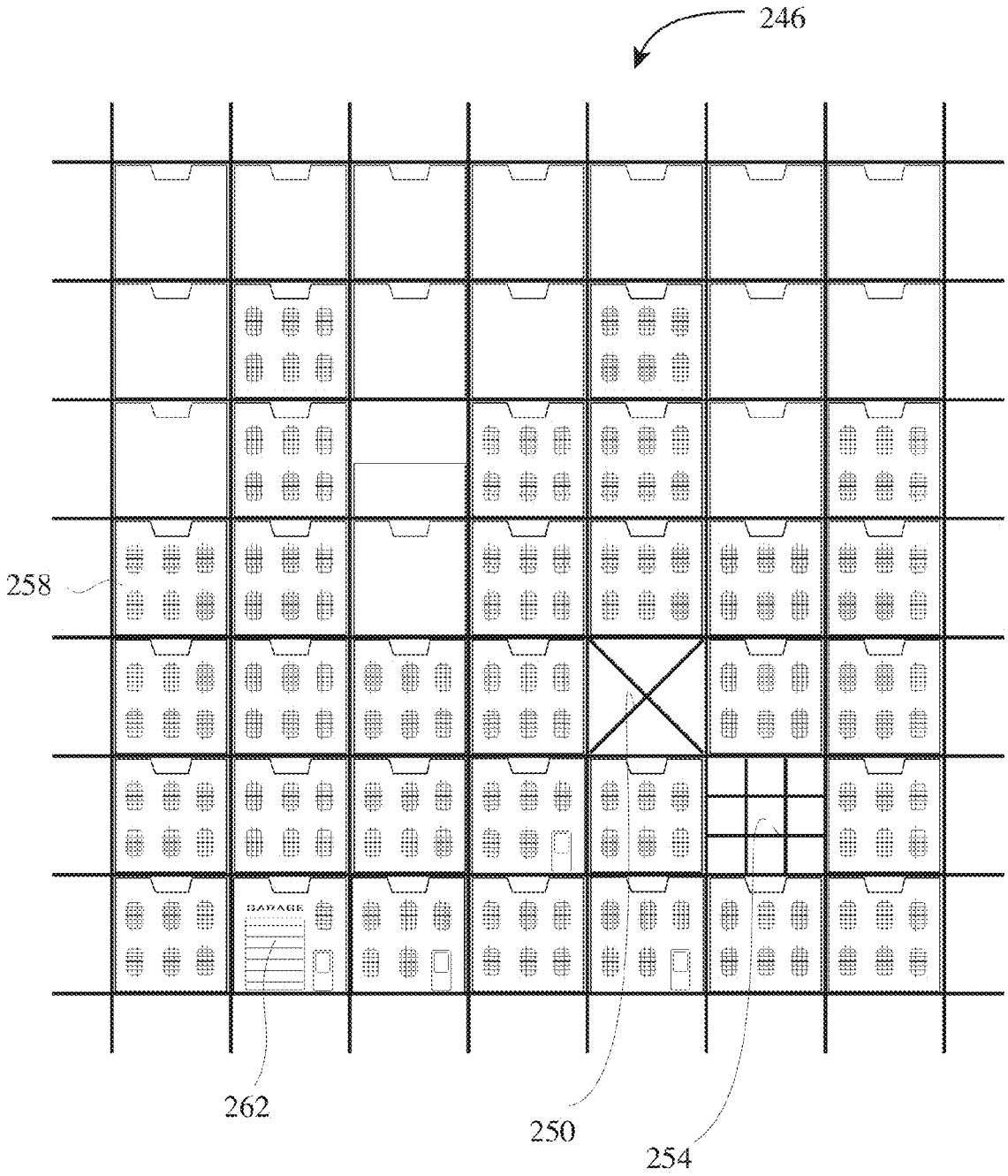
FIGS. 58 through 71 shows printed boxes/bins which may be used with a shelving grid.

FIG. 58 illustrates a large shelving grid or cubby unit referred to generally at 246. This unit 246 has a number of shelf areas or cubbies formed from panels 10, 14 as discussed previously. The unit 246 may be formed from a large shelving grid or multiple smaller shelving grids connected together. Insertable subdividers 250 and 254 have been inserted into some of the cubby openings. The insertable subdividers 250, 254 may also use the joints described previously in discussing panels 10, 14 and slots 18. Storage bins 258 may be inserted into the cubbies as desired. These storage bins may be boxes made of cardboard or plastic. The bins 258 may be printed with a variety of designs.

In one embodiment, some of the bins 258 are made to look like the facade of buildings. These bins are arranged to look like a skyline. Bin 262 is printed to represents a garage. Other bins that represent shops, apartments, labs, and other common buildings could be included. These building bins can be arranged to look like different cityscapes. In another embodiment, the bins are made to look like common household appliances, so the grid units can become a play kitchen. Printed bins become fun and interesting objects to children and are more decorative than ordinary bins.

Figure 59:
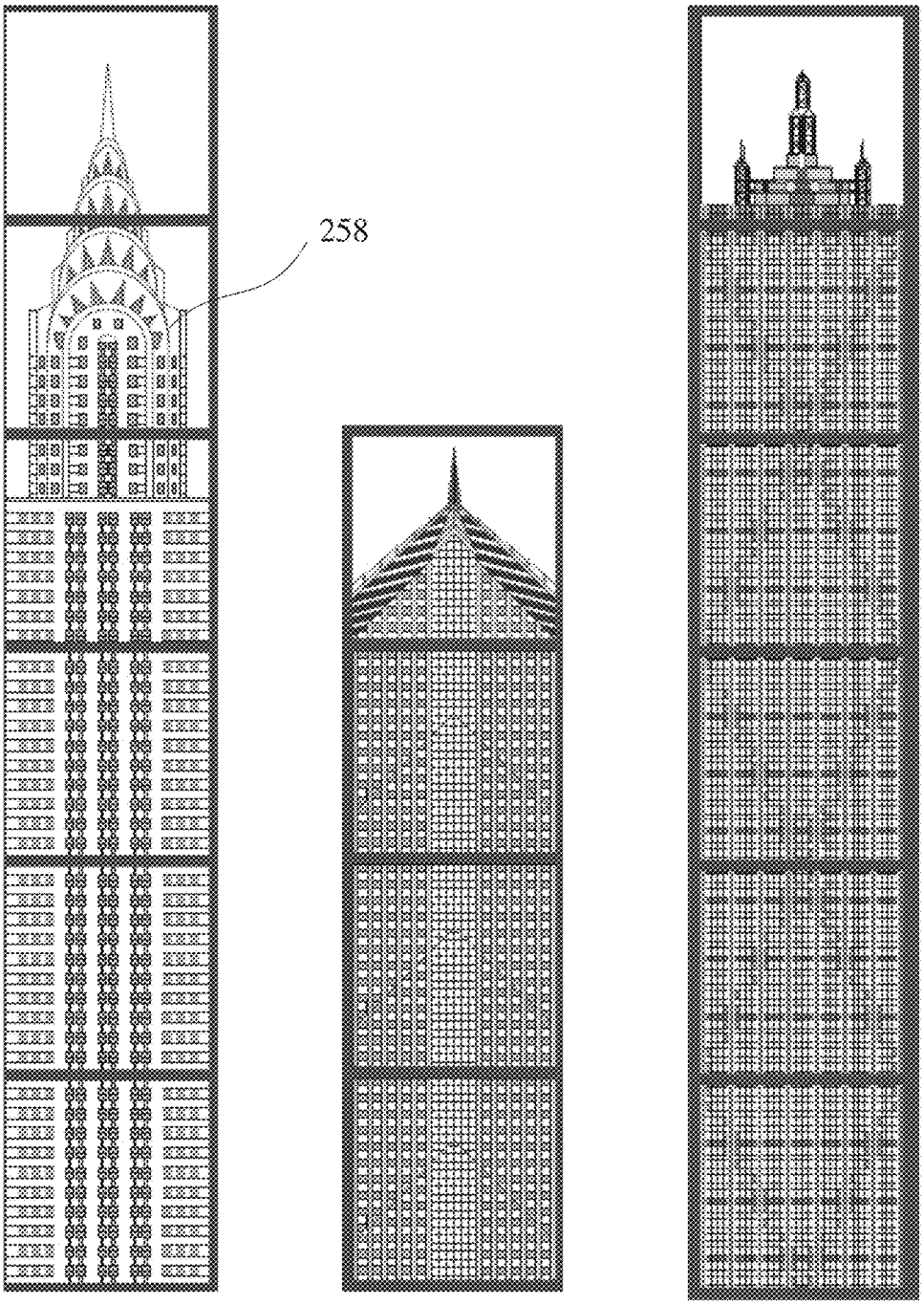
Figure 60:
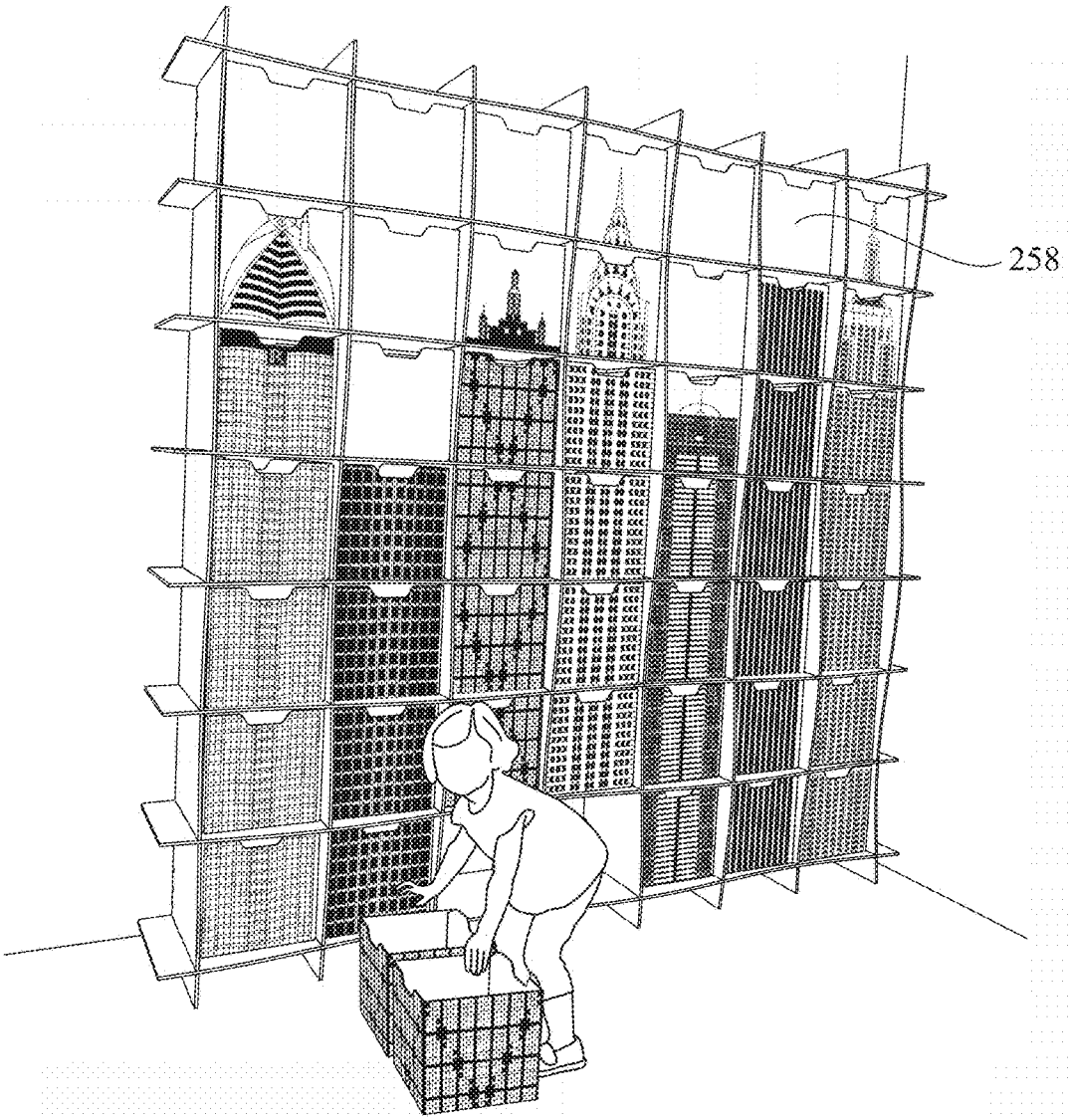
Figure 61:
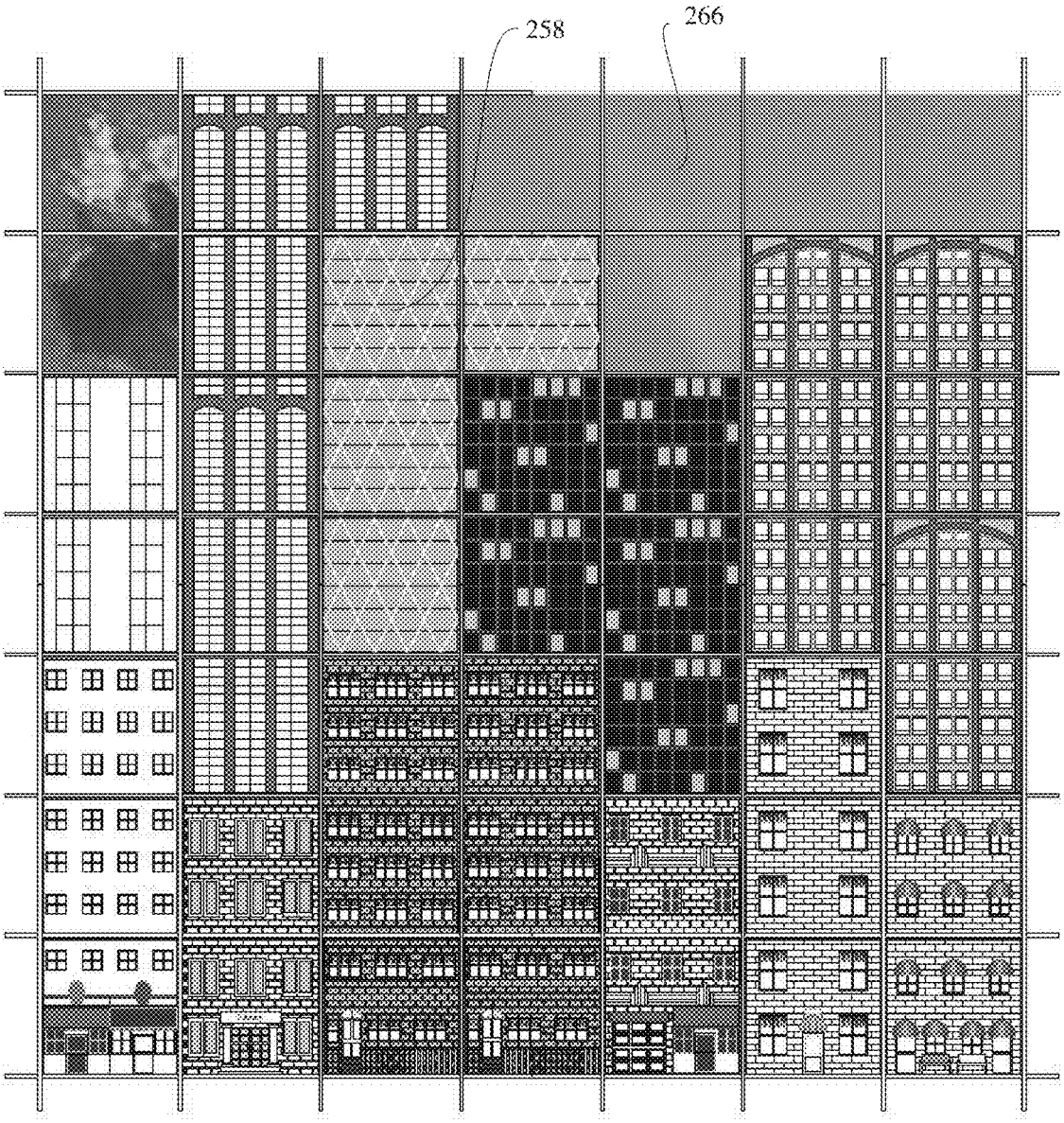

Modular building bins 258 as well as bins 266 which are unprinted or printed to look like sky prints are illustrated in FIGS. 59 through 61. Existing building have been identified and simplified to find repeating block sections that could be repeated to represent a building. These block sections are then printed on multiple bins, the bins are then put in the shelving units and the adjoining portions form the outline of a building. Multiple stacks next to each other can form an image similar to a city skyline. The tops may be unique to make a building more identifiable. Bins printed like smaller buildings may be included to create a layered effect. These bins may be printed front, back, and side with different patterns if desired.

Figure 62:
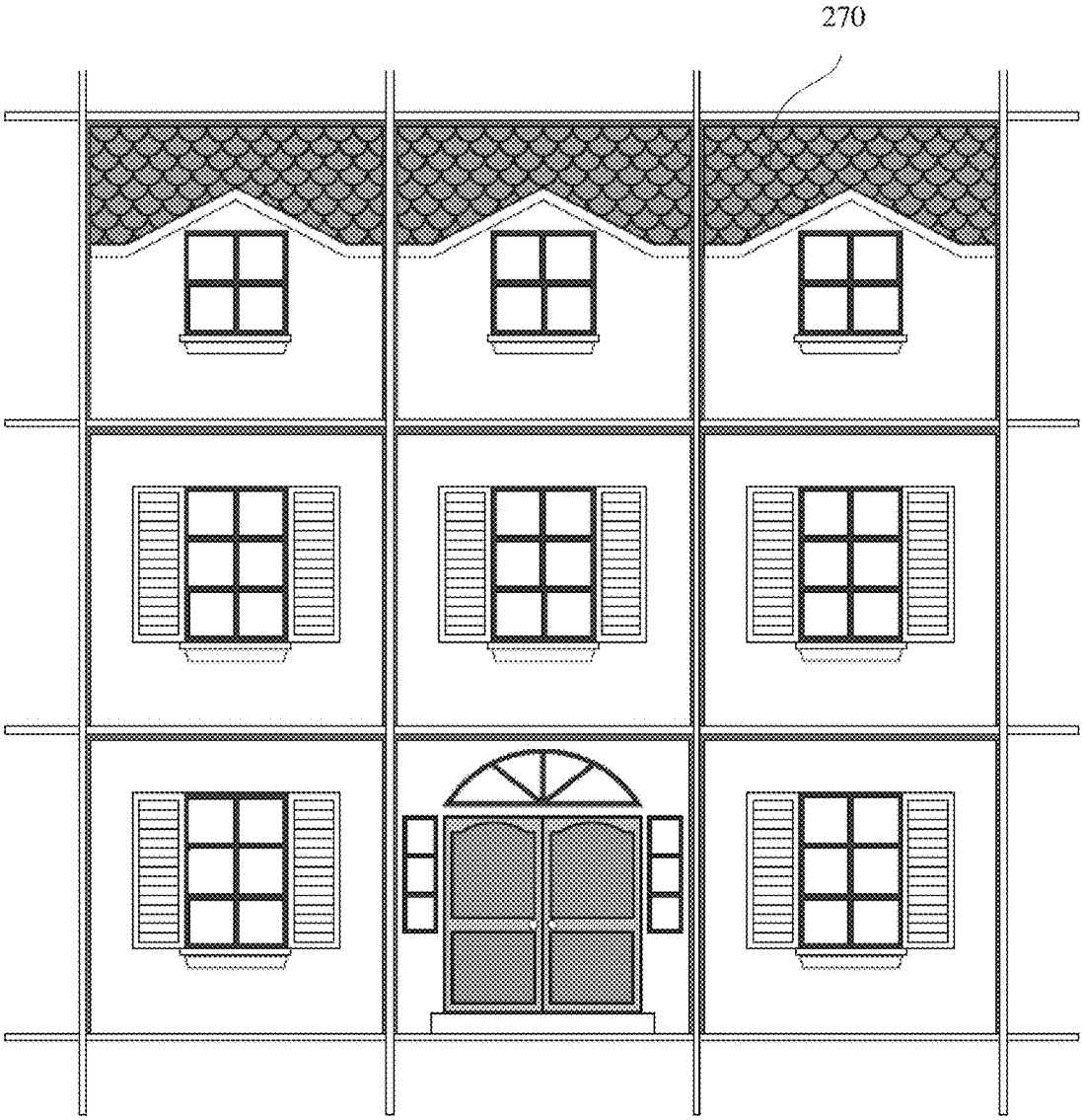
Figure 63:
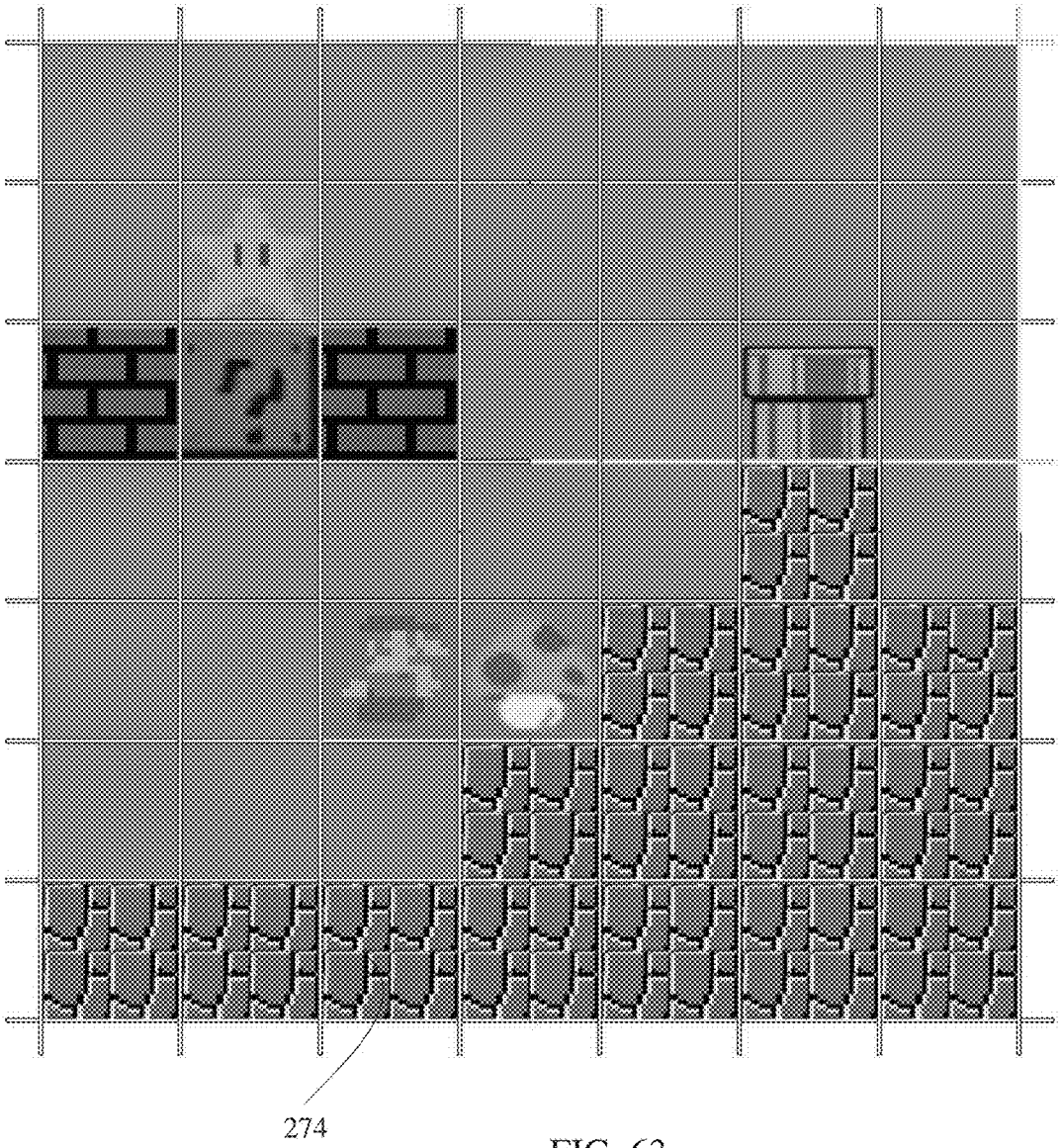
Figure 64:
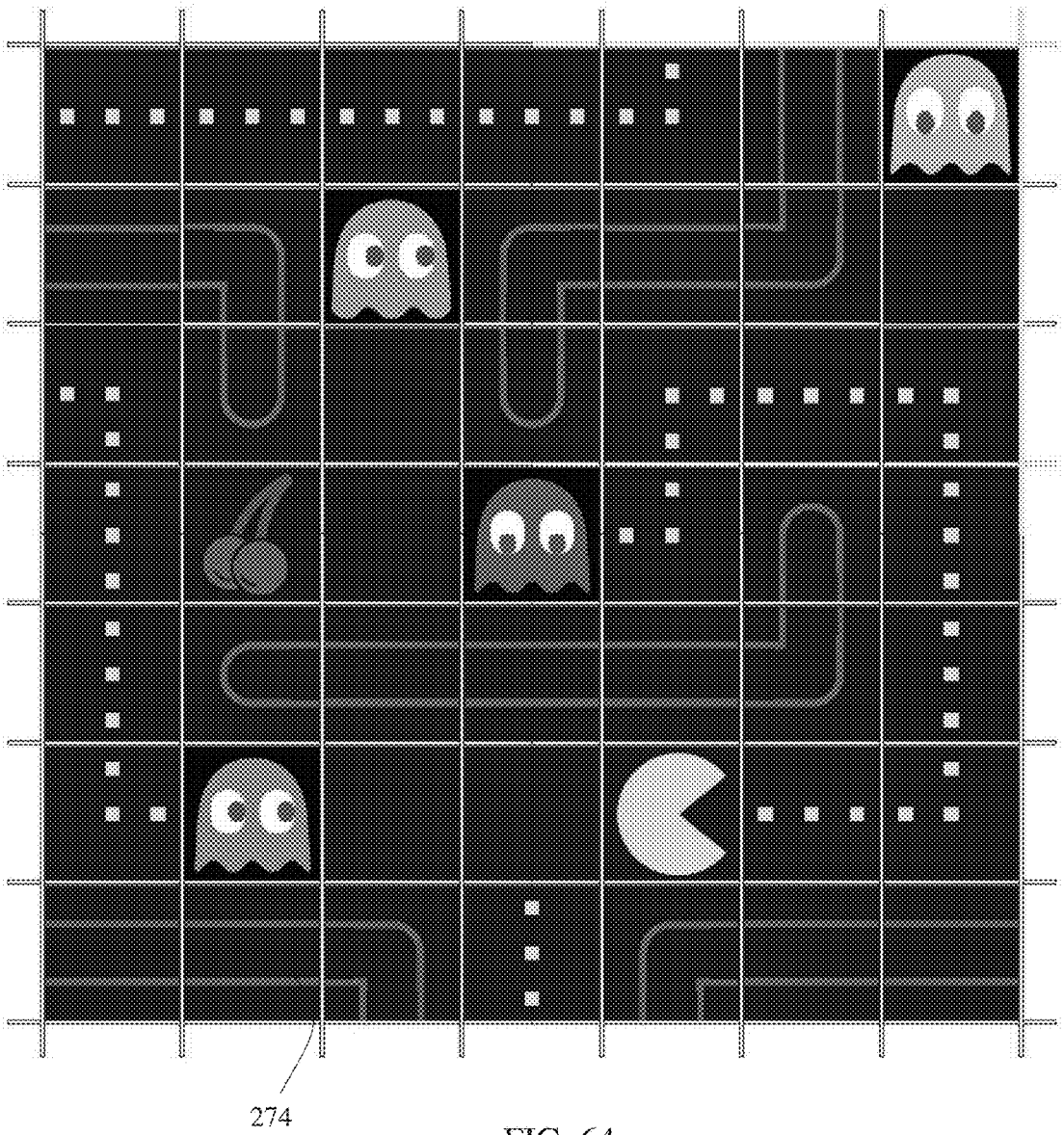

FIG. 62 illustrates bins 270 which are printed to look like parts of a house. These bins may be arranged to create different houses similar to how the city bins can be rearranged. FIGS. 63 and 64 show bins 274 which are printed to look like block elements of a video game. These bins 274 may be arranged to create different video game levels. Printed bins such as these allow a user to create custom decorative appearances for what would otherwise be a less attractive wall of storage boxes.

Patterned Bins

Figure 65:
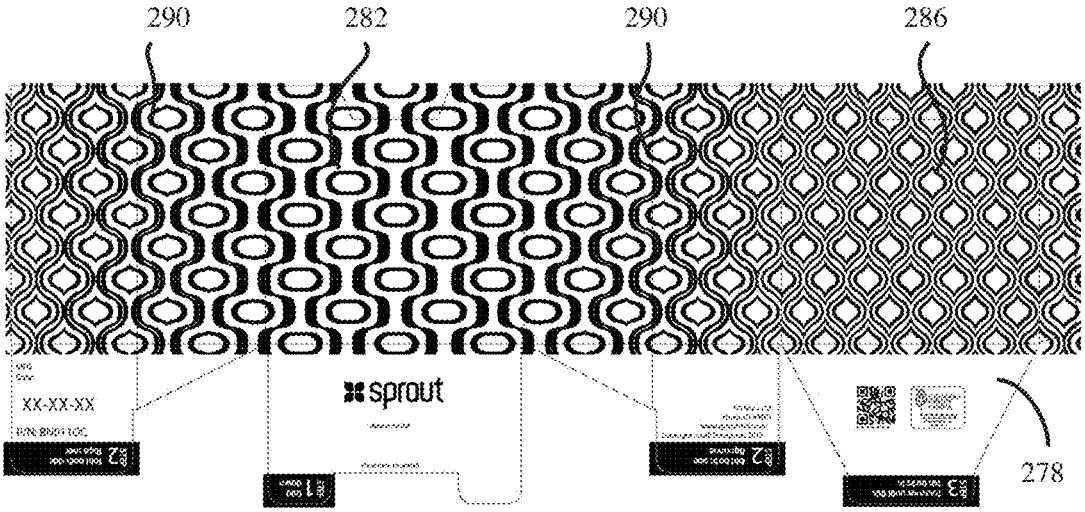
Figure 66:
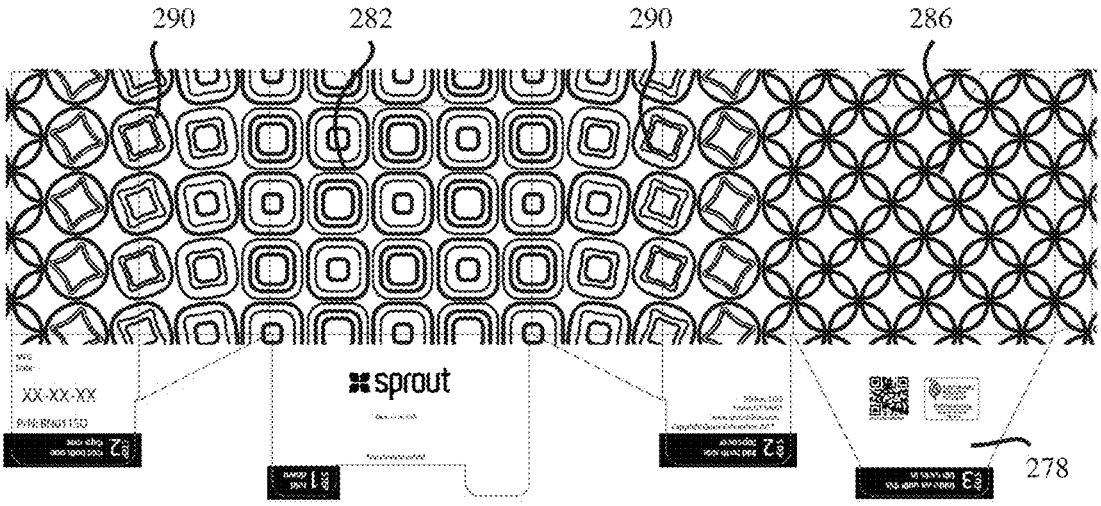
Figure 67:
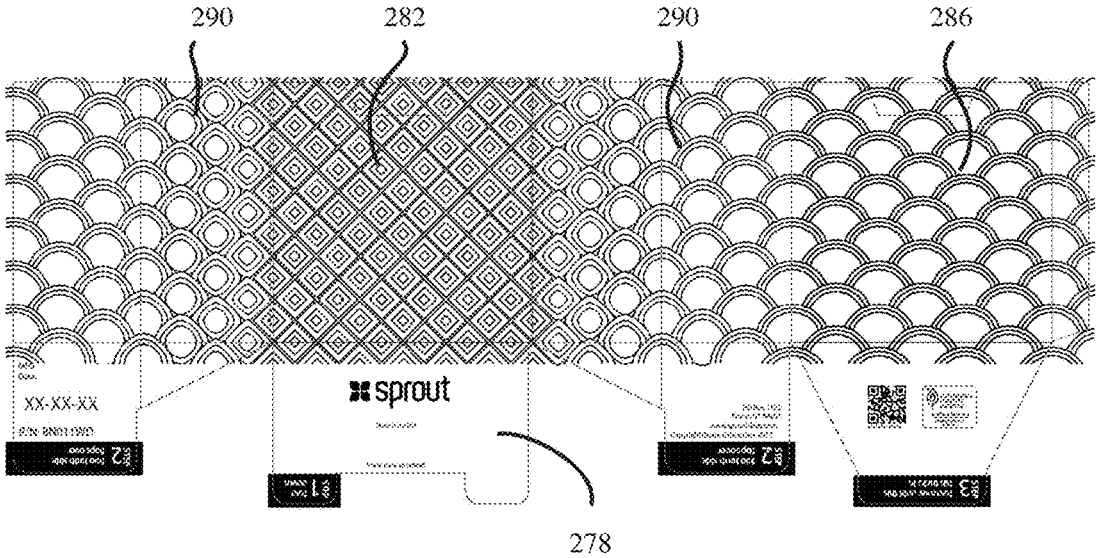

FIGS. 65 through 67 show bins 278 which are printed to show morphing patterns. The bins 278 are shown as the flat pattern of a box that is die cut and folded into box. When folded, the bin 278 has a front pattern 282 and a different back pattern 286, and side patterns 290 which gradually morph between the front and back patterns.

Figure 68:
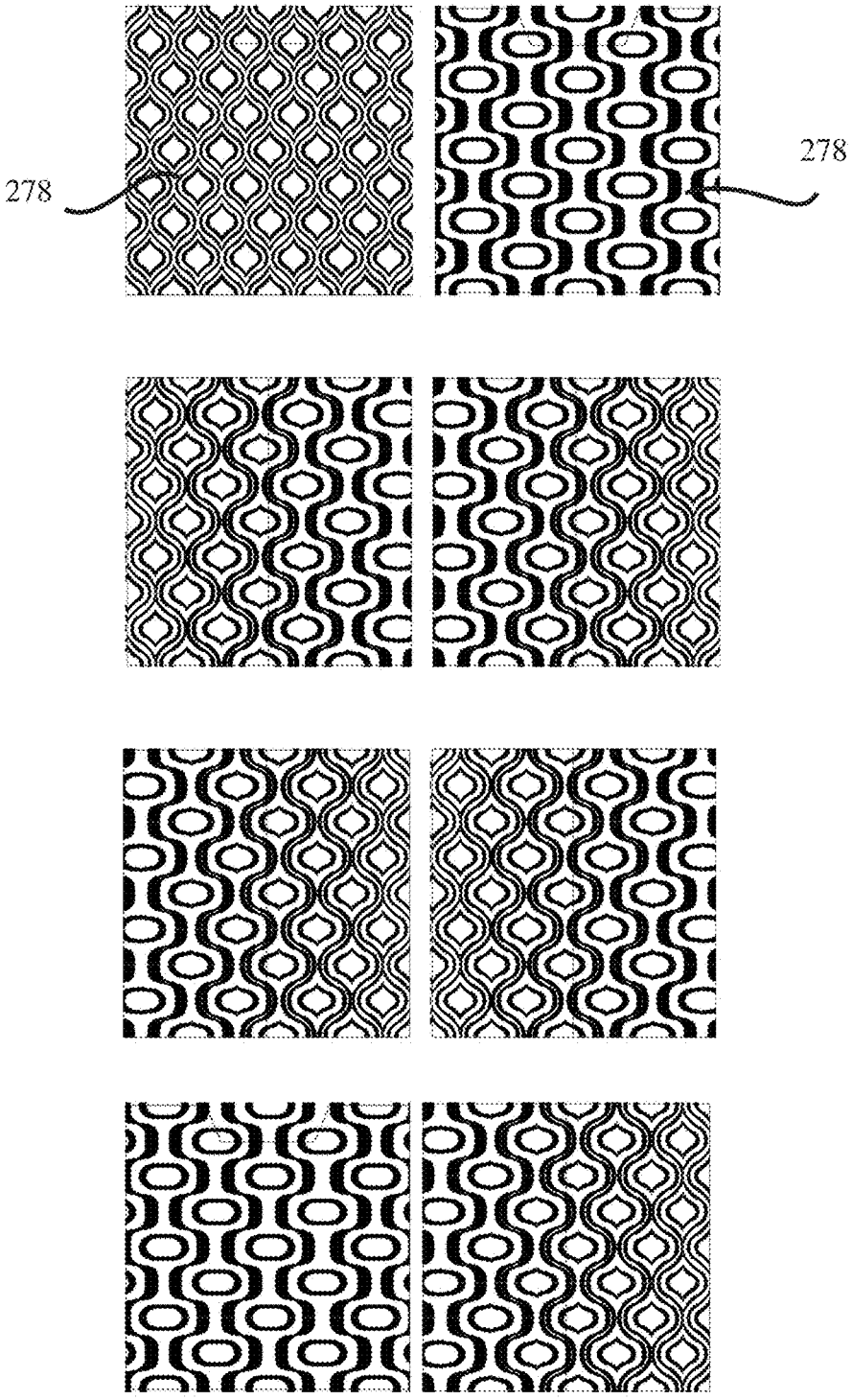
Figure 69:
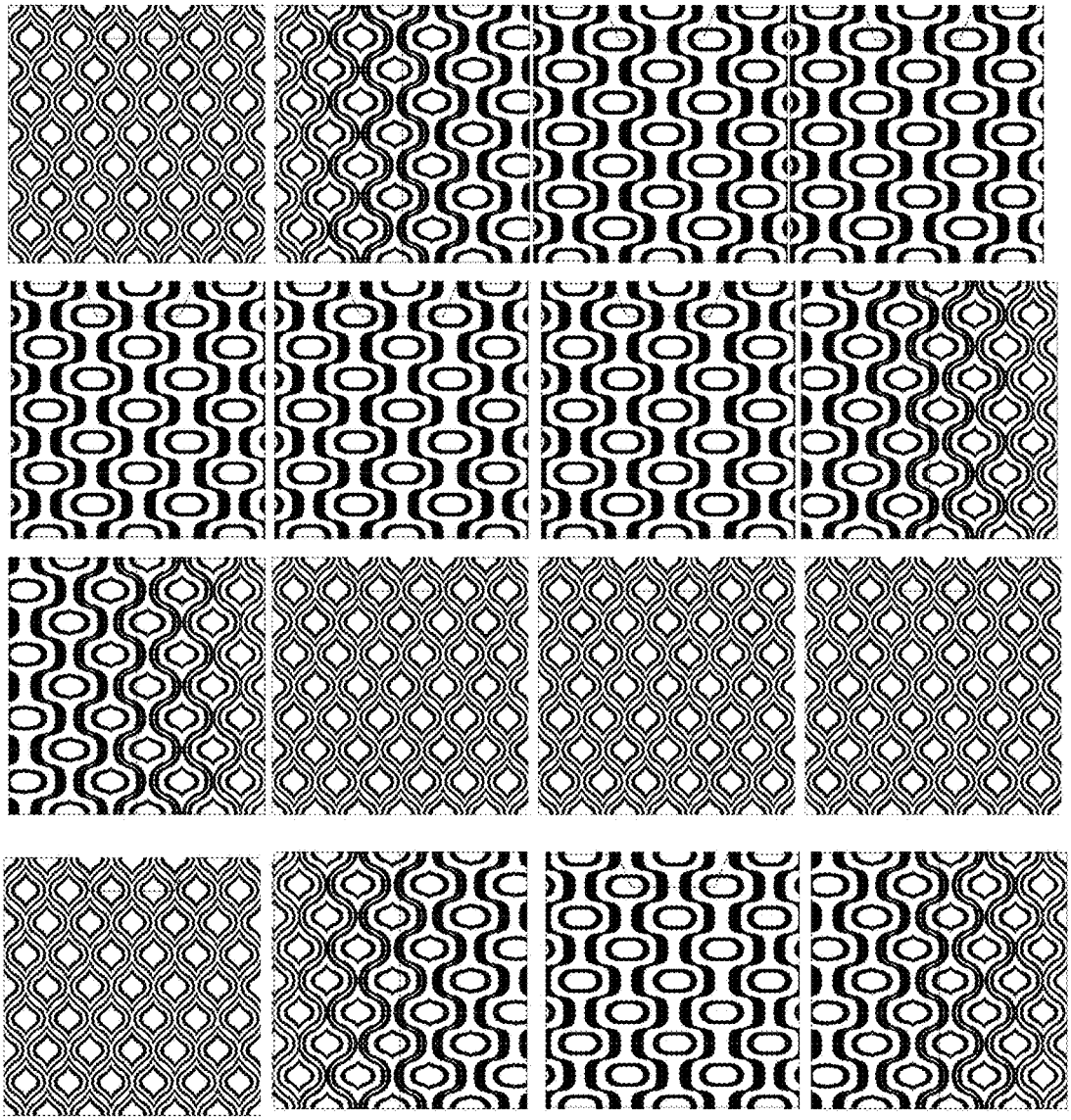

FIGS. 68 and 69 show how the pattern bins 278 may be placed in a shelving grid or cubby shelf to achieve various visual effects. The layout of the patterns and the morph allows a large number of interesting combinations. By only exposing the front or back patterns two very different patterns are given. By showing the sides, gradual transitions can be made. The bins can be arranged as desired by a user to create different visual patterns to make a storage shelving unit more attractive.

To create a morphing pattern, the pattern height typically needs to be the same, though the width can vary. Other mediums besides printing could also be sued such as molding or stitching. The patterns may also morph between different colors, etc.

Figure 70:
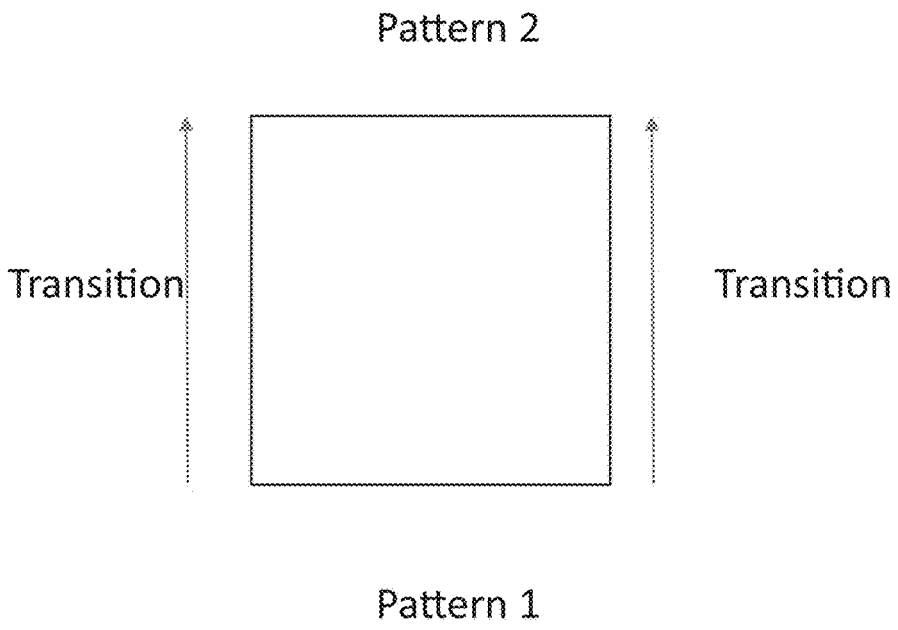
Figure 71:
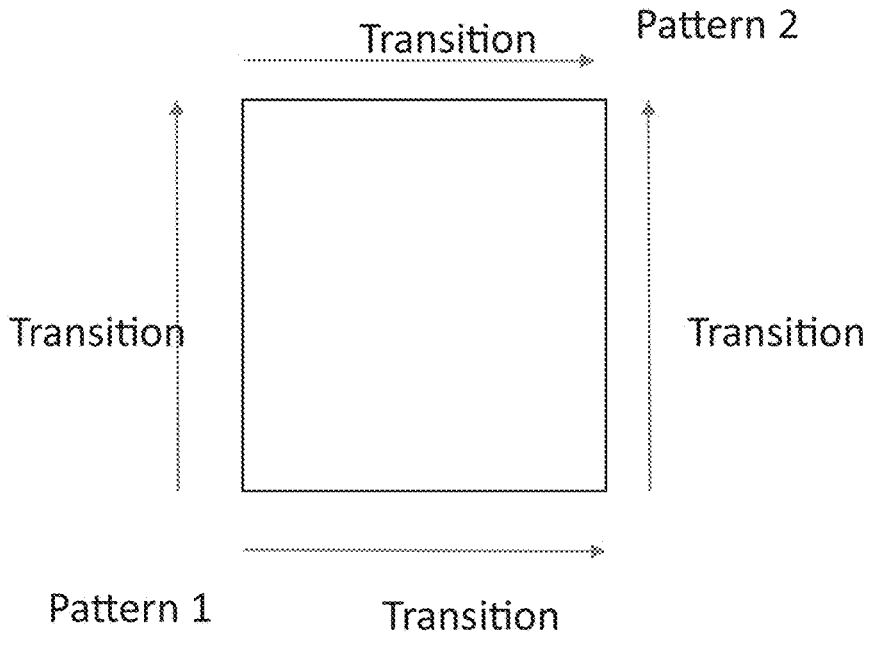

FIGS. 70 and 71 show two different ways for doing morphing prints on bins. These figures show top views of bins to illustrate how the patterns may change around the different sides of the bins. FIG. 70 shows a pattern on the front and a different pattern on the back with both sides having a pattern which morphs or transitions between the front and back patterns. FIG. 71 illustrates a bin which has a first pattern on a corner of the bin and a second different pattern on an opposite corner of the bin and all four sides morph or transition between the two patterns. The bin could start at one corner then morph to another print on the opposite corner, then morph back as one views successive sides around the bin.

The above description of illustrated examples of the present invention, including what is described in the Abstract, are not intended to be exhaustive or to be limitation to the precise forms disclosed. While specific examples of the invention are described herein for illustrative purposes, various equivalent modifications are possible without departing from the broader scope of the present claims. Indeed, it is appreciated that specific example dimensions, materials, voltages, currents, frequencies, power range values, times, etc., are provided for explanation purposes and that other values may also be employed in other examples in accordance with the teachings of the present invention.

What is claimed is:

1. A modular furniture system comprising:

a piece of furniture having:

a first bendable panel having a length, a width, a first face, a second face, and a thickness between the first face and the second face which is less than the length and which is less than the width;

a second panel having a length, a width, and a thickness which is less than the length and less than the width; and a joint connecting the first panel to the second panel comprising:

a slot cut through the thickness of the second panel to receive the first panel, the slot extending through an edge of the second panel to an opening in the edge of the second panel, the second panel having a first wall and a second wall which extend away from the opening in the edge of the second panel along a length of the slot, the length of the slot being larger than a width of the opening;

wherein the first panel is disposed in the slot so that the first face and second face of the first panel are held between the first wall and the second wall of the slot to assemble the joint; and wherein the slot is nonlinear along its length so that a section of the first panel which is located in the slot is bent by the first wall and the second wall of the slot and is maintained in a bent state when the first panel is disposed in the slot and when the first panel is held substantially perpendicular to the second panel after assembly of the joint; and wherein, for a section of the slot which is defined by a total length of the first panel which is located in the slot, said section of the slot defines an unobstructed linear path through said section of the slot which is narrower than the thickness of the first panel.

2. The modular furniture system of claim 1, wherein the first wall defines two points and a recessed surface therebetween and the second wall defines a first point located between the two points, and wherein the two points contact a first face of the first panel and the first point contacts a second face of the first panel at a location between the two points and maintains the first panel in a bent state after assembly of the joint.

3. The modular furniture system of claim 1, wherein the slot has a width between the first wall and the second wall which is between about 10 and 50 percent greater than a thickness of the first panel and wherein the unobstructed linear path through the slot is between about 90 and 50 percent of the thickness of the first panel.

4. The modular furniture system of claim 1, wherein the piece of furniture further comprises:

a joint comprising:

a tab slot formed in a panel selected from the group consisting of the first panel and the second panel;

a third panel having a first generally triangular tab extending from an edge thereof, the first tab being disposed in the tab slot so that the second panel extends from a first side of the first panel;

a fourth panel having a second generally triangular tab extending from an edge thereof, the second tab being disposed in the tab slot so that the third panel extends from a second side of the first panel;

wherein the first tab is disposed adjacent a first end of the tab slot, the second tab is disposed adjacent a second end of the tab slot, and the first tab and the second tab engage each other along an interface which is angled relative to the first and second ends of the tab slot.

5. The modular furniture system of claim 4, wherein the third panel and the fourth panel are back panels and wherein the panel selected from the group consisting of the first panel and the second panel is a vertical panel extending forwards from the third panel and the fourth panel.

6. The modular furniture system of claim 1, wherein the second panel is a vertical panel and wherein the first panel is a horizontal panel which forms a support surface.

7. The modular furniture system of claim 1, wherein the piece of furniture is a shelving unit and wherein the first panel and the second panel comprise a vertical panel and a horizontal panel which forms a shelf.

8. The modular furniture system of claim 1, wherein the first panel extends through the slot in the second panel and extends beyond opposing faces of the second panel.

9. A modular furniture system comprising:

a piece of furniture having:

a first joint comprising:

a first panel having a length, a width, a first face, a second face, and a thickness between the first face and the second face which is less than the length and which is less than the width;

a second panel having a length, a width, and a thickness which is less than the length and less than the width;

a slot formed through the thickness of the second panel which extends into the second panel through an edge of the second panel and is open to said edge, the second panel having a first wall and a second wall which extend away from the opening in the edge of the second panel along a length of the slot, the length of the slot being larger than a width of the opening;

wherein the slot is nonlinear;

wherein a section of the first panel is disposed in the slot so that the first face and second face of the first panel are held between the first wall and the second wall of the slot to assemble the joint, and wherein the first panel is held substantially perpendicular to the second panel and the section of the first panel disposed in the slot is bent by the slot and is held in a bent state by the slot after assembly of the joint, and wherein the slot, for a total length of the first panel disposed in the slot, defines an unobstructed linear path through the slot which is narrower than the thickness of the first panel.

10. The modular furniture system of claim 9, further comprising:

a second joint comprising:

a tab slot formed in a panel selected from the group consisting of the first panel and the second panel;

a third panel;

a first tab extending from an edge of the third panel, the first tab having a first edge which is generally perpendicular to the edge of the third panel and a second edge which extends at an angle relative to the edge of the third panel so as to reduce the width of an outer portion of the first tab;

a fourth panel;

a second tab extending from an edge of the fourth panel, the second tab having a first edge which is generally perpendicular to the edge of the fourth panel and a second edge which extends at an angle relative to the edge of the fourth panel so as to reduce the width of an outer portion of the second tab;

wherein the first tab is disposed in the tab slot such that the third panel extends away from a first side of the panel selected from the group consisting of the first panel and the second panel and such that the first edge of the first tab is disposed adjacent a first end of the tab slot; and wherein the second tab is disposed in the tab slot such that the fourth panel extends away from a second side of the panel selected from the group consisting of the first panel and the second panel generally in a direction opposite the third panel and such that the first edge of the second tab is disposed adjacent a second end of the tab slot and such that the second edge of the first tab and the second edge of the second tab are disposed adjacent each other.

11. The modular furniture system of claim 10, wherein the second edge of the first tab defines a line disposed at an angle relative to the first edge of the first tab and the second edge of the second tab defines a line disposed at an angle relative to the first edge of the second tab.

12. A modular furniture system comprising:

a piece of furniture comprising:

a first panel having a length, a width, a first face, a second face, and a thickness between the first face and the second face which is less than the length and which is less than the width;

a second panel having a length, a width, and a thickness which is less than the length and less than the width;

a slot formed through the thickness of the second panel which extends into the second panel through an edge of the second panel and is open at said edge, the second panel having a first wall and a second wall which extend away from the opening in the edge of the second panel along a length of the slot to bound the slot, the length of the slot being larger than a width of the opening;

wherein the slot is nonlinear;

wherein the first panel and the second panel collectively comprise a vertical panel and a horizontal panel which forms a shelf;

wherein a section of the first panel is disposed in the slot so that the first face and second face of the first panel are held between the first wall and the second wall of the slot to assemble the joint, and wherein the section of the first panel disposed in the slot is bent by the slot and is held in a bent state by the slot after assembly of the joint, and wherein, for a total length of the first panel which is disposed in the slot, there is an unobstructed linear path through the slot which is narrower than the thickness of the first panel.

13. The modular furniture system of claim 12, wherein the first wall comprises two points and a recessed surface between the two points and wherein the second wall defines a first point located between the two points, and wherein the two points contact a first face of the first panel and the first point contacts a second face of the first panel at a location between the two points and maintains the first panel in a bent state after assembly of the joint.

14. The modular furniture system of claim 12, wherein the second panel comprises a plurality of slots which receive a plurality of intersecting panels, and wherein at least one of the plurality of slots receives a panel and holds said panel in a bent state after assembly and wherein at least one of the plurality of slots receives a panel and does not hold said panel in a bent state after assembly.

15. The modular furniture system of claim 12, wherein the furniture comprises a plurality of vertical panels and a plurality of horizontal panels which are connected to form an array of receptacles.

16. The modular furniture system of claim 15, wherein each of the plurality of vertical panels and each of the plurality of horizontal panels have a front edge which is wave shaped and wherein the array of receptacles defines a front face which is wave shaped.

17. The modular furniture system of claim 16, wherein the array of receptacles defines a front face with a wave pattern having crests and troughs which are aligned on a diagonal of the receptacles.

18. The modular furniture system of claim 15, wherein the plurality of vertical panels and the plurality of horizontal panels are connected to form a first rectangular grid, wherein a second plurality of vertical panels and a second plurality of horizontal panels are connected to form a second array of receptacles defining a second rectangular grid, and wherein the first array of receptacles and the second array of receptacles are attachable together to form a larger array of receptacles.

19. A modular piece of furniture comprising:

a first panel having a length, a width, a first face, a second face, and a thickness between the first face and the second face which is less than the length and which is less than the width;

a second panel having a length, a width, and a thickness which is less than the length and less than the width;

wherein the first panel and the second panel collectively form a vertical support panel and a horizontal shelf panel; and a joint between the first and second panel comprising:

an elongate slot formed through the second panel having a width and a length which is greater than the width, wherein the slot extends through an edge of the second panel and is open at said edge and wherein the length of the slot extends into the second panel away from the edge of the second panel;

wherein the slot is nonlinear;

wherein a section of the first panel is disposed in the slot so that the first panel extends transversely through the second panel and so that the first face and second face of the first panel are held by slot edges, wherein the section of the first panel which is disposed in the slot is bent by the slot and is held in a bent state by the slot after assembly of the joint, and wherein, for a section of the slot corresponding to a total length of the first panel which is disposed in the slot, there is an unobstructed linear path through said section of the slot which is narrower than the thickness of the first panel.

20. The modular piece of furniture of claim 19, wherein the first panel is bent elastically by the slot while remaining generally flat.

* * * * *